US009968126B2

(12) United States Patent
Thiry

(10) Patent No.: US 9,968,126 B2
(45) Date of Patent: May 15, 2018

(54) CIGARETTE MANUFACTURING MACHINES AND METHODS

(71) Applicant: HSPT Golden Rainbow LLC, Coppell, TX (US)

(72) Inventor: Philippe Thiry, Hemmingford (CA)

(73) Assignee: HSPT GOLDEN RAINBOW LLC, Coppell, TX (US)

( * ) Notice: Subject to any disclaimer, the term of this patent is extended or adjusted under 35 U.S.C. 154(b) by 948 days.

(21) Appl. No.: 14/456,444

(22) Filed: Aug. 11, 2014

(65) Prior Publication Data

US 2015/0047654 A1 Feb. 19, 2015

Related U.S. Application Data

(60) Provisional application No. 61/865,209, filed on Aug. 13, 2013.

(51) Int. Cl.
*A24C 5/06* (2006.01)
*A24C 5/00* (2006.01)

(52) U.S. Cl.
CPC ..... *A24C 5/06* (2013.01)

(58) Field of Classification Search
None
See application file for complete search history.

(56) References Cited

U.S. PATENT DOCUMENTS 4,488,562 A 12/1984 Remington
5,214,988 A 6/1993 Quigley
5,615,692 A 4/1997 Ruppert et al.
5,769,095 A 6/1998 Schramm
6,913,022 B2 * 7/2005 Moser ..... A24C 5/42 131/70
7,066,183 B2 6/2006 Parcevaux
7,597,105 B2 10/2009 Barnes et al.
2006/0096604 A1 5/2006 Moser et al.
2007/0193591 A1 8/2007 Anderson et al.
2010/0229880 A1 9/2010 Bao
(Continued)

FOREIGN PATENT DOCUMENTS

CN 101986903 A 3/2011
CN 202407060 U 9/2012
(Continued)

OTHER PUBLICATIONS

International Search Report and Written Opinion for PCT/US2014/050532 by ISA/US dated Dec. 23, 2014, 13 pages.
(Continued)

*Primary Examiner* — Dennis R Cordray
(74) *Attorney, Agent, or Firm* — Haynes and Boone, LLP

(57) ABSTRACT

In one aspect, an apparatus for manufacturing cigarettes includes a housing, a mandrel extending from the housing, and a movable member operably coupled to the housing and adapted to carry a first cigarette tube. The movable member is movable, relative to each of the housing and the mandrel, in a first direction and a second direction that is opposite the first direction. In another aspect, a method of manufacturing cigarettes includes loading a first cigarette tube on a mandrel, holding the first cigarette tube on the mandrel, and inserting a push rod and a carrot of pre-cut tobacco leaves into the first cigarette tube, the carrot of pre-cut tobacco leaves having a generally cylindrical shape. An offset distance is defined between the first cigarette tube and the mandrel after the push rod and the carrot of pre-cut tobacco leaves are inserted into the first cigarette tube.

26 Claims, 60 Drawing Sheets

(56) References Cited

U.S. PATENT DOCUMENTS

| | | | | |
|---|---|---|---|---|
| 2011/0265805 | A1* | 11/2011 | Laplante | A24C 5/06 131/78 |
| 2011/0303230 | A1* | 12/2011 | Thiry | A24C 5/06 131/81.1 |
| 2012/0240950 | A1 | 9/2012 | Laplante et al. | |
| 2012/0291790 | A1 | 11/2012 | Bao | |
| 2013/0047996 | A1 | 2/2013 | Ryszard et al. | |
| 2013/0152952 | A1 | 6/2013 | Bao | |
| 2013/0192612 | A1 | 8/2013 | Prevost | |
| 2014/0202471 | A1 | 7/2014 | Bao | |

FOREIGN PATENT DOCUMENTS

| | | | |
|---|---|---|---|
| EP | 0151377 | B1 | 3/1989 |
| EP | 0746988 | A1 | 12/1996 |
| GB | 352082 | A | 7/1931 |
| GB | 2501336 | A | 10/2013 |

OTHER PUBLICATIONS

Examination Report for European Patent Application No. 14836049.8, prepared by the European Patent Office, dated Oct. 23, 2017. (5 pages).

English Translation of the First Office Action for Chinese Patent Application No. 201480056126.9, prepared by the Chinese State Intellectual Property Office, dated Aug. 15, 2017. (23 pages).

Examination Report for European Patent Application No. 14836049.8, prepared by the European Patent Office, dated Feb. 24, 2017. (5 pages).

* cited by examiner

CIGARETTE MANUFACTURING MACHINES AND METHODS

CROSS-REFERENCE TO RELATED APPLICATION

This application claims the benefit of the filing date of, and priority to, U.S. patent application No. 61/865,209, filed Aug. 13, 2013, the entire disclosure of which is hereby incorporated herein by reference.

TECHNICAL FIELD

The present disclosure relates in general to cigarette manufacturing machines and, in particular, to cigarette manufacturing machines for home and personal use.

BACKGROUND

Cigarette manufacturing machines for home and personal use are sometimes referred to as roll-your-own ("RYO") machines. Typically, an RYO machine is used to form a cylinder or "carrot" of tobacco, and to inject the tobacco carrot into an empty cigarette tube, thereby manufacturing a cigarette. RYO machines may be manually or automatically operated, or may require a combination of manual and automatic operation. However, typical RYO machines are not able to automatically manufacture a plurality of cigarettes precisely, uniformly, and efficiently, absent some degree of manual operation or intervention. Tubes may be damaged during the operation of a typical RYO machine, precluding the manufacture of acceptable cigarettes. Additionally, tobacco carrots may not include enough compacted tobacco to form acceptable cigarettes. Typical RYO machines may not be able to accommodate user preferences such as, for example, the amount of tobacco the user desires to be included in each cigarette, or environmental considerations such as, for example, humidity. Therefore, what is needed is an apparatus, kit, system, or method that addresses one or more of the above-described issues, and/or one or more other issues.

DETAILED DESCRIPTION

Figure 1:
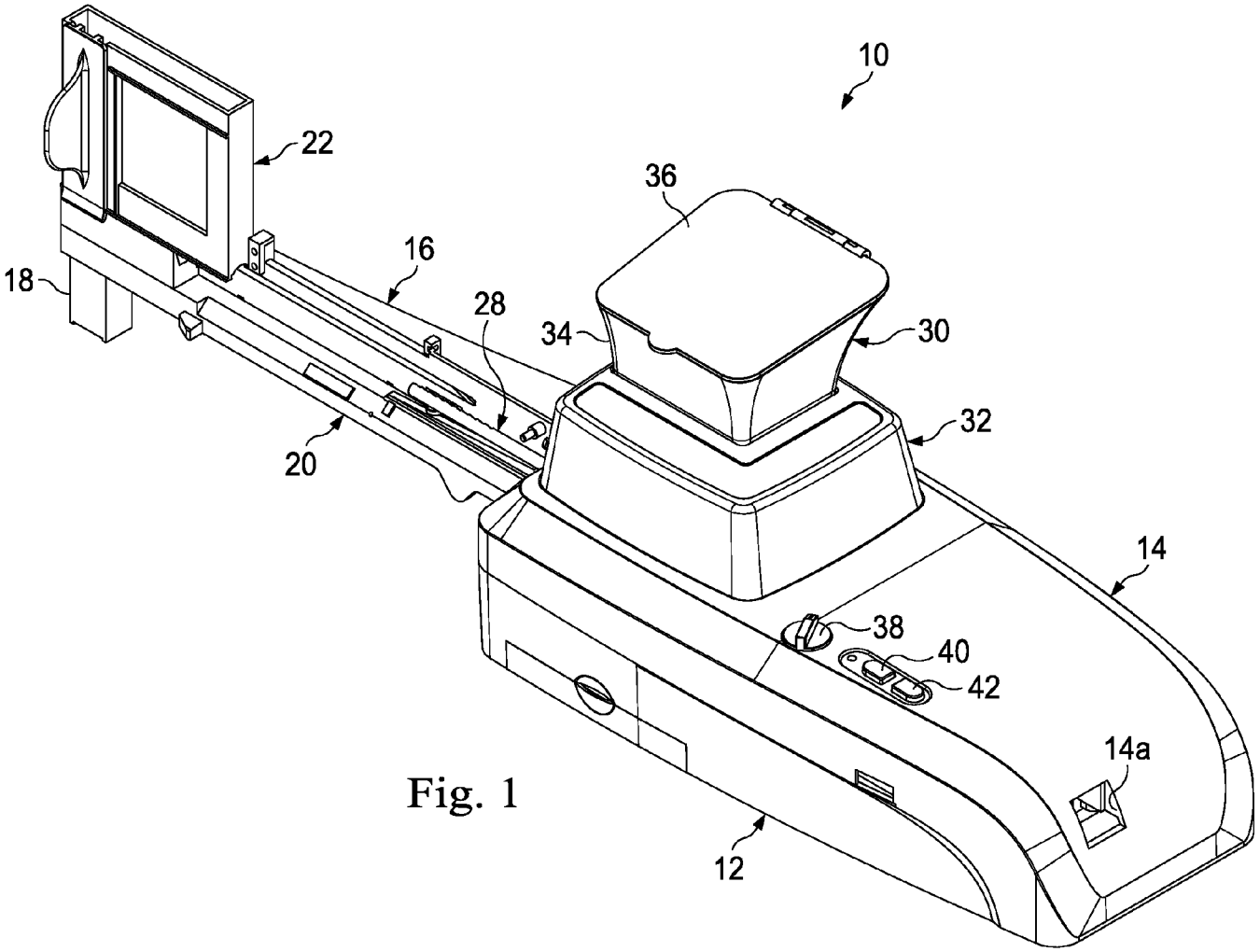
FIGS. 1-3 are different perspective views of a cigarette manufacturing machine according to an exemplary embodiment, the cigarette manufacturing machine including a horizontal support, a tube magazine assembly, a cigarette stopper assembly, a tube holding assembly, a carrot injection assembly, and a carrot forming assembly, according to respective exemplary embodiments.
Figure 2:
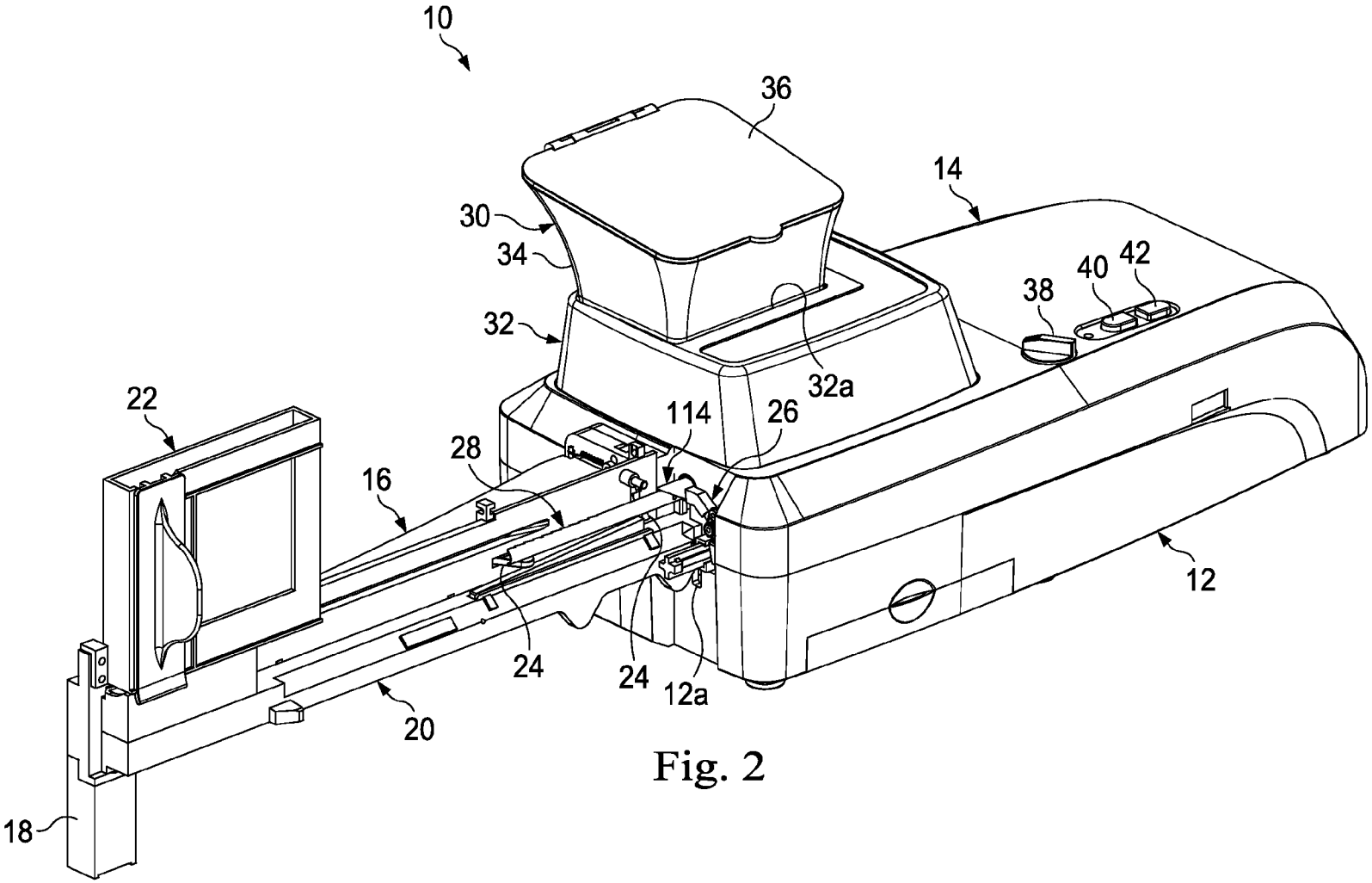
Figure 3:
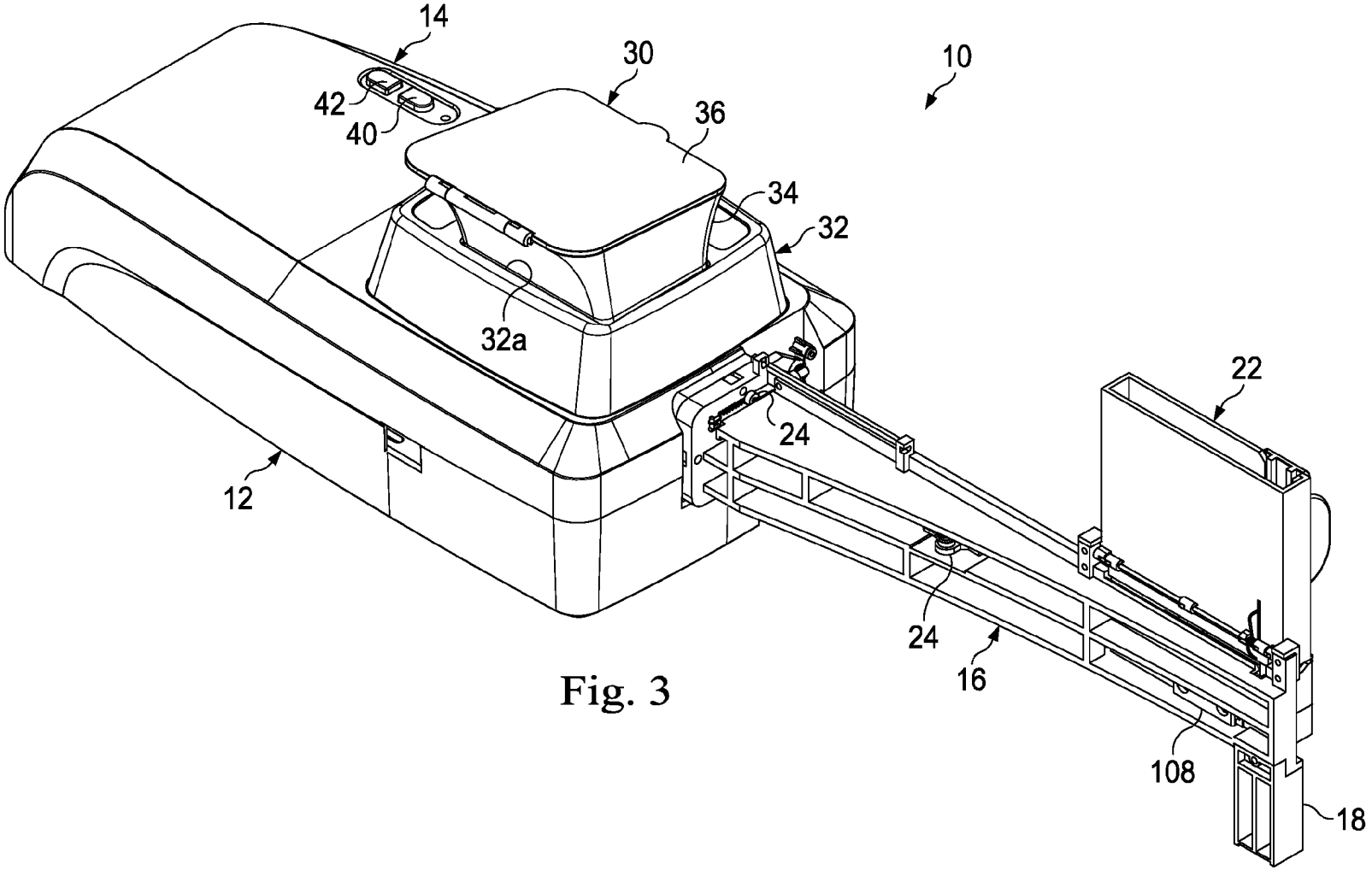

In an exemplary embodiment, as illustrated in FIGS. 1-3, a cigarette manufacturing machine is generally referred to by the reference numeral 10 and includes a lower housing 12 and an upper housing 14 connected thereto. A horizontal support 16 extends from the housings 12 and 14, and includes an end post 18 at the distal end thereof. An opening 14*a* is formed through the upper housing 14 at the end thereof opposite the horizontal support 16. A carriage assembly 20 is operably coupled to the horizontal support 16 and the housings 12 and 14. A tube magazine assembly 22 is connected to the horizontal support 16. A cigarette stopper assembly 24 is connected to the horizontal support 16. A tube holding assembly 26 is connected to the housings 12 and 14. A carrot injection assembly 28 is operably coupled to the upper housing 14. A carrot forming assembly 30 is operably coupled to the upper housing 14. The carrot forming assembly 30 includes a guard 32 mounted on top of the upper housing 14, a hopper 34 operably coupled to the upper housing 14 and surrounded by the guard 32, and a cover 36 hingedly connected to the hopper 34. A tobacco compaction level switch 38, a pause/start button 40, and an on/off button 42 are operably coupled to the upper housing 14.

Figure 4:
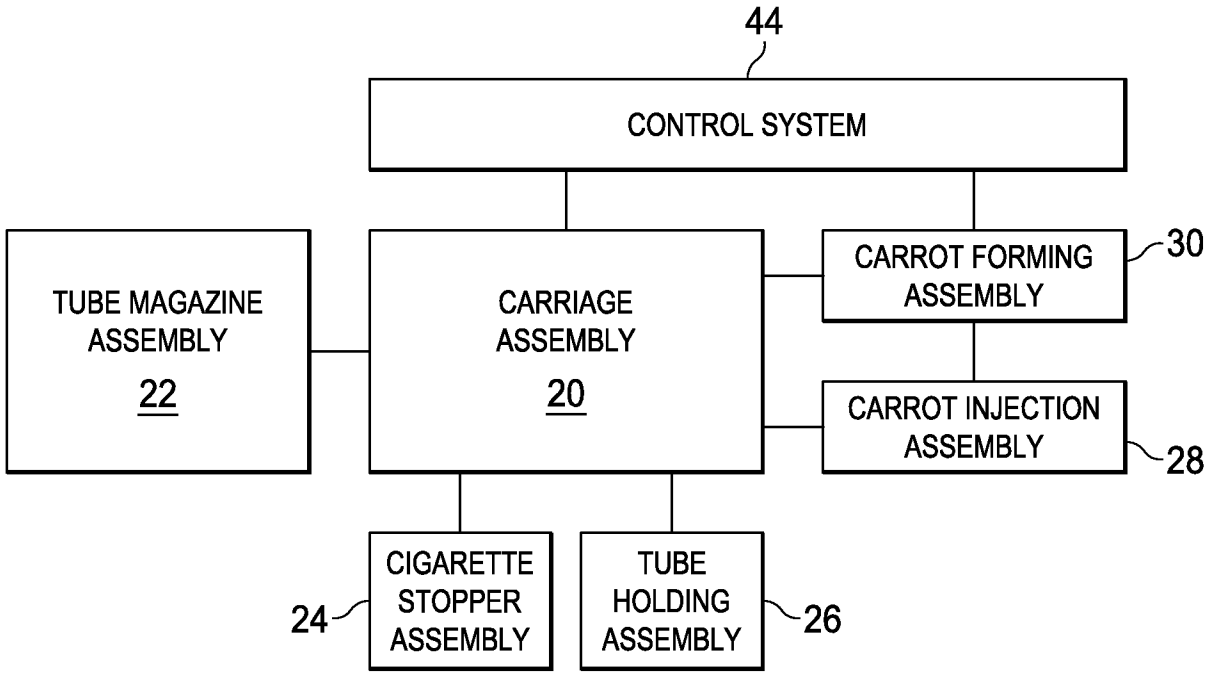
FIG. 4 is a diagrammatic illustration of the cigarette manufacturing machine of FIGS. 1-3 according to an exemplary embodiment, the cigarette manufacturing machine further including a control system.

In an exemplary embodiment, as illustrated in FIG. 4 with continuing reference to FIGS. 1-3, each off the tube magazine assembly 22, the cigarette stopper assembly 24, the tube holding assembly 26, the carrot injection assembly 28, and the carrot forming assembly 30 is operably coupled to the carriage assembly 20. The carrot forming assembly 30 is also operably coupled to the carrot injection assembly 28. A control system 44 is operably coupled to each of the carriage assembly 20 and the carrot forming assembly 30.

Figure 5:
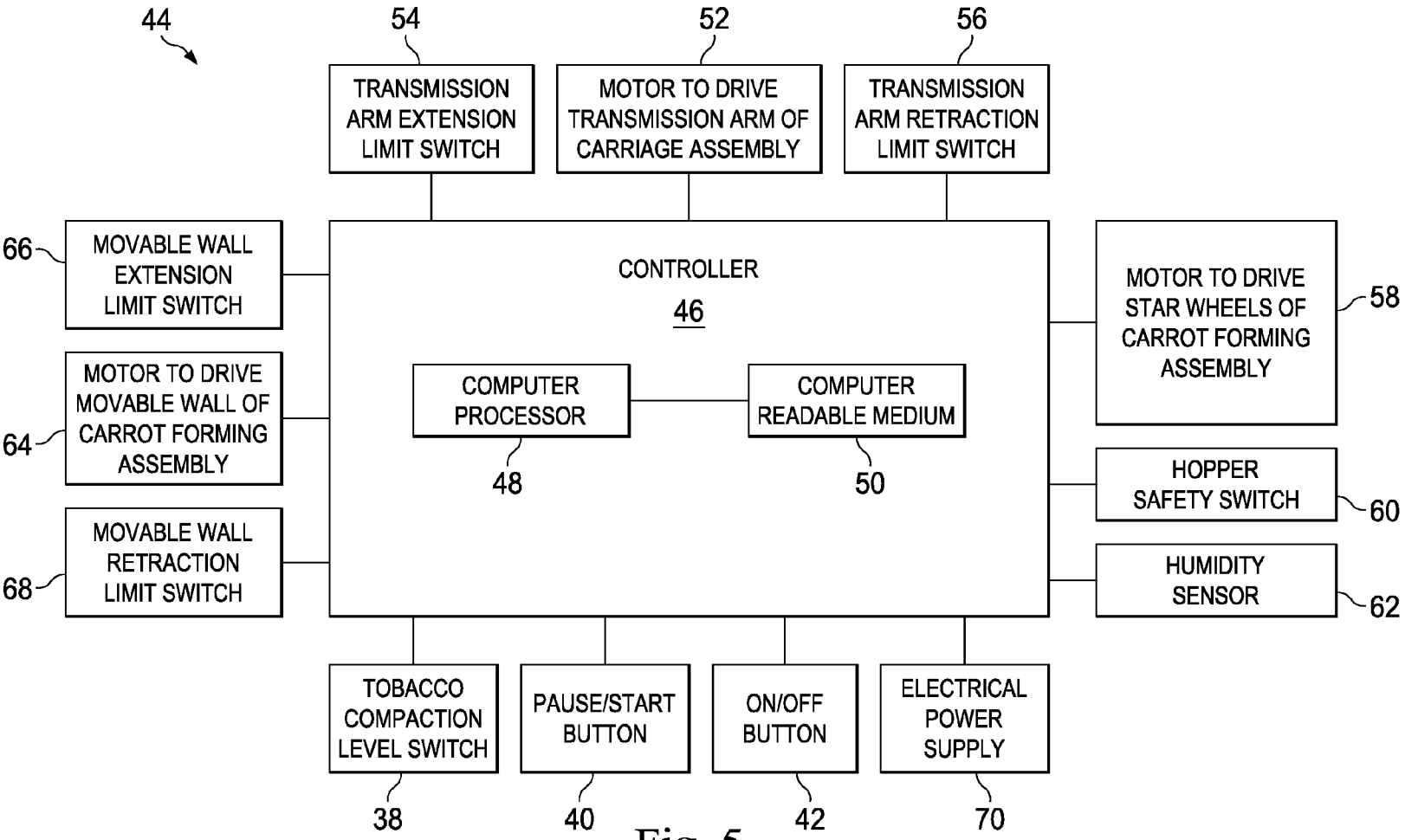
FIG. 5 is a diagrammatic illustration of the control system of FIG. 4 according to an exemplary embodiment.

In an exemplary embodiment, as illustrated in FIG. 5 with continuing reference to FIGS. 1-4, the control system 44 includes a controller 46, which includes a computer processor 48 and a computer readable medium 50 in communication therewith. Instructions accessible to, and executable by, the computer processor 48 are stored on the computer readable medium 50. In several exemplary embodiments, the controller 46 includes a plurality of controllers. In several exemplary embodiments, the computer processor 48 includes a plurality of computer processors. In several exemplary embodiments, the computer readable medium 50 includes a plurality of computer readable mediums.

As shown in FIG. 5, a motor 52 to drive a transmission arm (described below) of the carriage assembly 20 is in communication with the controller 46. A transmission arm extension limit switch 54 and a transmission arm retraction limit switch 56 are in communication with the controller 46. A motor 58 to drive star wheels (described below) of the carrot forming assembly 30 is in communication with the controller 46. A hopper safety switch 60 and a humidity sensor 62 are in communication with the controller 46. A motor 64 to drive a movable wall (described below) of the carrot forming assembly 30 is in communication with the controller 46. A movable wall extension limit switch 66 and a movable wall retraction limit switch 68 are in communication with the controller 46. The tobacco compaction level switch 38, the pause/start button 40, and the on/off button 42 are in communication with the controller 46. An electrical power supply 70 is in communication with the controller 46, and is configured to supply electrical power to the controller 46 and the foregoing components in communication therewith.

Figure 6A:
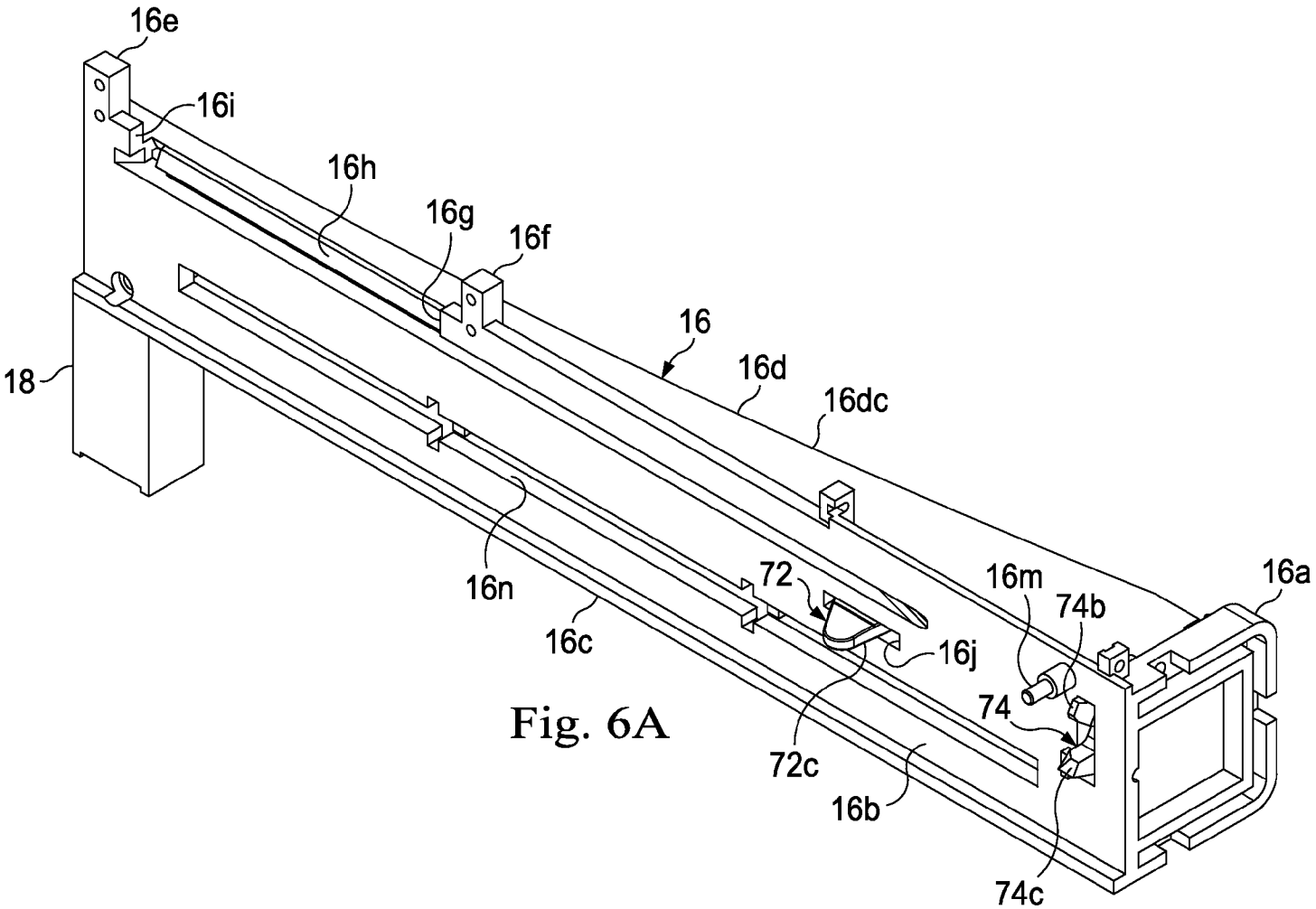
FIGS. 6A-6C are different perspective views of the horizontal support and the cigarette stopper assembly of the cigarette manufacturing machine of FIGS. 1-3, according to an exemplary embodiment.
Figure 6B:
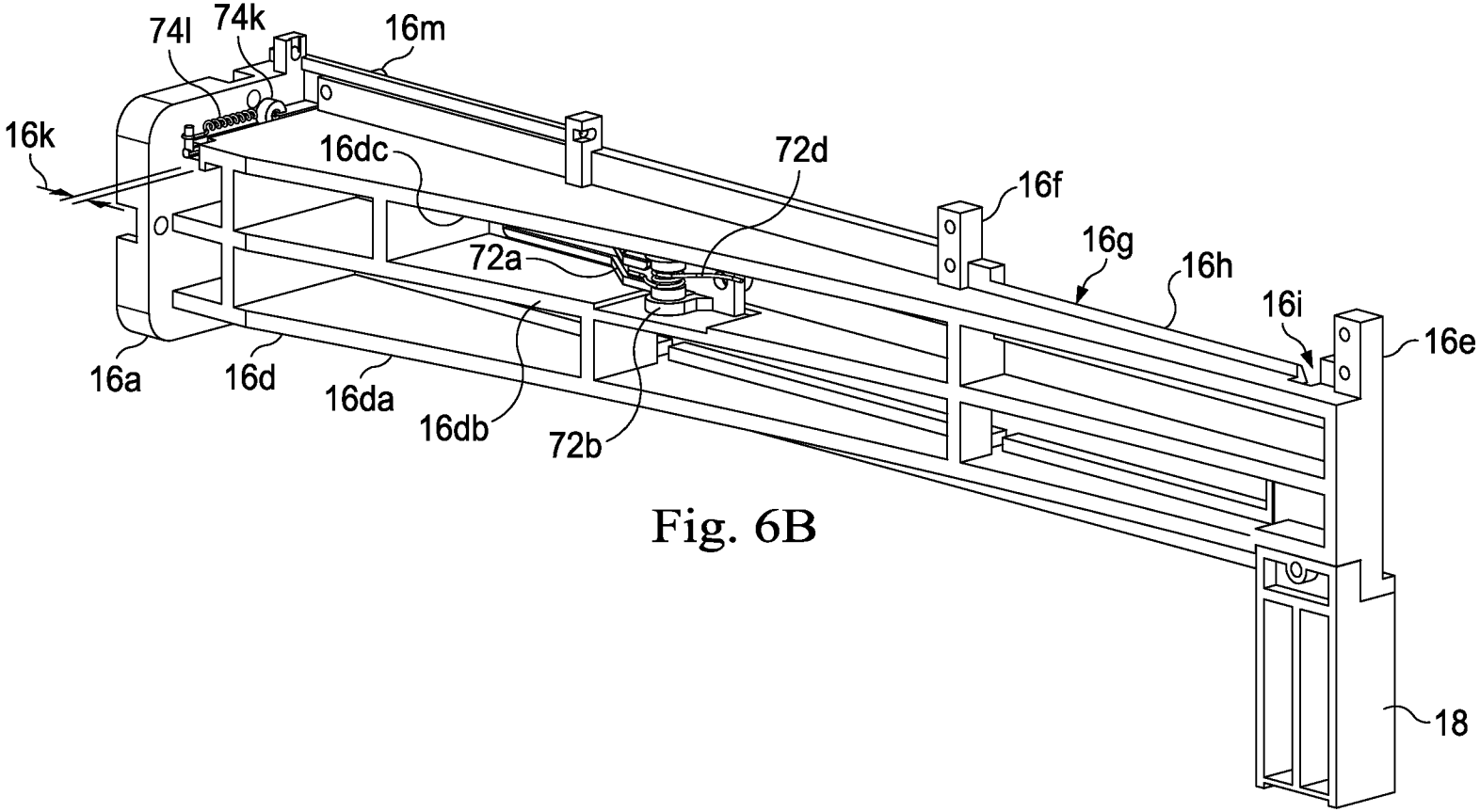
Figure 6C:
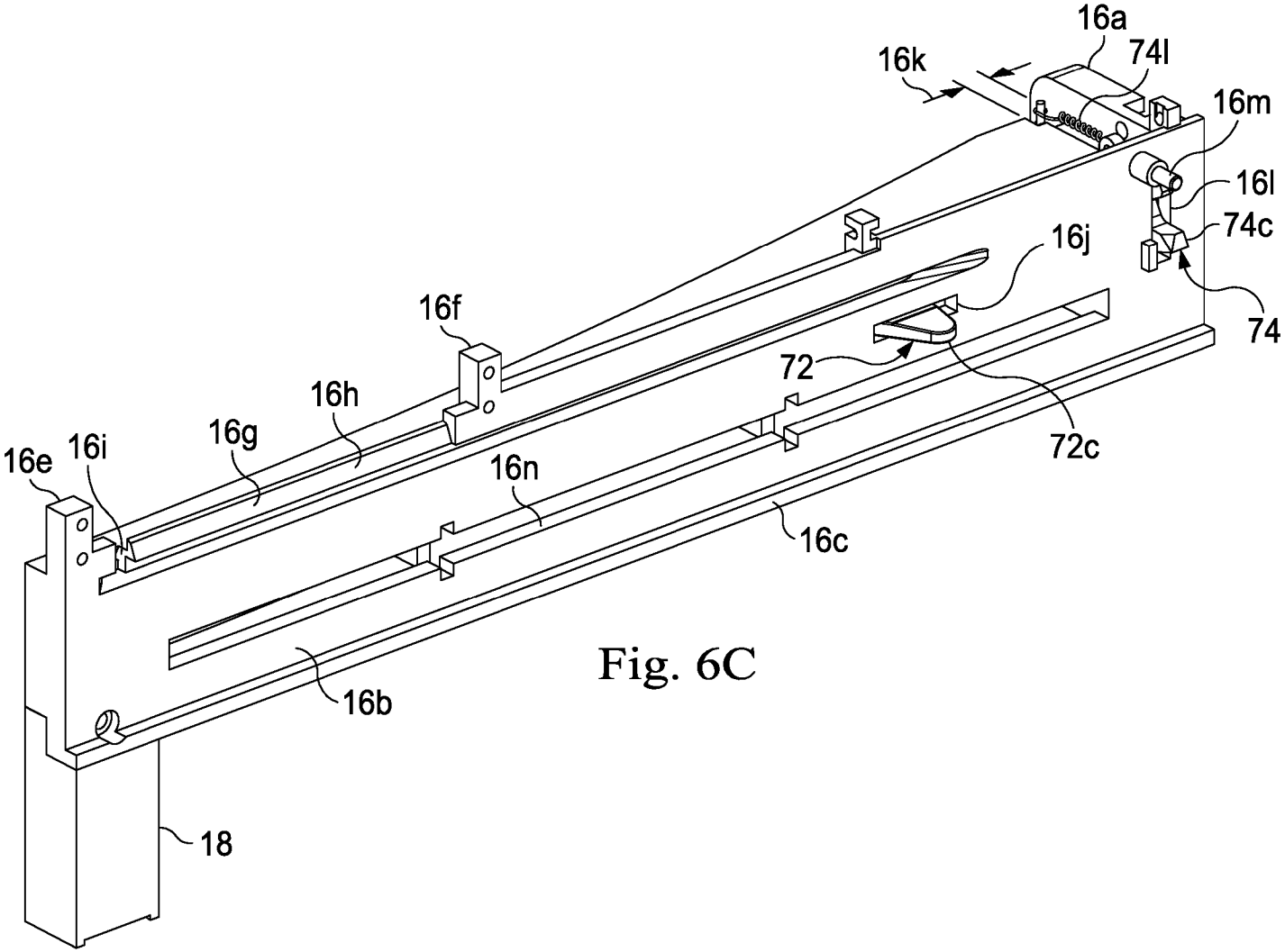

In an exemplary embodiment, as illustrated in FIGS. 6A-6C with continuing reference to FIGS. 1-5, the horizontal support 16 includes an end portion 16*a* that is located opposite the end post 18 and connected to the housings 12 and 14. A vertically-extending wall 16*b* extends from the end portion 16*a* to the end post 18. A support shoulder 16*c* extends along the lower end of the vertically-extending wall 16*b*. A gusset 16*d*, which includes vertically-spaced horizontal walls 16*da*, 16*db*, and 16*dc*, extends along the back of the vertically-extending wall 16*b*, that is, the side of the vertically-extending wall 16*b* opposite the support shoulder 16*c*. Horizontally-spaced posts 16*e* and 16*f* extend upwards from the vertically-extending wall 16*b*. The side of the post 16*e* opposite the end portion 16*a* is generally horizontally aligned with the side of the end post 18 opposite the end portion 16*a*. A horizontally-extending notch 16*g* is formed in the upper end of the vertically-extending wall 16*b*, and between the posts 16*e* and 16*f*. An angularly-extending surface 16*h* is defined by the notch 16*g*. A notch 16*i* is located proximate the post 16*e*. The notch 16*i* is defined between the end of the angularly-extending surface 16*h* opposite the post 16*f*, and the end of the horizontally-extending notch 16*g* opposite the post 16*f*. A horizontal slot 16*j* is formed through the vertically-extending wall 16*b*, and is vertically positioned between the horizontal walls 16*db* and 16*dc* of the gusset 16*d*. A horizontal gap 16*k* is defined between the end portion 16*a* and the end of the horizontal wall 16*dc* of the gusset 16*d* opposite the end post 18. The horizontal walls 16*da* and 16*db* of the gusset 16*d* are connected to the end portion 16*a*. A vertical slot 16*l* is formed through the vertically-extending wall 16*b*, and is horizontally positioned at the gap 16*k*. A guide roller 16*m* extends perpendicularly outward from the vertically-extending wall 16*b*, and is vertically positioned slightly above the vertical slot 16*l* and, as viewed in FIG. 6A, slightly to the left of the vertical slot 16*l*. A horizontally-extending slot 16*n* is formed through the vertically-extending wall 16*b*, and is vertically positioned between the horizontal walls 16*da* and 16*db*.

As noted above, the cigarette stopper assembly 24 is connected to the horizontal support 16. The cigarette stopper assembly 24 includes a cigarette end support 72 and a cigarette horizontal travel stopper 74, both of which are connected to the horizontal support 16. In several exemplary embodiments, the horizontal support 16, or at least a portion thereof, may be part of the cigarette stopper assembly 24.

Figure 7A:
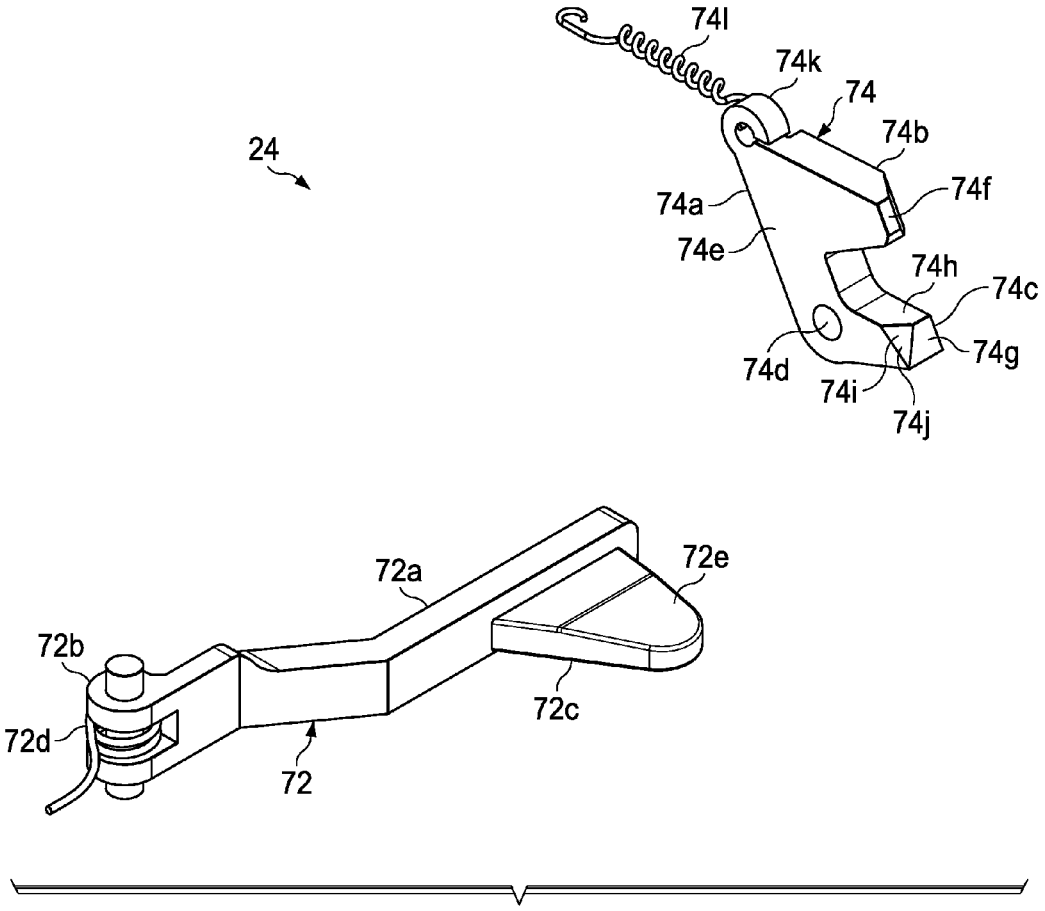
FIG. 7A is a perspective view of two components of the cigarette stopper assembly of FIGS. 6A-6C, according to an exemplary embodiment.
Figure 7B:
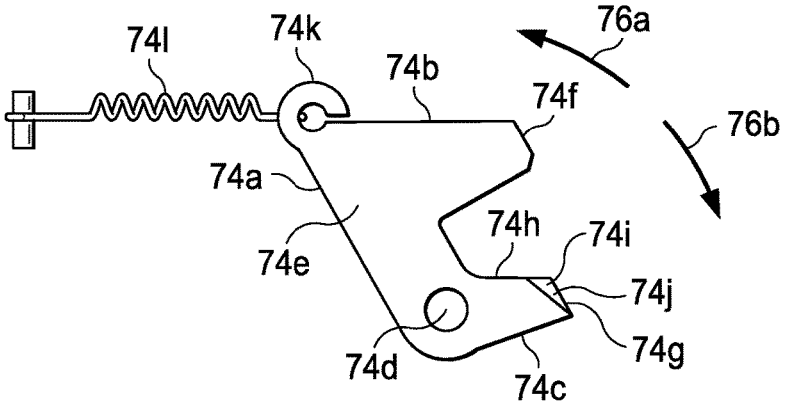
FIG. 7B is an elevational view of one of the two components of FIG. 7A, according to an exemplary embodiment.
Figure 7C:
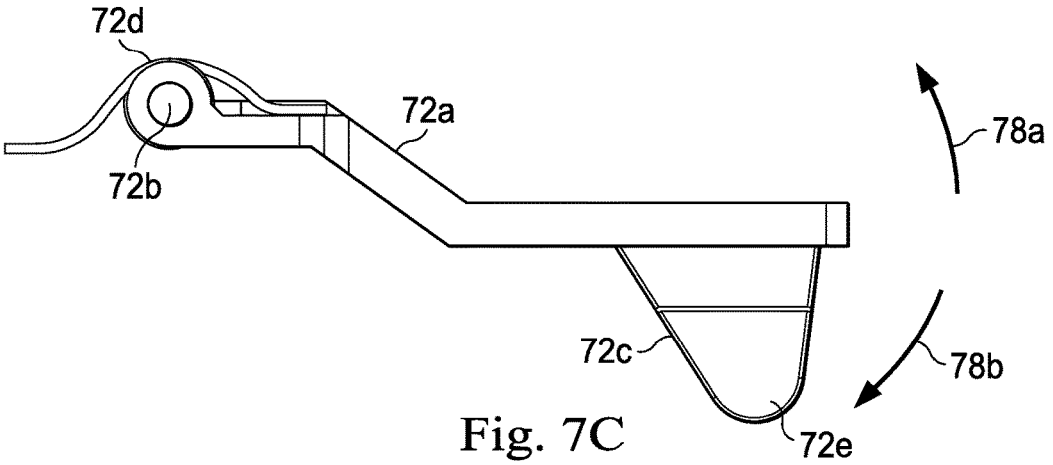
FIG. 7C is a top plan view of the other of the two components of FIG. 7A, according to an exemplary embodiment.

In an exemplary embodiment, as illustrated in FIGS. 7A-7C with continuing reference to FIGS. 1-6C, the cigarette end support 72 and the cigarette horizontal travel stopper 74 are shown without the horizontal support 16. As shown in FIGS. 7A and 7B, the cigarette horizontal travel stopper 74 includes a generally C-shaped bracket 74*a*, which includes an upper protrusion 74*b* and a lower protrusion 74*c*. A pin connection 74*d* extends through the bracket 74*a* proximate the lower protrusion 74*c* thereof. The bracket 74*a* defines a vertically-extending planar surface 74*e*. The protrusions 74*b* and 74*c* define planar end surfaces 74*f* and 74*g*, respectively, both of which are perpendicular to the planar surface 74*e*. An upper surface 74*h* is defined by the lower protrusion 74*c*. A chamfer 74*i* is formed at the location where the planar surface 74*e*, the planar end surface 74*g* of the lower protrusion 74*c*, and the upper surface 74*h* of the lower protrusion 74*c* meet to form a corner, but for the presence of the chamfer 74*i*. As a result, the chamfer 74*i* defines an angularly-extending triangular surface 74*j*. The bracket 74*a* includes a hook feature 74*k* proximate the base of the upper protrusion 74*b*. A helical spring 74*l* is connected to the hook feature 74*k*, and extends from the bracket 74*a* in a horizontal direction generally opposite the respective extensions of the protrusions 74*b* and 74*c*. The bracket 74*a* is adapted to rotate, about the pin connection 74*d*, back and forth as indicated by arrows 76*a* and 76*b* in FIG. 7B.

As shown in FIGS. 7A and 7C, the cigarette end support 72 includes an arm 72*a*, a pin connection 72*b* at one end of the arm 72*a*, and a tab 72*c* at the other end of the arm 72*a*. The pin connection 72*b* includes a torsion spring 72*d*. A horizontally-extending surface 72*e* is defined by the tab 72*c*. The tab 72*c* is adapted to pivot, about the pin connection 72*b*, back and forth as indicated by arrows 78*a* and 78*b* in FIG. 7C.

Referring back to FIGS. 6A-6C, the pin connection 72*b* of the cigarette end support 72*d* is connected to the gusset 16*d*, and is disposed between the horizontal walls 16*db* and 16*dc* of the gusset 16*d*. The arm 72*a* extends horizontally between the horizontal walls 16*db* and 16*dc*. The torsion spring 72*d* provides a biasing force against the arm 72*a*, urging the tab 72*c* to pivot, about the pin connection 72*b* and in the direction indicated by the arrow 78*b* in FIG. 7C, so that the tab 72*c* extends through the horizontal slot 16*j* of the horizontal support 16. The pin connection 74*d* of the cigarette horizontal travel stopper 74 is connected to at least the end portion 16*a* of the horizontal support 16. The helical spring 74*l* is connected to a vertically-extending protrusion, which may be connected to the end portion 16*a* and/or a bracket that extends within the gap 16*k* and is connected to the end portion 16*a* and/or the horizontal wall 16*dc*. At least respective portions of the C-shaped bracket 74*a*, the pin connection 74*d*, and the helical spring 74*l* are disposed in the gap 16*k*. At any given time, at least one of the protrusions 74*b* and 74*c* extends through the vertical slot 16*l* of the horizontal support 16. In several exemplary embodiments, at any given time, at least respective portions of the protrusions 74*b* and 74*c* extend through the vertical slot 16*l*. The helical spring 74*l* provides a biasing force against the C-shaped bracket 74*a*, urging the C-shaped bracket 74*a* to rotate, about the pin connection 74*d* and in the direction indicated by the arrow 76*a* in FIG. 7B, so that none, or at least less, of the upper protrusion 74*b* of the C-shaped bracket 74*a* extends through the vertical slot 16*l* and more of the lower protrusion 74*c* extends through the vertical slot 16*l*.

In an exemplary embodiment, as illustrated in FIGS. 8A-8F with continuing reference to FIGS. 1-7C, the tube magazine assembly 22 includes a quadrilateral structure 80, a bottom door 82 hingedly connected to the quadrilateral structure 80, and a cigarette tube holder 84 adapted to engage the quadrilateral structure 80. The quadrilateral structure 80 defines a top opening 80*a*, a bottom opening 80*b*, a vertically-extending front side 80*c* extending between the openings 80*a* and 80*b*, and a vertically-extending back side 80*d* extending between the openings 80*a* and 80*b*. An opening 80*e* is formed in the front side 80*c*. A slot 80*f* is also formed in the front side 80*c*, extending from the top opening 80*a* and terminating at a lower end portion of the front side 80*c*. Respective tabs 80*g* and 80*h* are disposed on opposing sides of the quadrilateral structure 80 at the lower end portion thereof, and extend from the back side 80*d*. The bottom door 82 includes a hinged connection 82*a*, at which the bottom door is hingedly connected to the back side 80*d* of the quadrilateral structure 80. The hinged connection 82*a* includes a torsion spring 82*b*, which engages the back side 80*d* of the quadrilateral structure 80 and a horizontally-extending block 82*c* of the bottom door 82. The block 82*c* defines an angularly-extending surface 82*d*. A vertically-extending protrusion 82*e* extends downward from the block

Figure 8A:
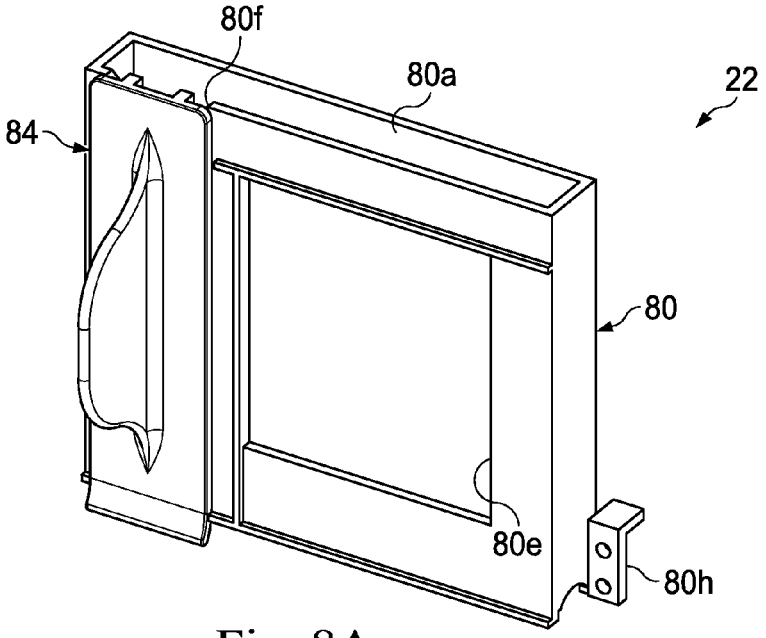
FIG. 8A is a perspective view of the tube magazine assembly of the cigarette manufacturing machine of FIGS. 1-3, according to an exemplary embodiment.
Figure 8B:
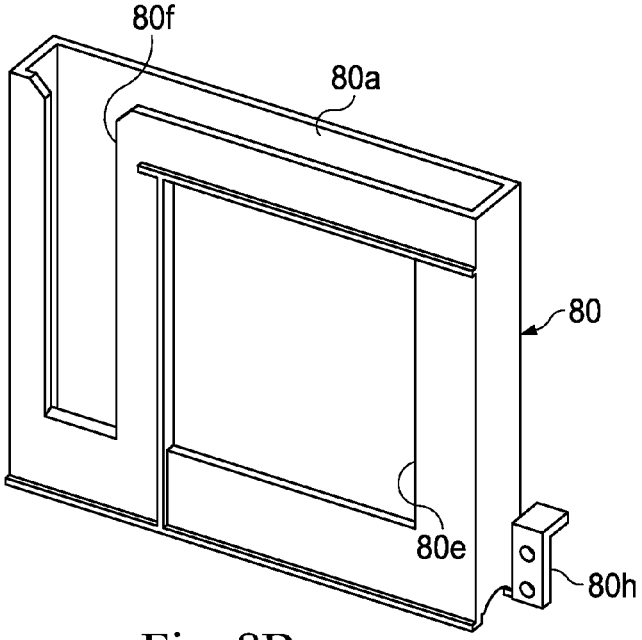
FIGS. 8B-8D are different perspective views of a portion of the tube magazine assembly of FIG. 8A, according to an exemplary embodiment.

82*c* at the end thereof proximate the tab 80*g*. An angularly-extending surface 82*f* is defined by the protrusion 82*e*. As shown in FIG. 8E, the tabs 80*g* and 80*h* of the quadrilateral structure 80 are connected to the posts 16*e* and 16*f*, respectively, of the horizontal support 16, thereby connecting the tube magazine assembly 22 to the horizontal support 16.

Figure 8C:
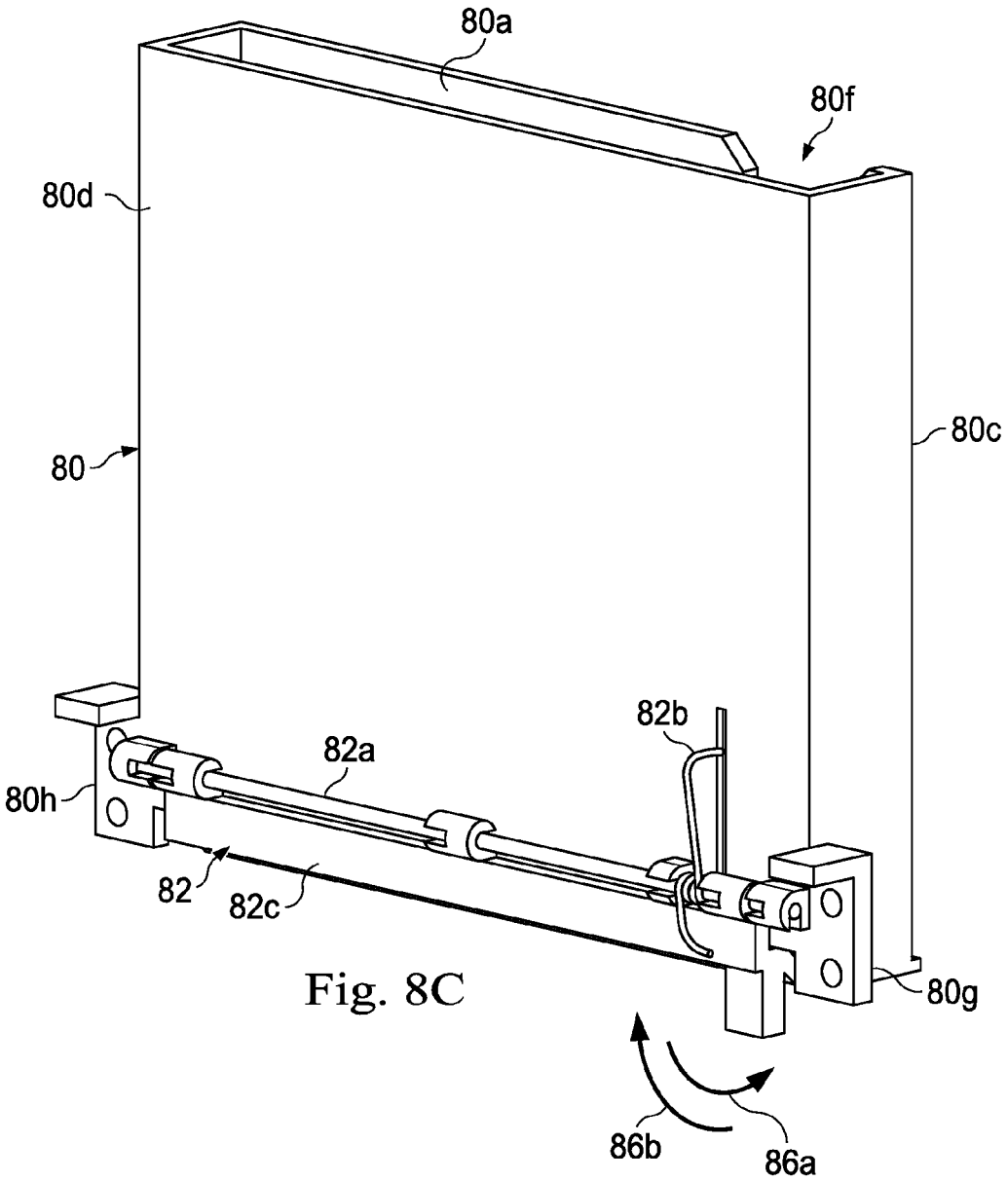
Figure 8D:
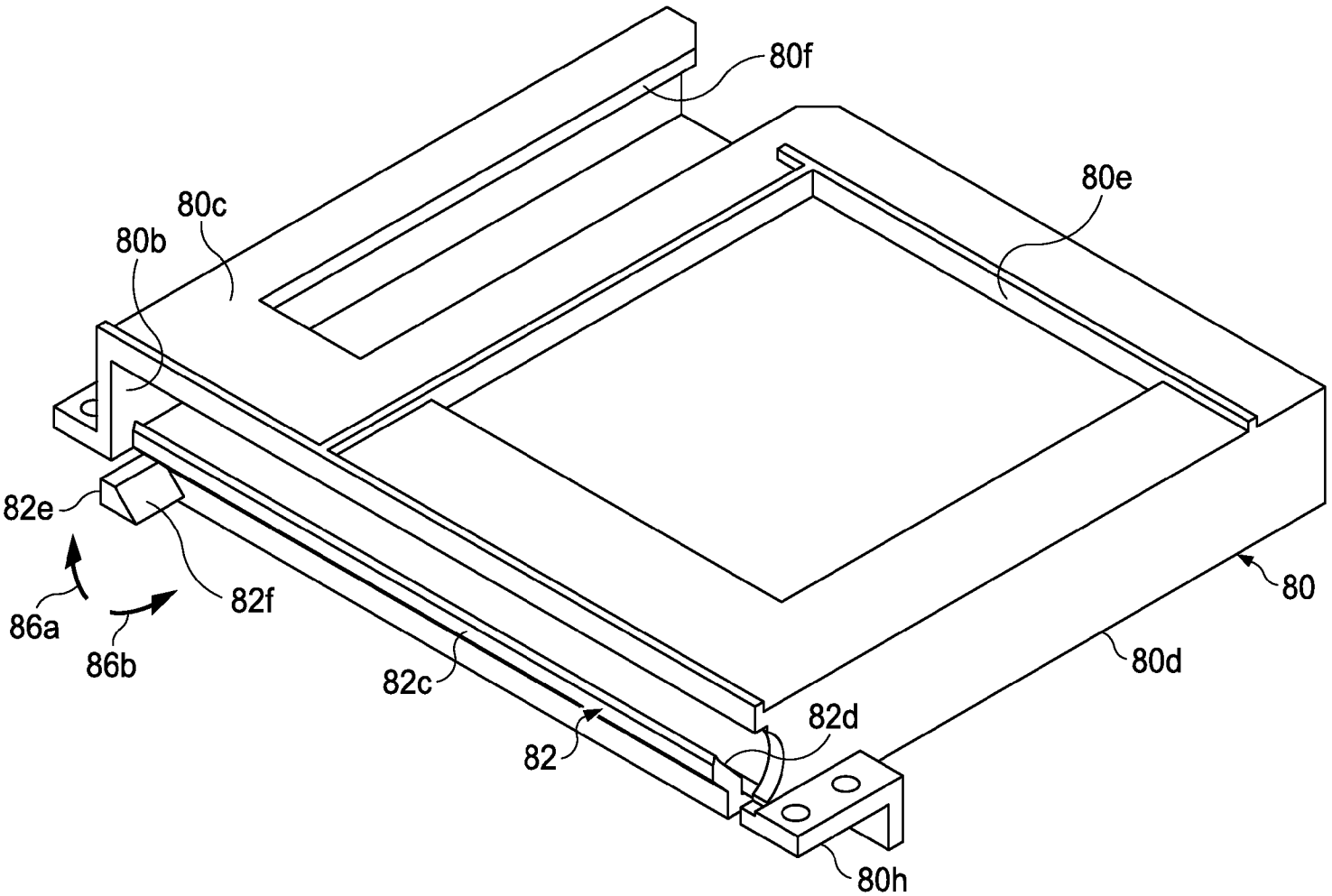
Figure 8E:
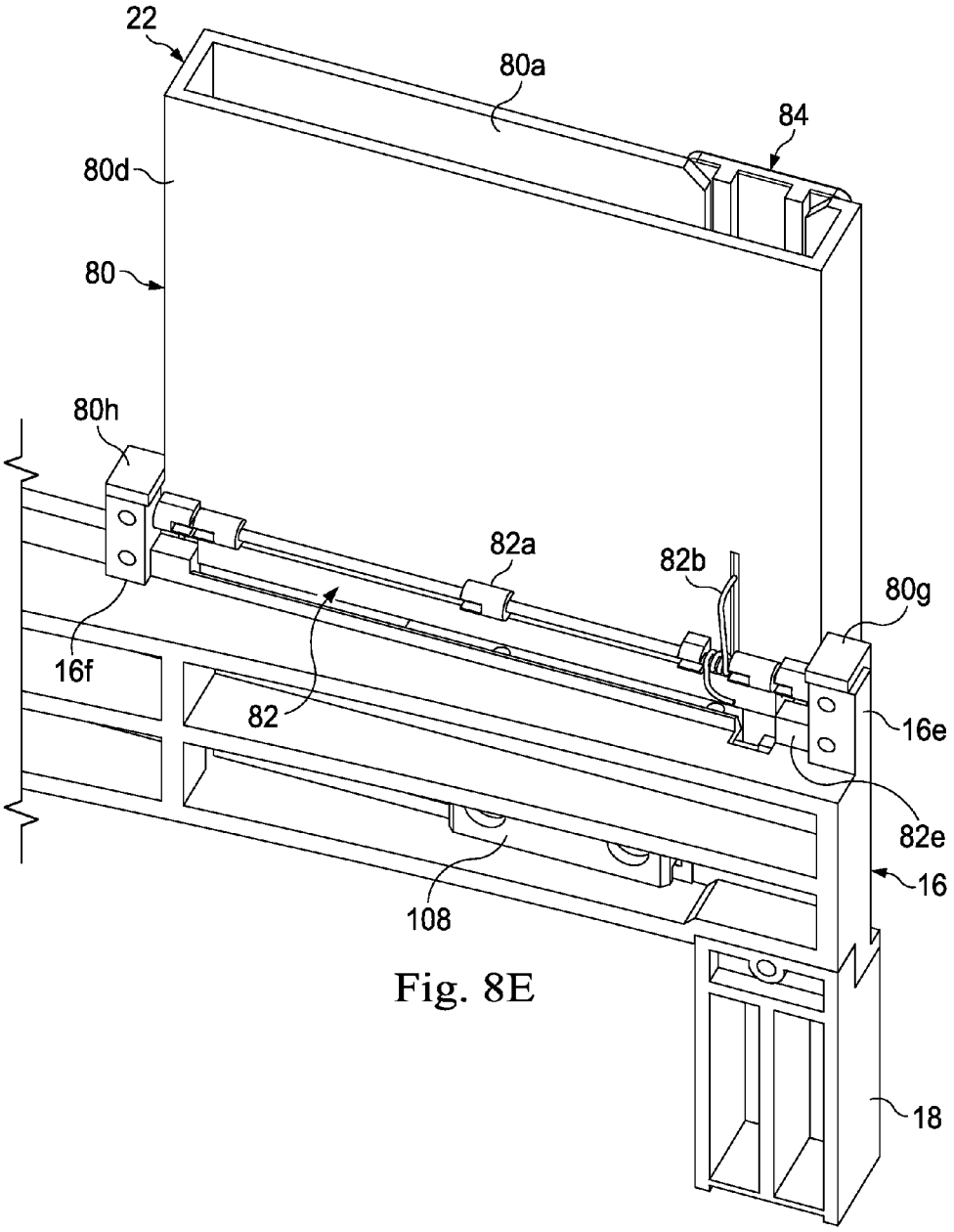
FIG. 8E is a perspective view of the tube magazine assembly of FIG. 8A connected to the horizontal support of FIGS. 6A-6C, according to an exemplary embodiment.

The block 82*c* of the bottom door 82 is adapted to pivot, about the hinged connection 82*a*, back and forth as indicated by arrows 86*a* and 86*b* in FIGS. 8C, 8D, and 8E. The torsion spring 82*b* provides a biasing force against the block 82*c*, urging the block 82*c* to pivot, about the hinged connection 82*a* and in the direction indicated by the arrow 86*a* in FIGS. 8C and 8D, so that the block 82*c* at least partially blocks the bottom opening 80*b* of the quadrilateral structure 80.

Figure 8F:
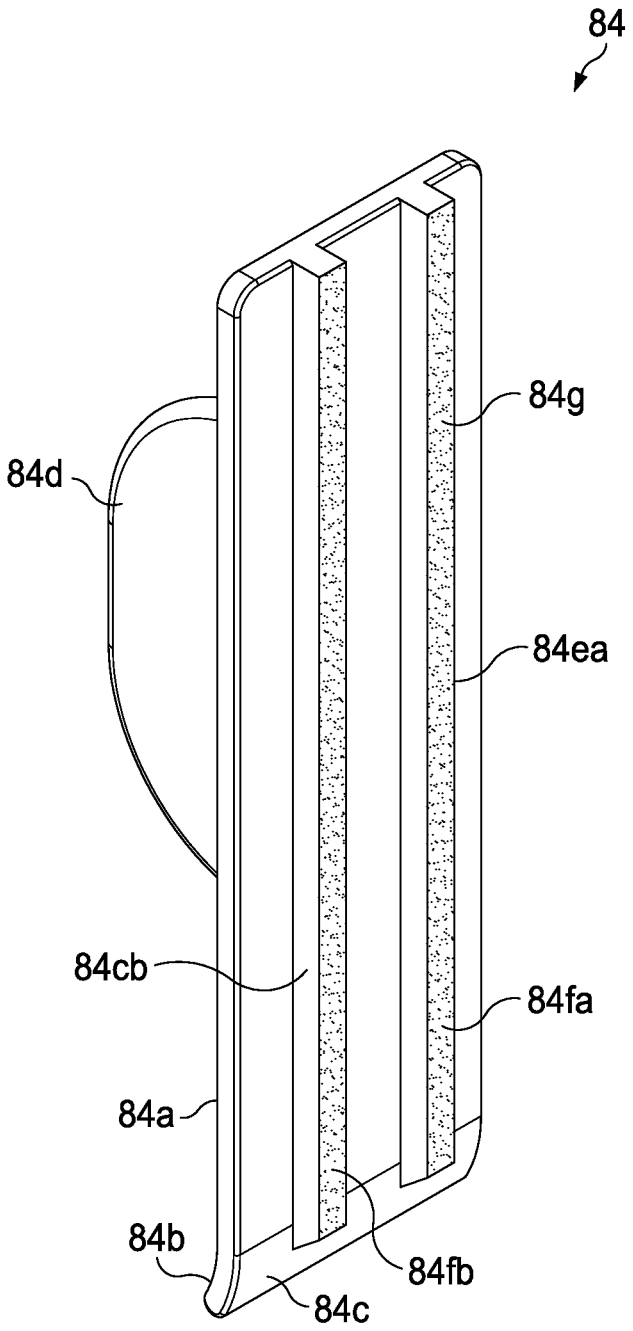
FIG. 8F is a perspective view of a handle of the tube magazine assembly of FIG. 8A, according to an exemplary embodiment.

As shown in FIGS. 8A and 8F, the cigarette tube holder 84 includes a rectangular plate 84*a* including a curved end portion 84*b*, which defines a curved surface 84*c*. A handle 84*d* extends along the plate 84*a* on one side thereof, and parallel-spaced ribs 84*ea* and 84*eb* extend along the plate 84*a* on the other side thereof, which side includes the curved surface 84*c*. The ribs 84*ea* and 84*eb* define surfaces 84*fa* and 84*fb*, respectively, which are offset from the plate 84*a*. One or more adhesives 84*g*, such as glue and/or tape, are connected to at least the surfaces 84*fa* and 84*fb*.

Figure 9A:
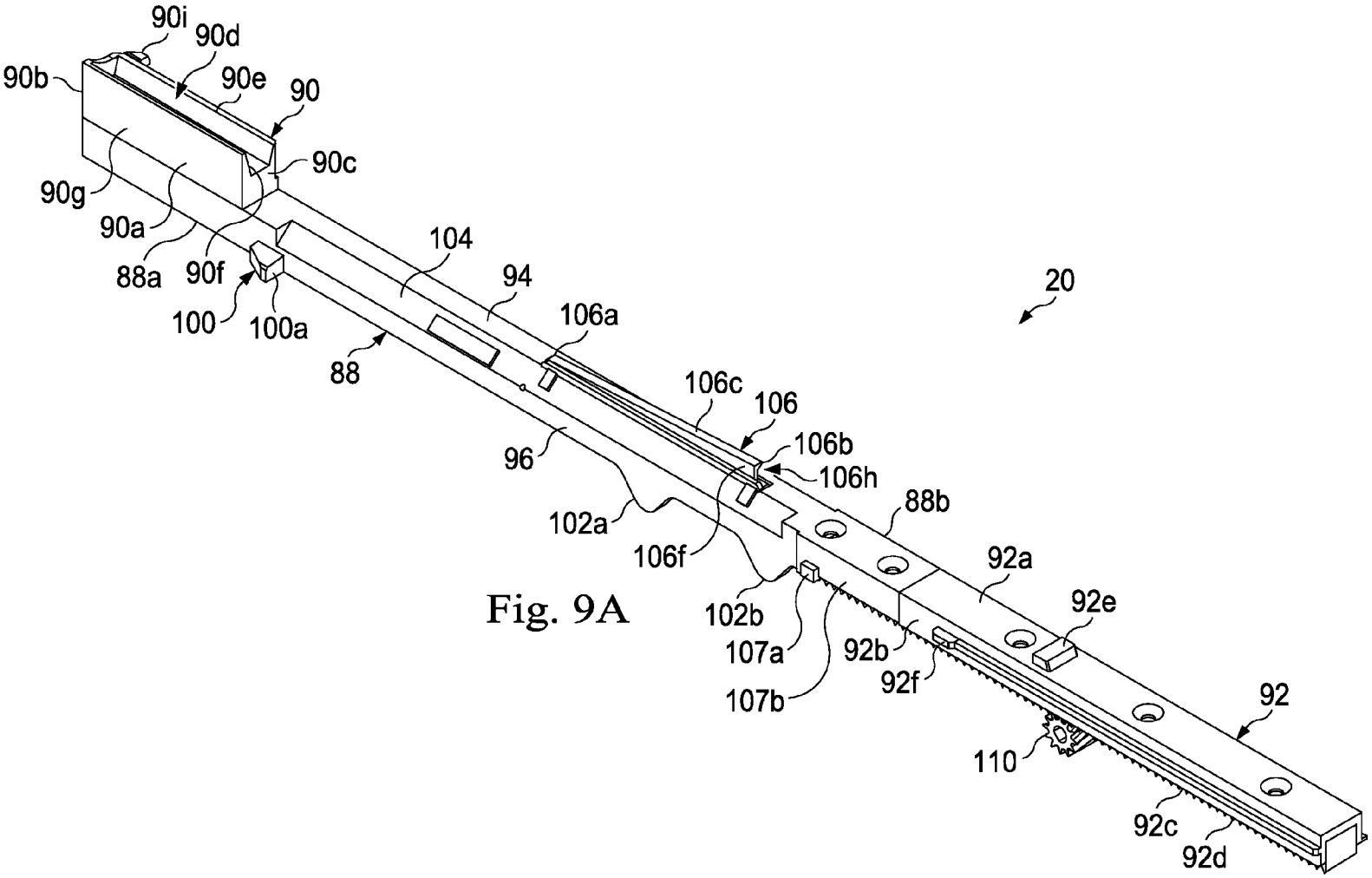
FIG. 9A is a perspective view of the carriage assembly of the cigarette manufacturing machine of FIGS. 1-3, according to an exemplary embodiment.
Figure 9B:
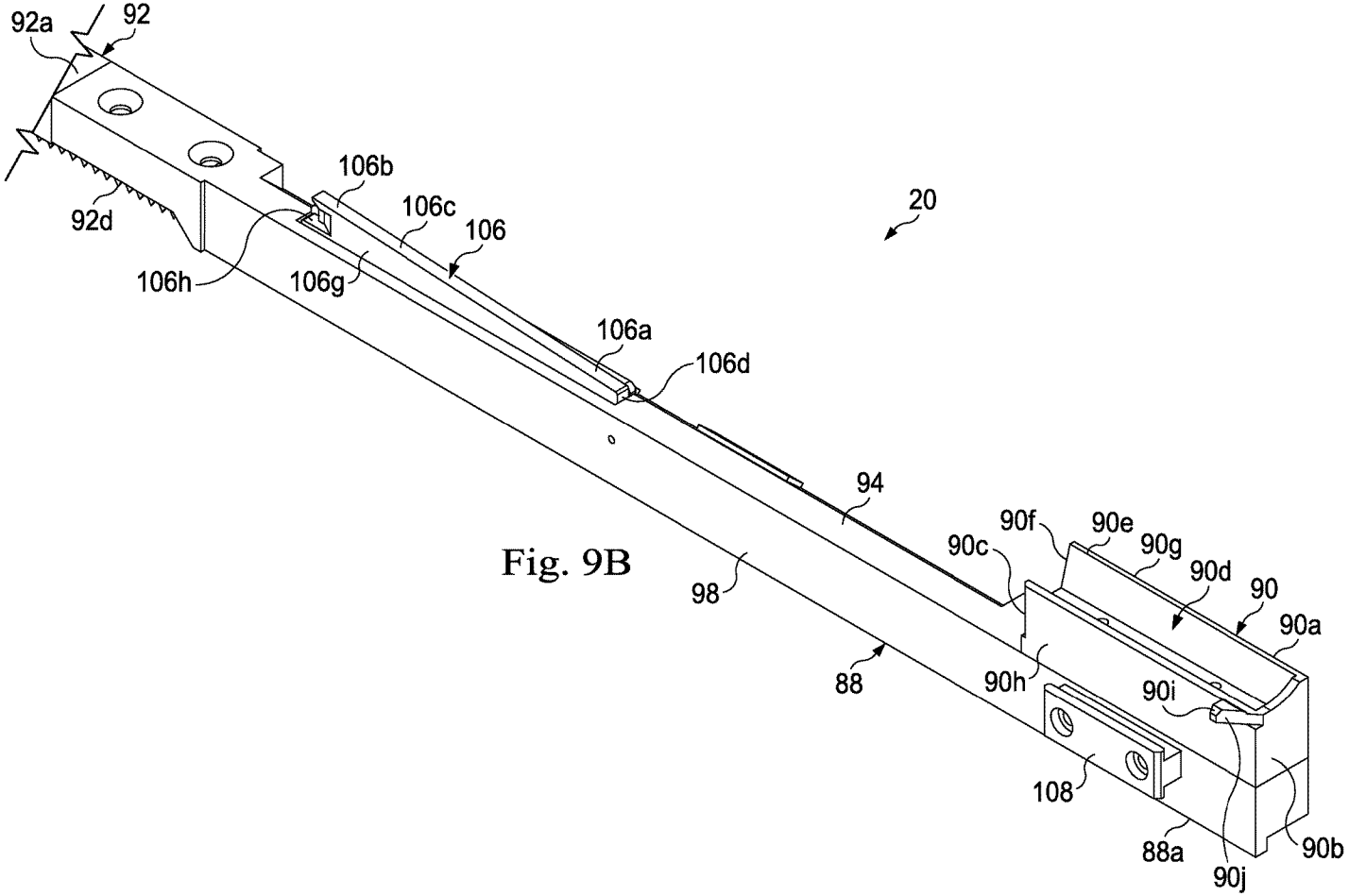
FIGS. 9B and 9C are respective perspective views of portions of the carriage assembly of FIG. 9A, according to an exemplary embodiment.
Figure 9C:
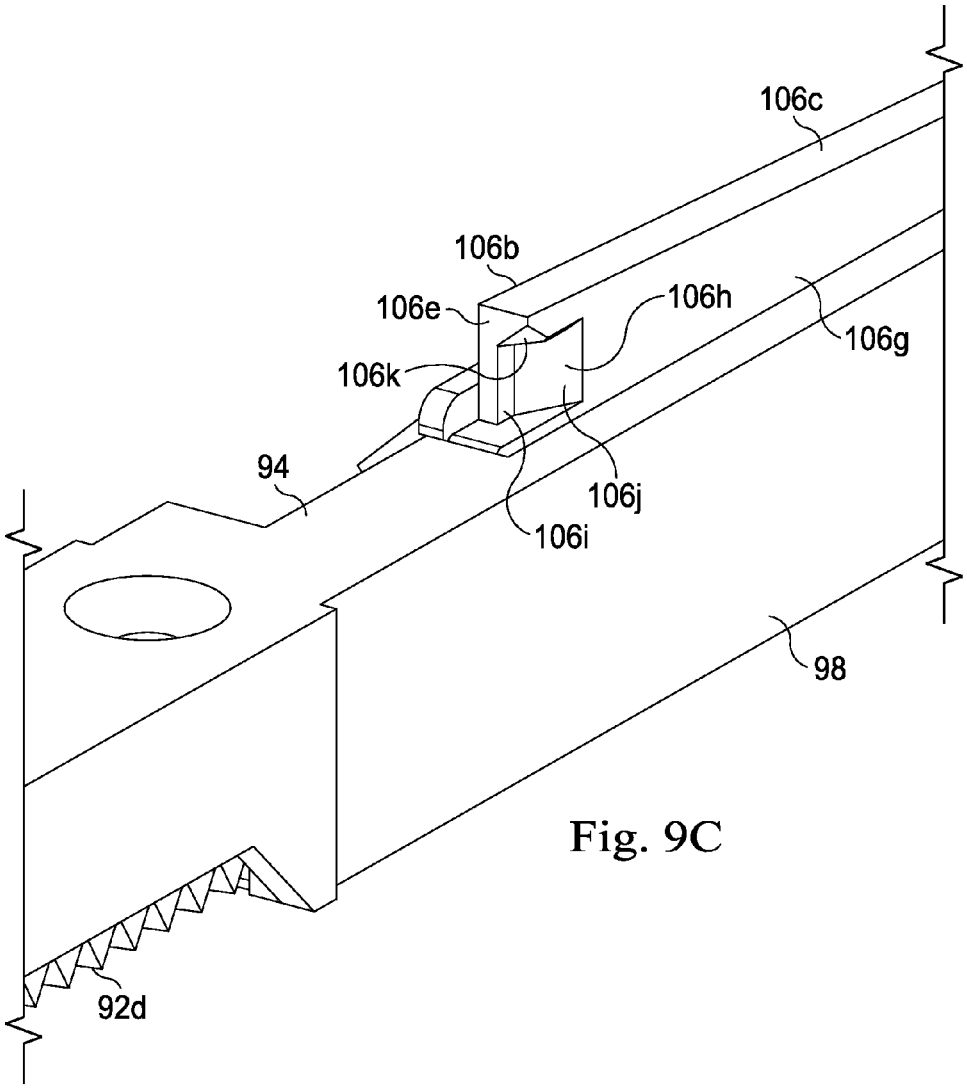

In an exemplary embodiment, as illustrated in FIGS. 9A, 9B, and 9C with continuing reference to FIGS. 1-8F, the carriage assembly 20 includes a transmission arm 88 including opposing end portions 88*a* and 88*b*, a carriage 90 connected to the end portion 88*a* of the transmission arm 88, and a rack bar 92 connected to the end portion 88*b* of the transmission arm 88. In an exemplary embodiment, the transmission arm 88 and the rack bar 92 are integrally formed as a unitary movable member to which the carriage 90 is connected; in other exemplary embodiments, the transmission arm 88 and the rack bar 92 constitute, at least in part, a movable member to which the carriage 90 is connected. The transmission arm 88 defines a top surface 94, a front surface 96, and a back surface 98. A protrusion 100 defining a contact surface 100*a* extends from the front surface 96 proximate the carriage 90. Horizontally-spaced cams 102*a* and 102*b* extend downward from, and are aligned with, the front surface 96. The cams 102*a* and 102*b* are located between the end portions 88*a* and 88*b*, but are closer to the end portion 88*b*. An angled surface, or chamfer 104, is formed in the top surface 94 and the front surface 96, and extends from about the protrusion 100 to about the cam 102*b*. A cam 106 extends upward from the top surface 94. The cam 106 includes opposing end portions 106*a* and 106*b*, and defines an inclined surface 106*c* extending between the end portions 106*a* and 106*b*. The inclined surface 106*c* gradually increases in height with respect to the top surface 94, from left to right as viewed in FIG. 9A. As a result, the height of the end portion 106*a* is less than the height of the end portion 106*b*. The cam 106 is generally horizontally centered about the cam 102*a*. Opposing end surfaces 106*d* and 106*e* are defined by the opposing end portions 106*a* and 106*b*, respectively. The cam 106 further defines a front surface 106*f* and a back surface 106*g*, each of which extends between the opposing end surfaces 106*d* and 106*e*. As shown most clearly in FIG. 9C, a notch 106*h* is formed in the corner at which the end surface 106*e* and the back surface 106*g* meet. A vertically-extending surface 106*i* is defined by the notch 106*h*, and is positioned between the front surface 106*f* and the back surface 106*g*. An angularly-extending surface 106*j* is defined by the notch 106*h*, and extends from the vertically-extending surface 106*i* to the back surface 106*g*. The notch 106*h* further defines an angularly-extending, generally triangular surface 106*k* adjacent the end surface 106*e* and the back surface 106*g*. At the end portion 88*b* of the transmission arm 88, a protrusion 107*a* extends from a front surface 107*b*, which is proximate the cam 102*b*.

The carriage 90 is mounted on, and connected to, the top surface 94 at the end portion 88*a* of the transmission arm 88. The carriage 90 includes a rectangular block 90*a* that defines opposing side surfaces 90*b* and 90*c*. The side surface 90*b* is aligned with the end of the transmission arm 88 at the end portion 88*a*. A channel 90*d* is formed in the block 90*a* and defines a top opening 90*e*, as well as a side opening 90*f* in the side surface 90*c*. The block 90*a* further defines a front surface 90*g* and a back surface 90*h*, each of which extends between the side surfaces 90*b* and 90*c*. A tab 90*i* extends from block 90*a* at the side surface 90*b* thereof. The tab 90*i* defines an angularly-extending surface 90*j*, which extends away from the side surface 90*b* and along the back surface 90*h*.

The end portion 88*b* of the transmission arm 88 overlaps, and is connected to, one end portion of the rack bar 92. The rack bar 92 defines a top surface 92*a*, a front surface 92*b*, and a bottom surface 92*c*. Rack teeth 92*d* are formed in, and/or connected to, the bottom surface 92*c* and extend therealong. A rectangular protrusion 92*e* extends upward from the top surface 92*a*. A rectangular protrusion 92*f* extends outward from the front surface 92*b*.

Figure 10A:
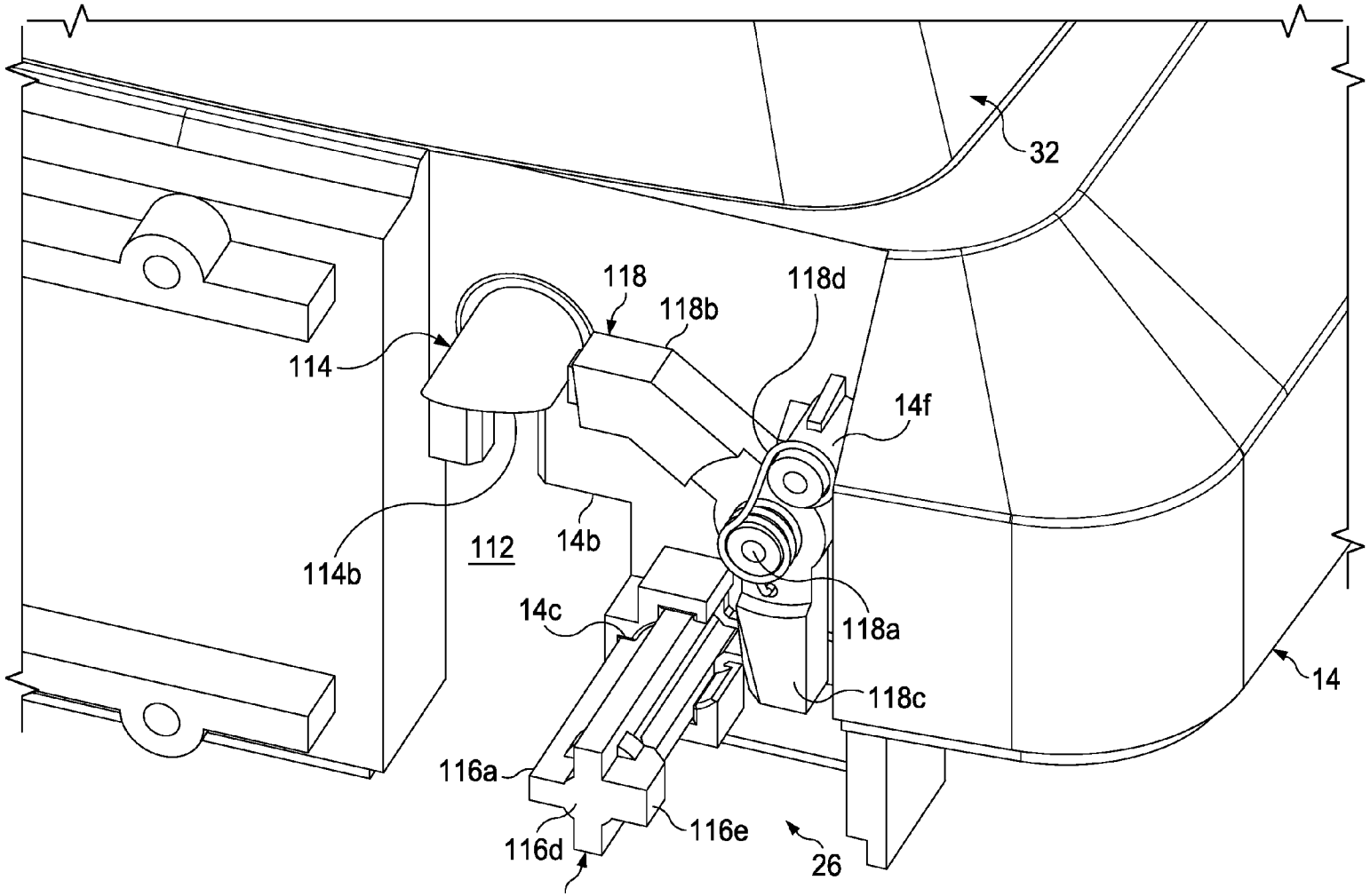
FIGS. 10A and 10B are different perspective views of the tube holding assembly of the cigarette manufacturing machine of FIGS. 1-3, according to an exemplary embodiment.
Figure 10B:
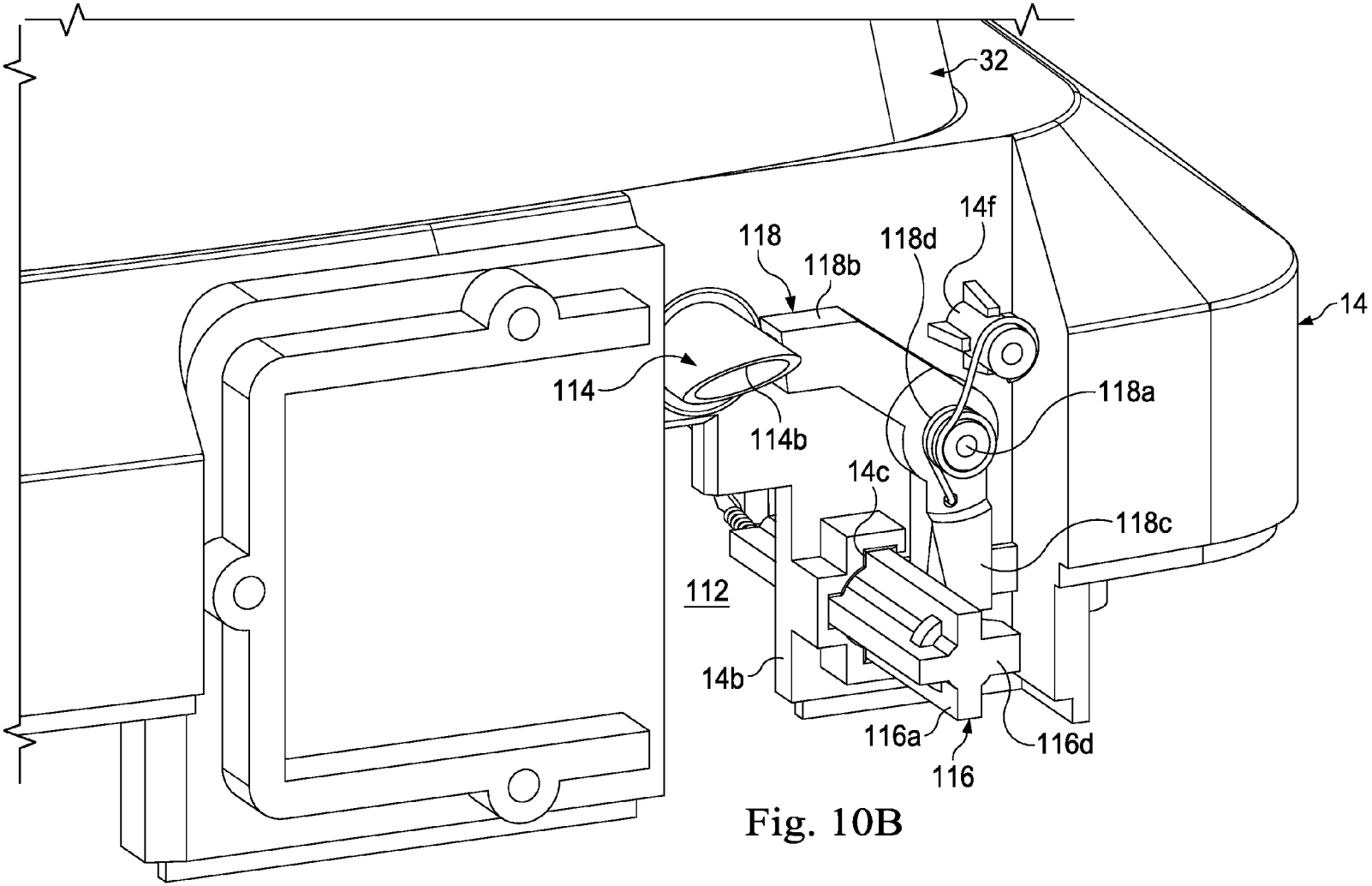

As noted above, the carriage assembly 20 is operably coupled to the horizontal support 16 and the housings 12 and 14. More particularly, the transmission arm 88 rests upon the support shoulder 16*c* of the horizontal support 16. A connector block 108 (shown in at least FIGS. 3, 8E, and 9B) is disposed between the horizontal walls 16*da* and 16*db* of the gusset 16*d*, and is connected to the back surface 98 of the transmission arm 88 at the end portion 88*a* thereof. In an exemplary embodiment, a portion of the connector block 108 extends through the horizontally-extending slot 16*n* of the horizontal support 16 and connects to the transmission arm 88. The rack teeth 106 are supported by, and operably engage, a pinion 110 (shown in FIG. 9A). The pinion 110 is connected to the output shaft of the motor 52, which is connected to the upper housing 14 and thus also the lower housing 12 connected thereto. At any given time, at least a portion of, or all, of the rack bar 92 is disposed within an internal region 112 (shown in at least FIGS. 10A and 10B) defined by the connected housings 12 and 14. Under conditions to be described below, the motor 52 drives the pinion 110, which causes the carriage assembly 20 to slide back and forth along the horizontal support 16. During this back-and-forth sliding movement, a portion of the transmission arm 88, including the end portion 88*b*, is adapted to reciprocate in and out of the internal region 112 via openings 12*a* and 14*b* formed in the housings 12 and 14, respectively (the opening 12*a* is shown in at least FIG. 2 and the opening 14*b* is shown in at least FIGS. 10A and 10B). During the same back-and-forth sliding movement, a portion of the rack bar 92, which includes the end of the rack bar 92 opposing the transmission arm 88, is adapted to reciprocate in and out of the internal region 112 via the opening 14*a* of the upper housing 14.

In an exemplary embodiment, as illustrated in FIGS. 10A-10E with continuing reference to FIGS. 1-9C, the tube holding assembly 26 includes a tubular member, or mandrel 114, which extends from the upper housing 14 at a position above the opening 14*b*, and thus above the transmission arm 88 of the carriage assembly 22. The mandrel 114 is spaced in a generally parallel relation from the transmission arm 88 of the carriage assembly 22. The tube holding assembly 26 further includes a sliding member 116 operably coupled to the upper housing 14, a clamping member 118 operably coupled to the upper housing 14 and adapted to operably engage each of the mandrel 114 and the sliding member 116, and a helical spring 120 connected to the sliding member 116 and the upper housing 14.

Figure 10D:
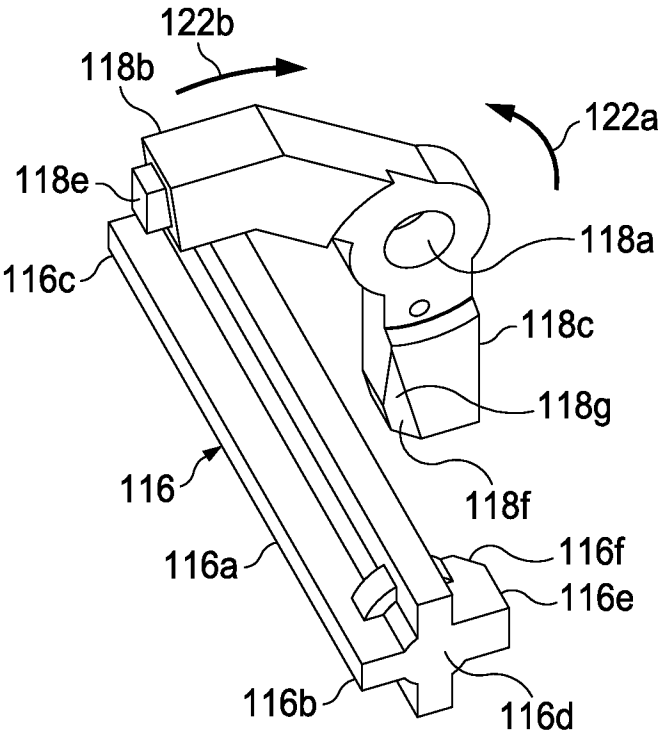
FIGS. 10C and 10D are different perspective views of a portion of the tube holding assembly of FIGS. 10A and 10B, according to an exemplary embodiment.
Figure 10C:
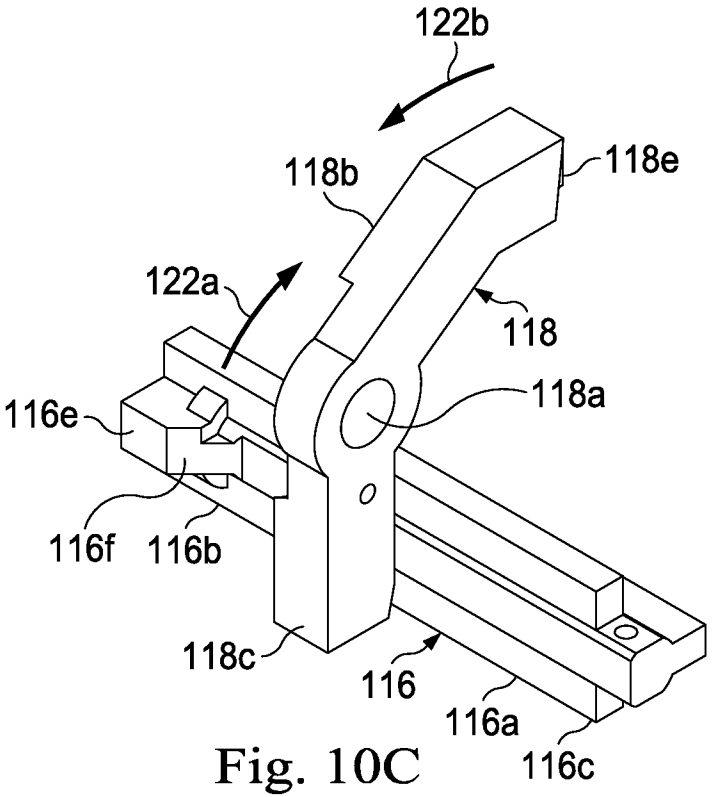
Figure 10E:
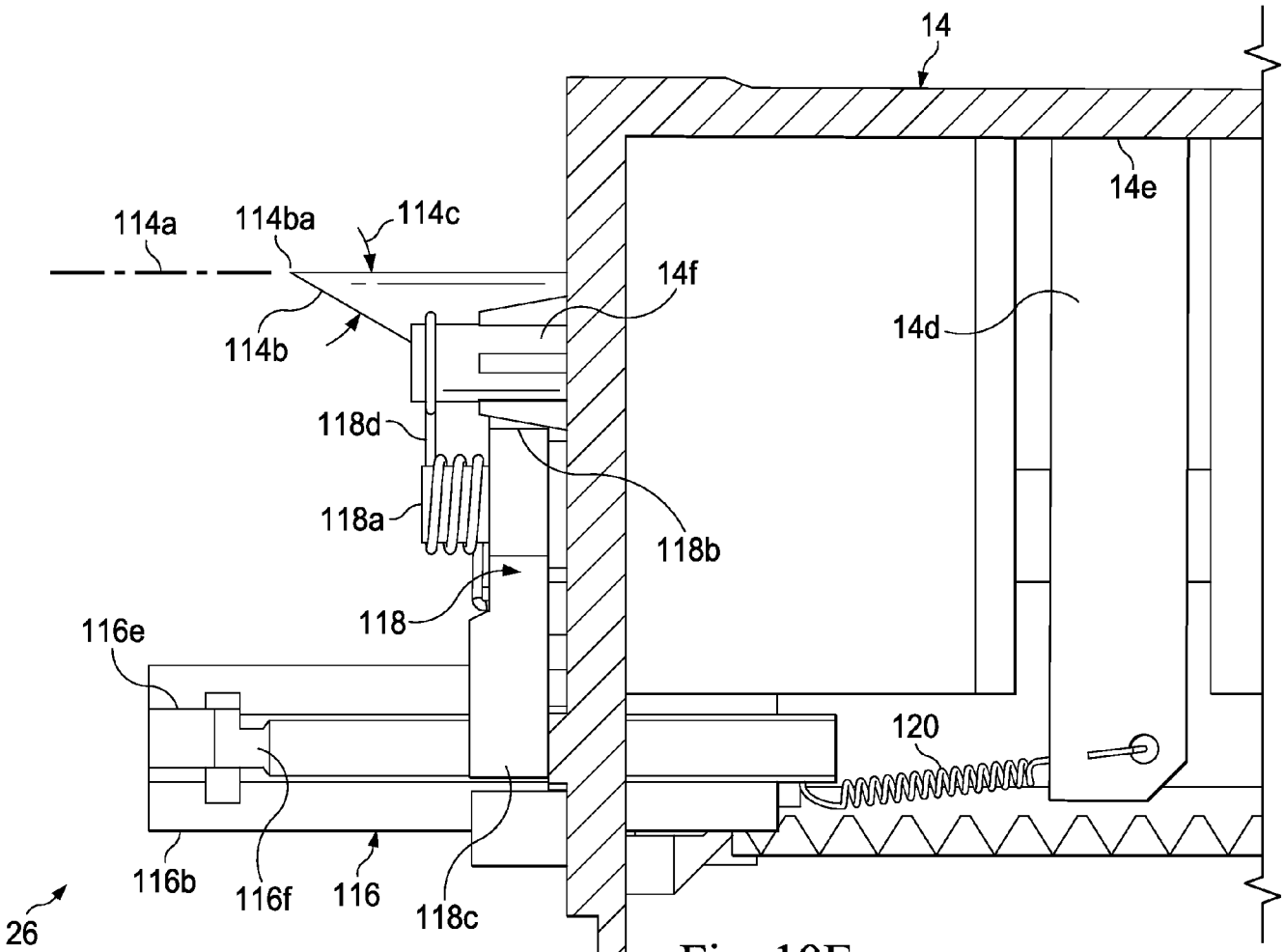
FIG. 10E is an elevational view of the tube holding assembly of FIGS. 10A and 10B, according to an exemplary embodiment.

As shown most clearly in FIG. 10E, the mandrel 114 defines a longitudinal axis 114*a* along the topside thereof, and includes a bevel 114*b* formed at the distal end of the mandrel 114 on the underside thereof. The bevel 114*b* defines a tip 114*ba* of the mandrel 114 on the topside thereof; the tip 114*ba* generally lies on the longitudinal axis 114*a*. Due to the bevel 114*b*, the topside of the mandrel 114, along which the longitudinal axis 114*a* generally extends, is longer than the underside of the mandrel 114. The bevel 114*b* defines an angle 114*c* from the longitudinal axis 114*a*. In an exemplary embodiment, the angle 114*c* is about 30 degrees. In an exemplary embodiment, the angle 114*c* is equal to, or less than, about 30 degrees. In an exemplary embodiment, the angle 114*c* is greater than 30 degrees. In an exemplary embodiment, the angle 114*c* is 45 degrees. In an exemplary embodiment, the angle 114*c* is less than 45 degrees. In an exemplary embodiment, the angle 114*c* is greater than 45 degrees.

The sliding member 116 includes a longitudinally-extending bar 116*a* including opposing end portions 116*b* and 116*c* and having a cross-section that is generally cross-shaped. The bar 116*a* extends through a corresponding cross-shaped opening 14*c* formed in the upper housing 14. As a result, the end portion 116*c* of the bar 116*a* is disposed in the internal region 112 defined by the connected housings 12 and 14. The bar 116*a* slidably engages one or more of the respective surfaces of the upper housing 14 defined by the cross-shaped opening 114*c*. A contact surface 116*d* is defined by the end portion 116*b*. A protrusion 116*e* extends from the end portion 116*b*, and defines an angularly-extending cam surface 116*f*. As shown in FIG. 10E, the helical spring 120 is connected to the end portion 116*c* of the bar 116*a*, and extends to a vertical support 14*d* of the upper housing 14. The vertical support 14*d* extends downward from a top inside surface 14*e* of the upper housing 14.

The clamping member 118 is generally wing-shaped and includes a pin connection 118*a* connected to the upper housing 14, an upper arm 118*b* extending from the pin connection 118*a*, and a lower arm 118*c* extending downward from the pin connection 118*a*. The pin connection 118*a* includes a torsion spring 118*d*, which extends around a pin 14*f* of the upper housing 14. A contact protrusion 118*e* extends from the distal end of the upper arm 118*b*. A chamfer 118*f* is formed in the distal end of the lower arm 118*c*, at a corner thereof proximate the sliding member 116. The chamfer 118*f* defines a contact surface 118*g*, which is adapted to contact the angularly-extending cam surface 116*f* of the sliding member 116. The clamping member 118 is adapted to rotate, about the pin connection 118*a*, back and forth as indicated by arrows 122*a* and 122*b* in FIGS. 10C and 10D. The torsion spring 118*d* provides a biasing force against the clamping member 118, urging the clamping member 118*d* to rotate, about the pin connection 118*a* and in the direction indicated by the arrow 122*b*, so that the contact protrusion 118*e* moves away from the mandrel 114.

In an exemplary embodiment, as illustrated in FIGS. 11A-11D with continuing reference to FIGS. 1-10E, the carrot injection assembly 28 includes a push rod 124, a tubular member 126, a box 128, a paddle 130, and a helical spring 132. The push rod 124 has a C-shaped cross-section along the majority of its longitudinal length, defining longitudinally-extending region 124*a*. The push rod 124 includes longitudinally-extending teeth arrays 124*b* and 124*c* formed therein, which arrays respectively extend along the upper and lower boundaries of the region 124*a* from an end 124*d* to about the longitudinal midpoint of the push rod 124. An end of the tubular member 126 is connected to the end of the push rod 124 opposing the end 124*d*, and the other end of the tubular member 126 is connected to a side wall 128*a* of the box 128. The box 128 further includes a top wall 128*b*, a front wall 128*c*, and a back wall 128*d*, which along with the side wall 128*a* define an internal region 128*e*. The box 128 is open at the bottom opposing the top wall 128*b*, and is open at the side opposing the side wall 128*a*. Internal shoulders 128*f* and 128*g* are formed in the front wall 128*c* and the back wall 128*da*, respectively, at the side opposing the side wall 128*a*.

The paddle 130 is at least partially disposed in the internal region 128*e* of the box 128. The paddle 130 includes a pin connection 130*a*, which extends between the front wall 128*c* and the back wall 128*d*. An outside arm 130*b* extends from the pin connection 130*a* and out of the side opposing the side wall 128*a*. An inside arm 130*c* extends from the pin connection 130*b*, within the internal region 128*e* and generally towards the side wall 128*a*. The helical spring 132 extends within the internal region 128*e*, between the top wall 128*a* and the inside arm 130*c* of the paddle 130.

Figure 11A:
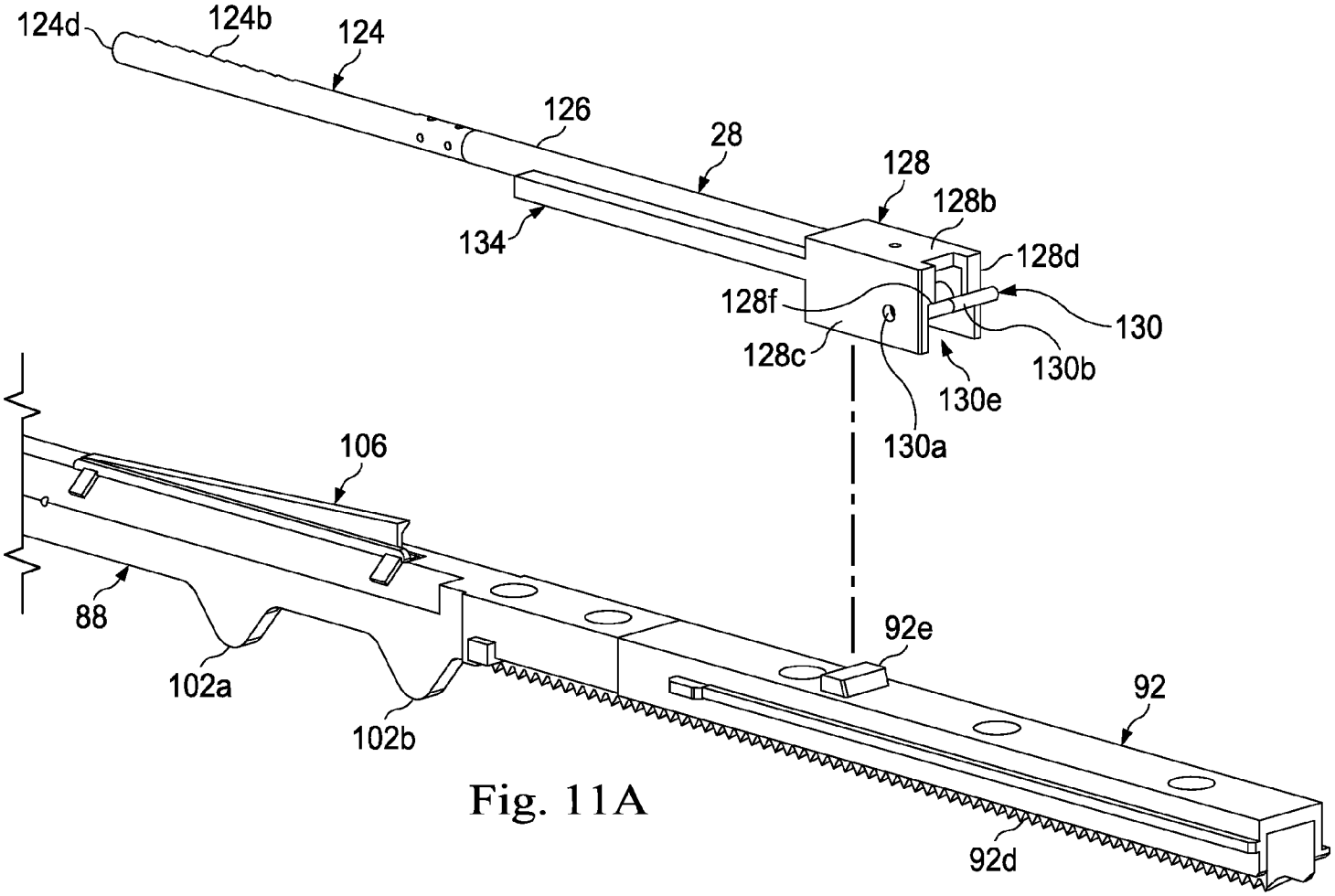
FIGS. 11A and 11B are different perspective views of the carrot injection assembly of the cigarette manufacturing machine of FIGS. 1-3, as exploded from a portion of the carriage assembly of FIGS. 9A-9C, according to an exemplary embodiment.
Figure 11B:
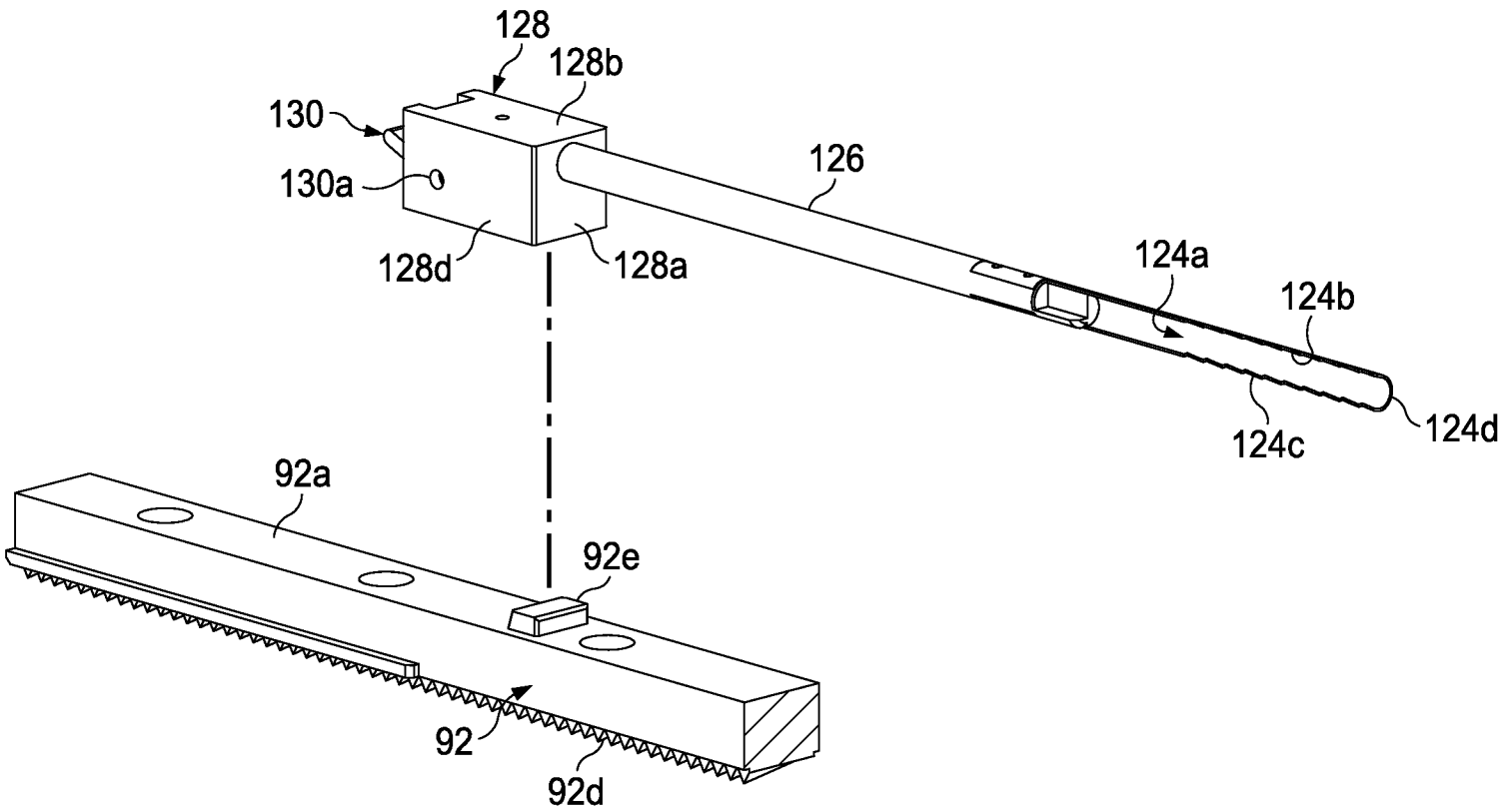
Figure 11C:
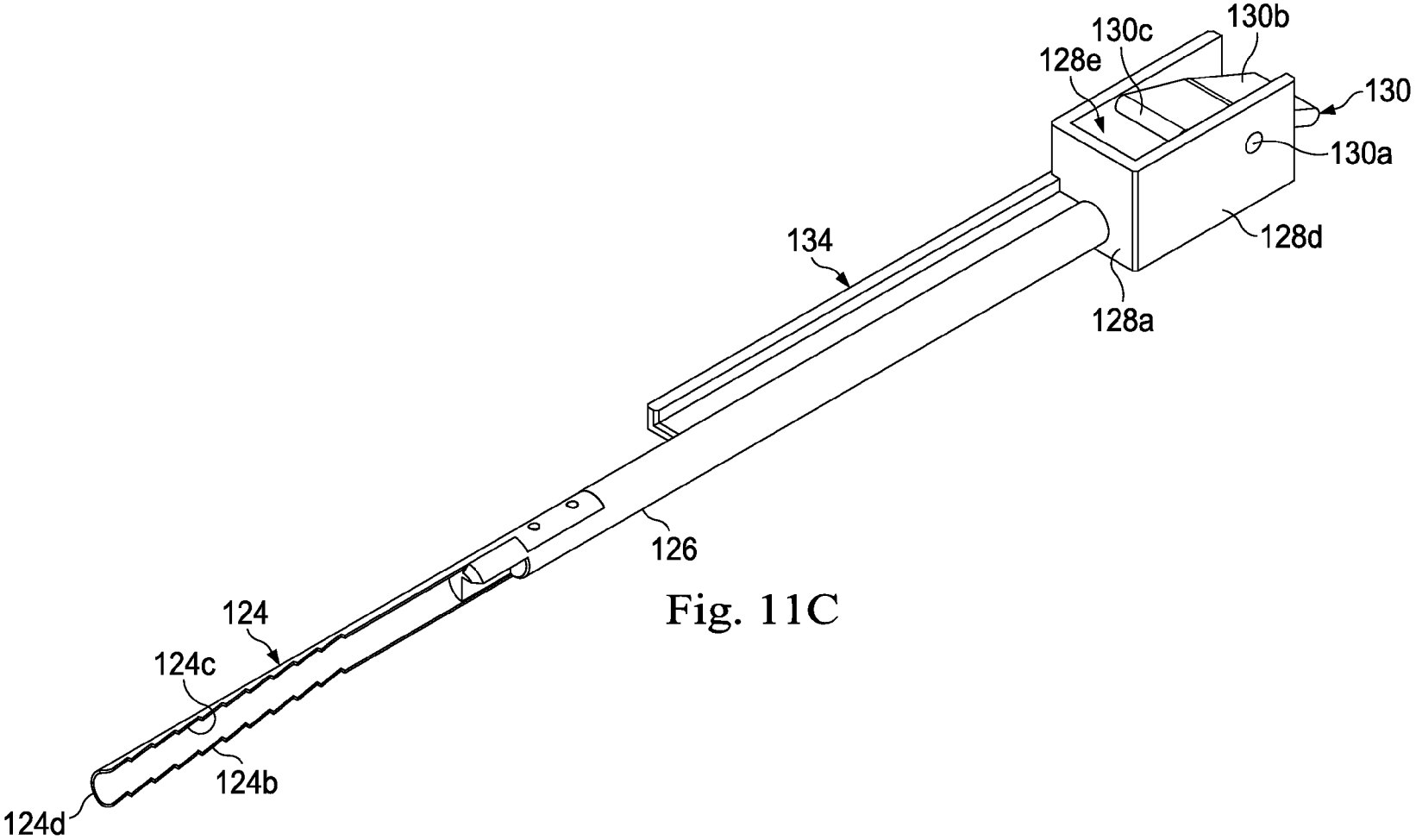
FIG. 11C is another perspective view of the carrot injection assembly of FIGS. 11A and 11B, according to an exemplary embodiment.
Figure 11D:
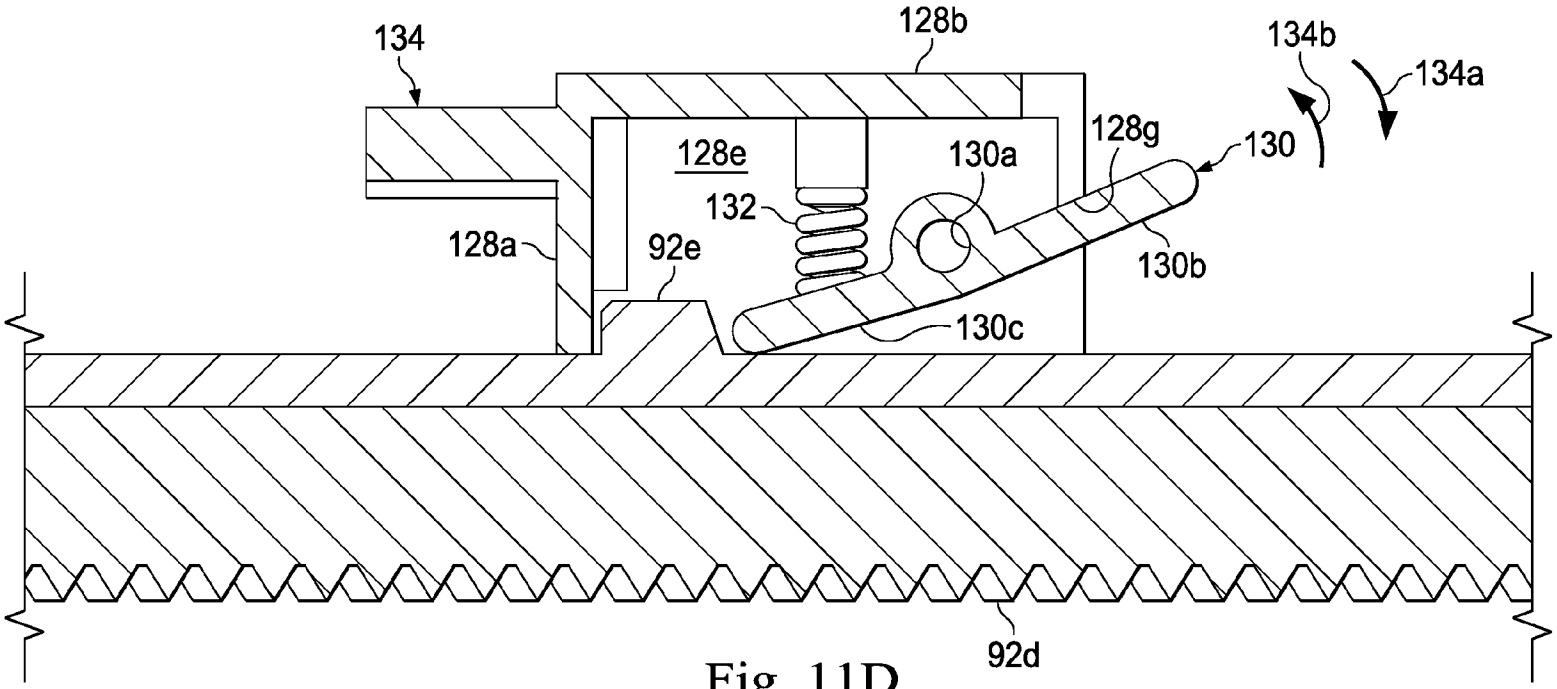
FIG. 11D is a sectional view of a portion of the carrot injection assembly of FIGS. 11A-11C, according to an exemplary embodiment.

The paddle 130 is adapted to rotate, about the pin connection 130*a*, back and forth as indicated by arrows 134*a* and 134*b* in FIG. 11D. The helical spring 132 provides a downward biasing force against the inside arm 130*c* of the paddle 130, urging the paddle 130 to rotate, about the pin connection 130*a* and in the direction indicated by the arrow 134*b*, so that the outside arm 130*b* is biased against the internal shoulders 128*f* and 128*g* of the box 128.

As noted above, the carrot injection assembly 28 is operably coupled to the carriage assembly 20. More particularly, the carrot injection assembly 28 is mounted on the rack bar 92 so that the box 128 engages the top surface 92*a* of the rack bar 92, and the push rod 124 is spaced in a generally parallel relation from the top surface 92*a* of the rack bar 92 and the top surface 94 of the transmission arm 88. The carrot injection assembly 28 has two operational modes with respect to the carriage assembly 20. One operational mode is shown in FIG. 11D, in which the box 128 engages the top surface 92*a* so that the protrusion 92*e* extends upward within the internal region 128*e* and between the side wall 128*a* and the inside arm 130*c*. In the operational mode shown in FIG. 11D, the carrot injection assembly 28 is adapted to translate, along with the carriage assembly 20 and back and forth within the internal region 112, so that the push rod 124 extends out of, and retracts back into, the mandrel 114. In the other operational mode of the carrot injection assembly 28, the box 128 engages the top surface 92*a* of the rack bar 92, but the protrusion 92*e* is located to the right of the box 128, as viewed in FIG. 11A; as a result, the carrot injection assembly 28 does not translate with the carriage assembly 20 when the carriage assembly 20 translates to the right, as viewed in FIG. 11A. The two operational modes of the carrot injection assembly 28, and the conditions for each, will be described in further detail below.

In an exemplary embodiment, the carrot injection assembly 28 further includes a guide rib 134, which extends from the box 128 and along the side of the tubular member 126. In an exemplary embodiment, the guide rib 134 extends within a guide slot (not shown) formed in the upper housing 14, and guides the carrot injection assembly 28 as it moves back and for the within the internal region 112 defined by the housings 12 and 14, thereby maintaining the horizontal extension of the push rod 124 during the translation thereof.

Figure 12A:
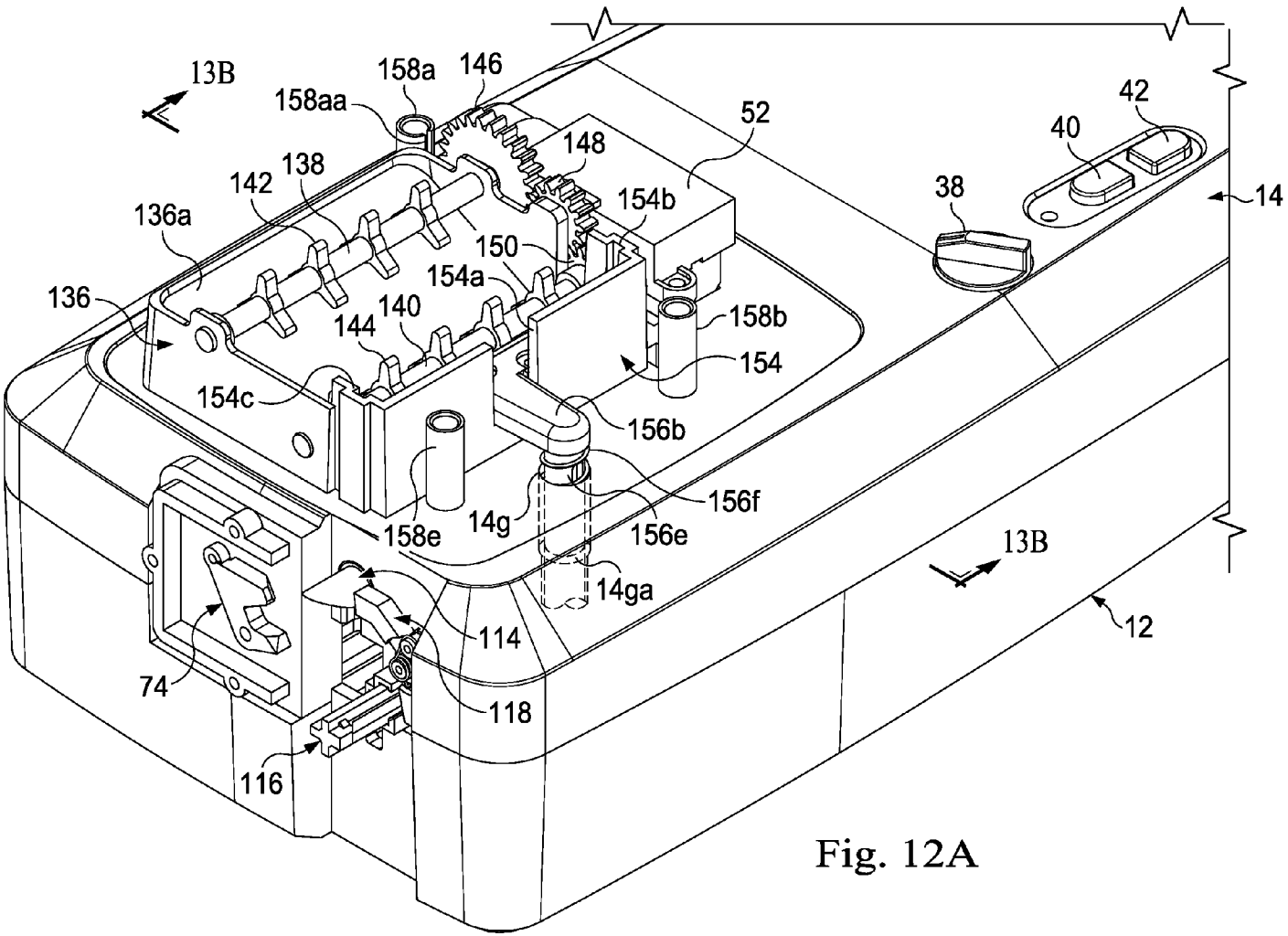
FIGS. 12A-12C are different perspective views of a portion of the carrot forming assembly of the cigarette manufacturing machine of FIGS. 1-3, according to an exemplary embodiment, the portion including a guard.
Figure 12B:
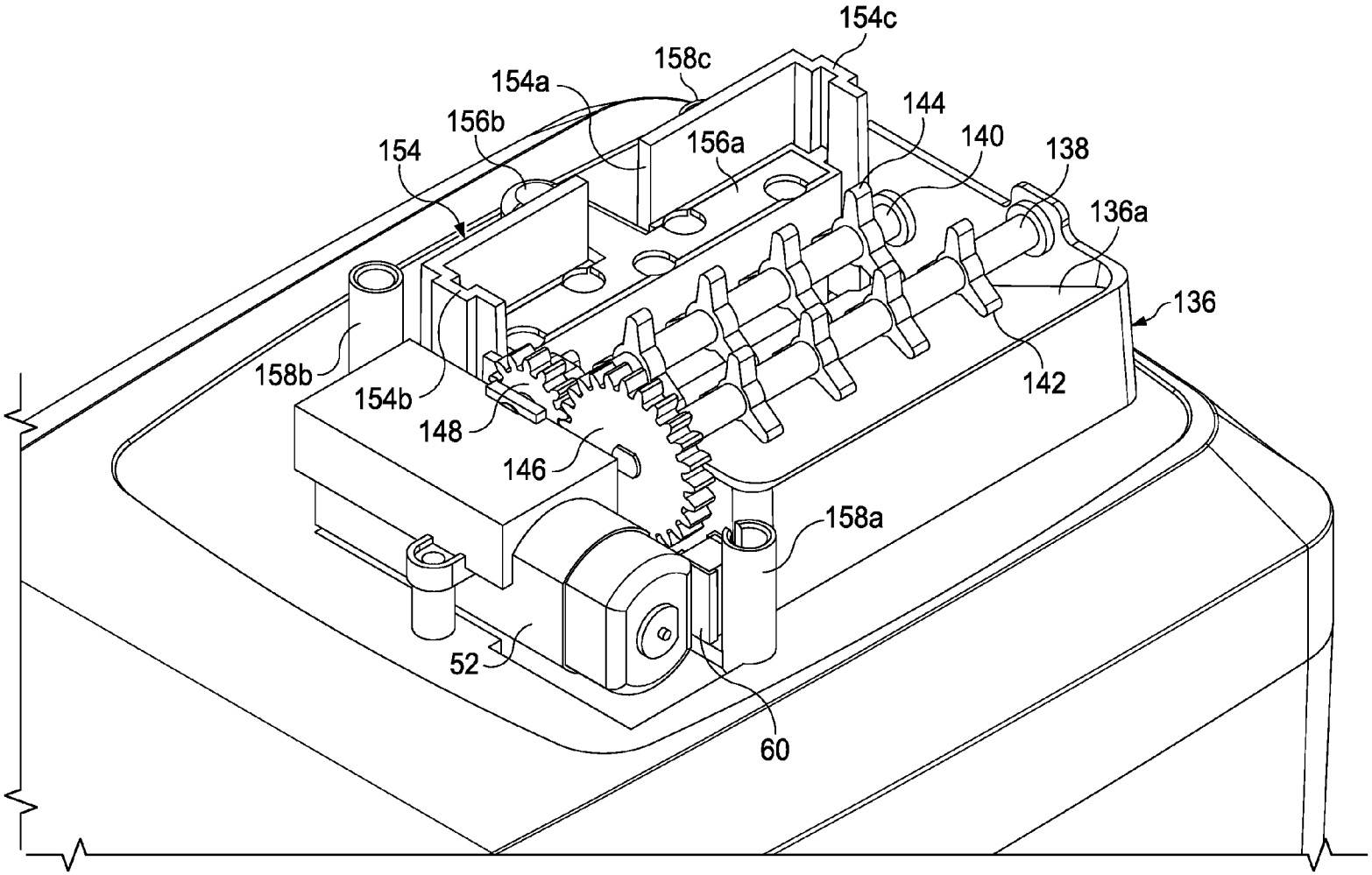
Figure 12C:
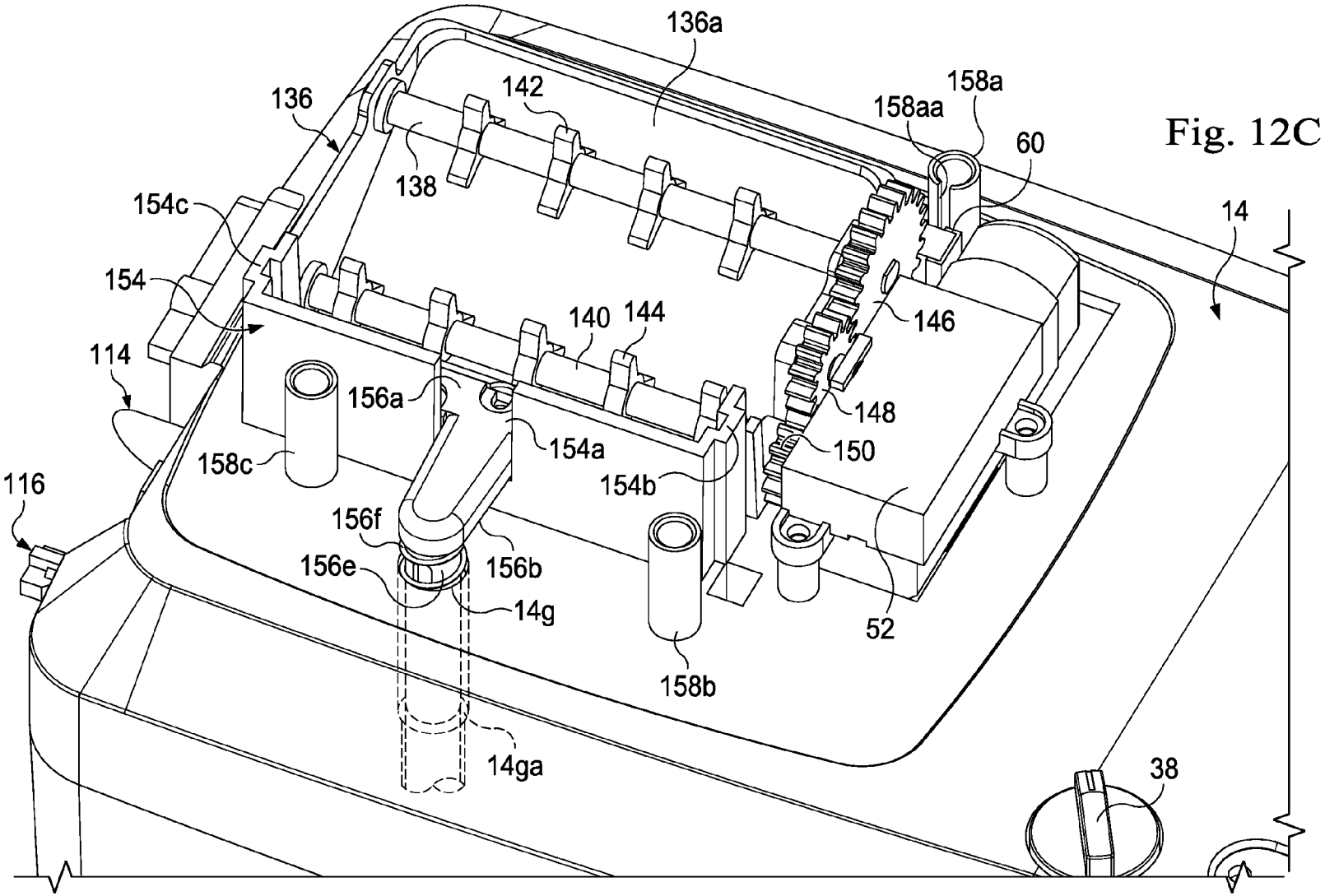

In an exemplary embodiment, as illustrated in FIGS. 12A-12C with continuing reference to FIGS. 1-11D, the carrot forming assembly 30 includes a tray 136 connected to the top of the upper housing 14 and including a ramp 136*a*. Shafts 138 and 140 extend across the tray 136 and over the ramp 136*a*. The shafts 138 and 140 are spaced in a parallel relation. The shaft 138 is positioned higher than the shaft 140. A plurality of horizontally-spaced star wheels 142 are connected to the shaft 138. A plurality of horizontally-spaced star wheels 144 are connected to the shaft 140. A gear 146 is connected to the shaft 138 at one end thereof. A gear 148 is connected to the tray 136 and engages the gear 146. A gear 150 is connected to the shaft 140 at one end thereof, and engages the gear 148. A motor 152 is mounted on the top of the upper housing 14 and adjacent the tray 136. The output shaft of the motor 152 is operably coupled to, and adapted to drive, the gear 150.

A three-sided vertical support structure 154 extends upward from the top of the upper housing 14. The vertical support structure 154 is adjacent the tray 136 and positioned near the star wheels 144, the shaft 140, and the bottom of the ramp 136*a*. The vertical support structure 154 includes a center vertical slot 154*a* and inner side channels 154*b* and 154*c* spaced in a parallel relation on either side of the center vertical slot 154*a*. A plunger assembly 156 extends within the vertical support structure 154, and includes a plunger block 156*a* and a transverse arm 156*b* extending from the top thereof. The transverse arm 156*b* extends through the center vertical slot 154*a*. Respective ribs 156*c* and 156*d* extend vertically along opposing sides of the plunger block 156*a*. The ribs 156*c* and 156*d* are more clearly shown in FIGS. 15A-15C. The ribs 156*c* and 156*d* extend within the inner side channels 154*b* and 154*c*, respectively. A post 156*e* extends downward from the transverse arm 156*d* and through a bore 14*g* formed in the top of the upper housing 14. The post 156*e* extends through a helical spring 156*f*, which engages the underside of the transverse arm 156*d* and extends within the bore 14*g*; the bottom end of the helical spring 156*f* is supported by an internal shoulder 14*ga* defined by the bore 14*g*. The remainder of the plunger assembly 156 will be described in detail below.

Bosses 158*a*, 158*b*, and 158*c* having respective openings extend up from the top of the upper housing 14. The bosses 158*a* and 158*b* are located on either side of the motor 152. The bosses 158*b* and 158*c* are located on either side of the center vertical slot 154*a*. A slot 158*aa* is formed in the side of the boss 158*a*, and extends longitudinally therealong. The hopper safety switch 60 is mounted on top of the upper housing 14, and is positioned proximate the slot 158*aa*.

Figure 13A:
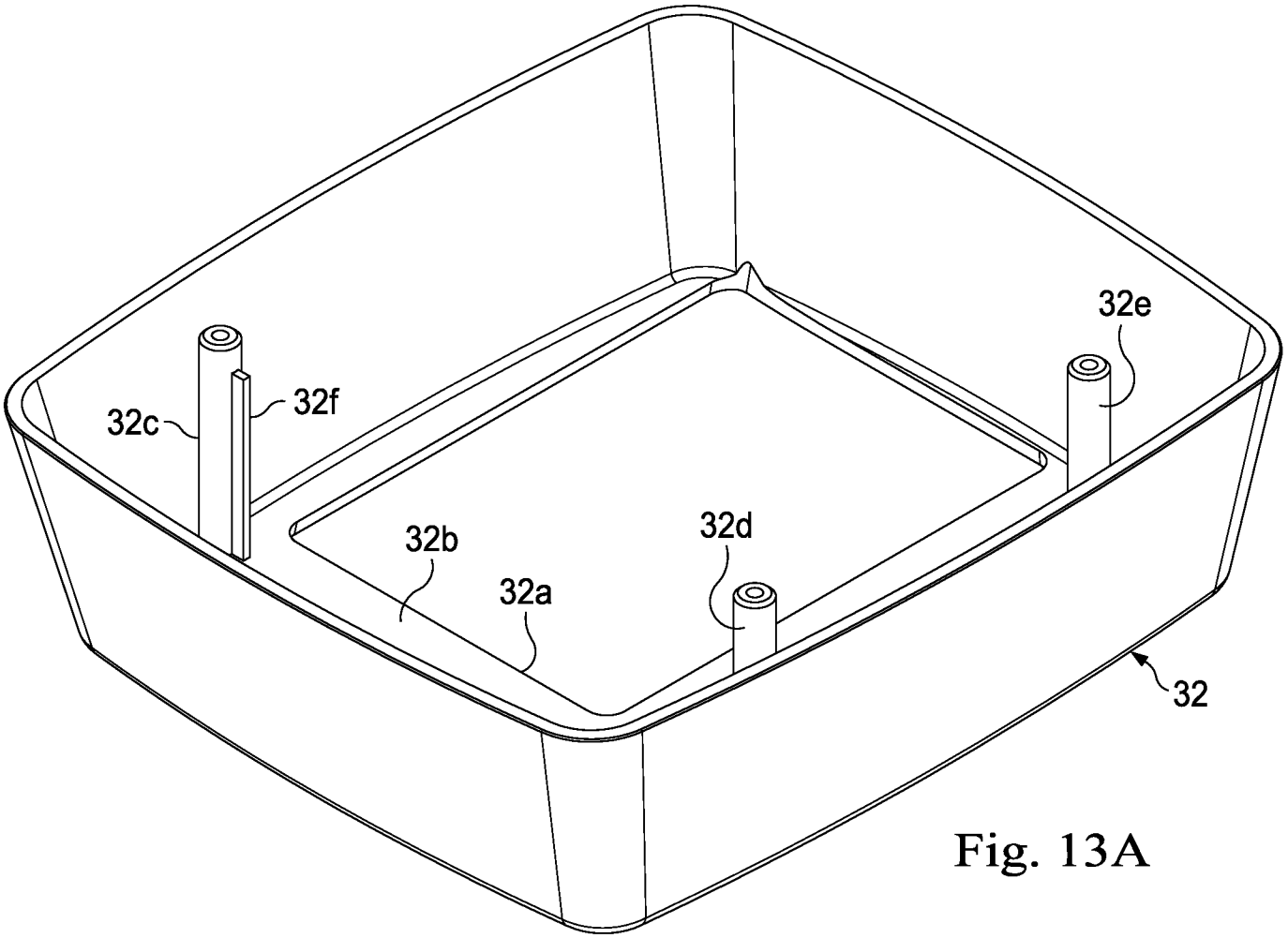
FIG. 13A is a perspective view of the guard of the carrot forming assembly of FIGS. 12A-12C.
Figure 13B:
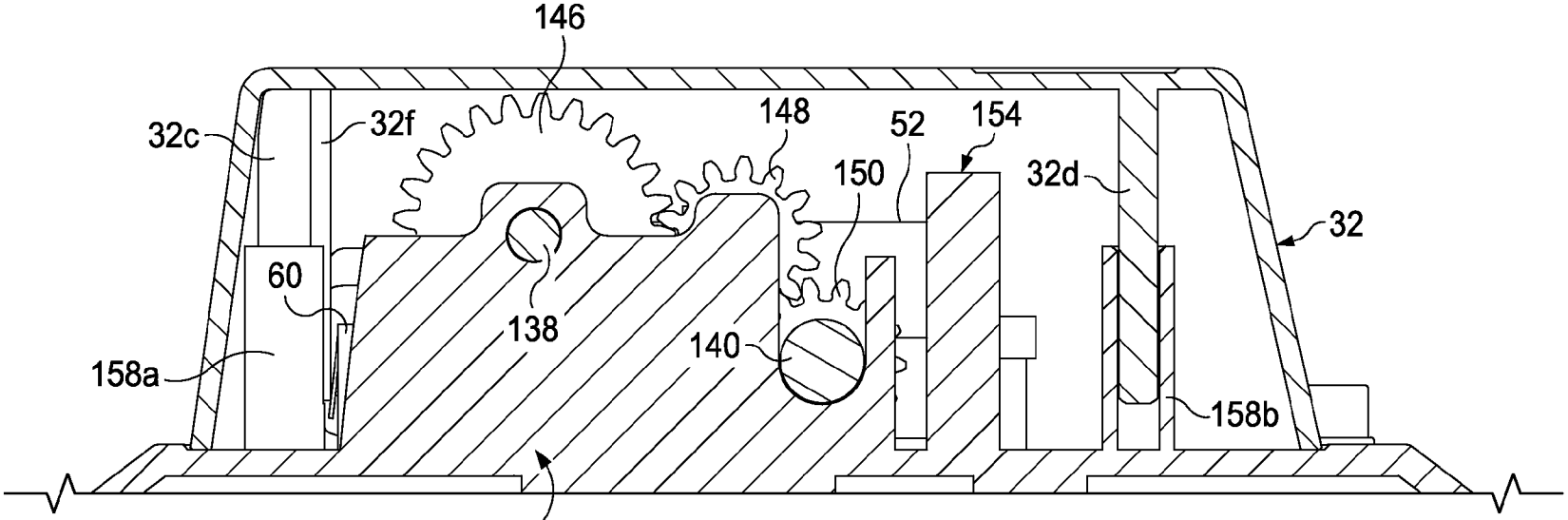
FIG. 13B is a sectional view of the portion of the carrot forming assembly of FIGS. 12A-12C taken along line 13B-13B of FIG. 12A, according to an exemplary embodiment.

In an exemplary embodiment, as illustrated in FIGS. 13A and 13B with continuing reference to FIGS. 1-12C, the guard 32 includes an opening 32*a* through which the hopper 34 extends. An inside top surface 32*b* is defined by the guard 32. Posts 32*c*, 32*d*, and 32*e* extend downward from the inside top surface 32*b*. A rib 32*f* extends along the post 32*c*. As shown in FIGS. 1-3, the guard 32 is mounted on top of the upper housing 14, and covers at least respective portions of the tray 136, the gears 146, 148, and 150, the motor 52, the vertical support structure 154, and the plunger assembly 156. When the guard 32 is so mounted, the posts 32*c*, 32*d*, and 32*e* extend downward and into the openings of the bosses 158*a*, 158*b*, and 158*c*, respectively. As shown in FIG. 13B, the rib 32*f* of the guard 32 extends through the slot 158*aa* and engages the hopper safety switch 60. As a result of this engagement, one or more signals are sent to the controller 46 indicating that the guard 32 is indeed properly mounted on the upper housing 14 and operation of the machine 10 is permissible. As shown in FIGS. 1-3, the hopper 34 extends through the opening 32*a* of the guard 32. The hopper 34 is coupled to the opposing ends of each of the shafts 138 and 140. The guard 32 surrounds the hopper 34. In several exemplary embodiments, the rib 32*f* may be omitted in favor of a feature on the hopper 34, which feature engages the hopper safety switch 60 when the hopper 34 extends through the opening 32*a* and is surrounded by the guard 32. In several exemplary embodiments, the hopper 34 is glued to the guard 32 to ensure that both the hopper 34 and the guard 32 must be mounted on the upper housing 14 in order for the hopper safety switch 60 to communicate to the controller 46 that operation of the machine 10 is permissible.

Figure 14A:
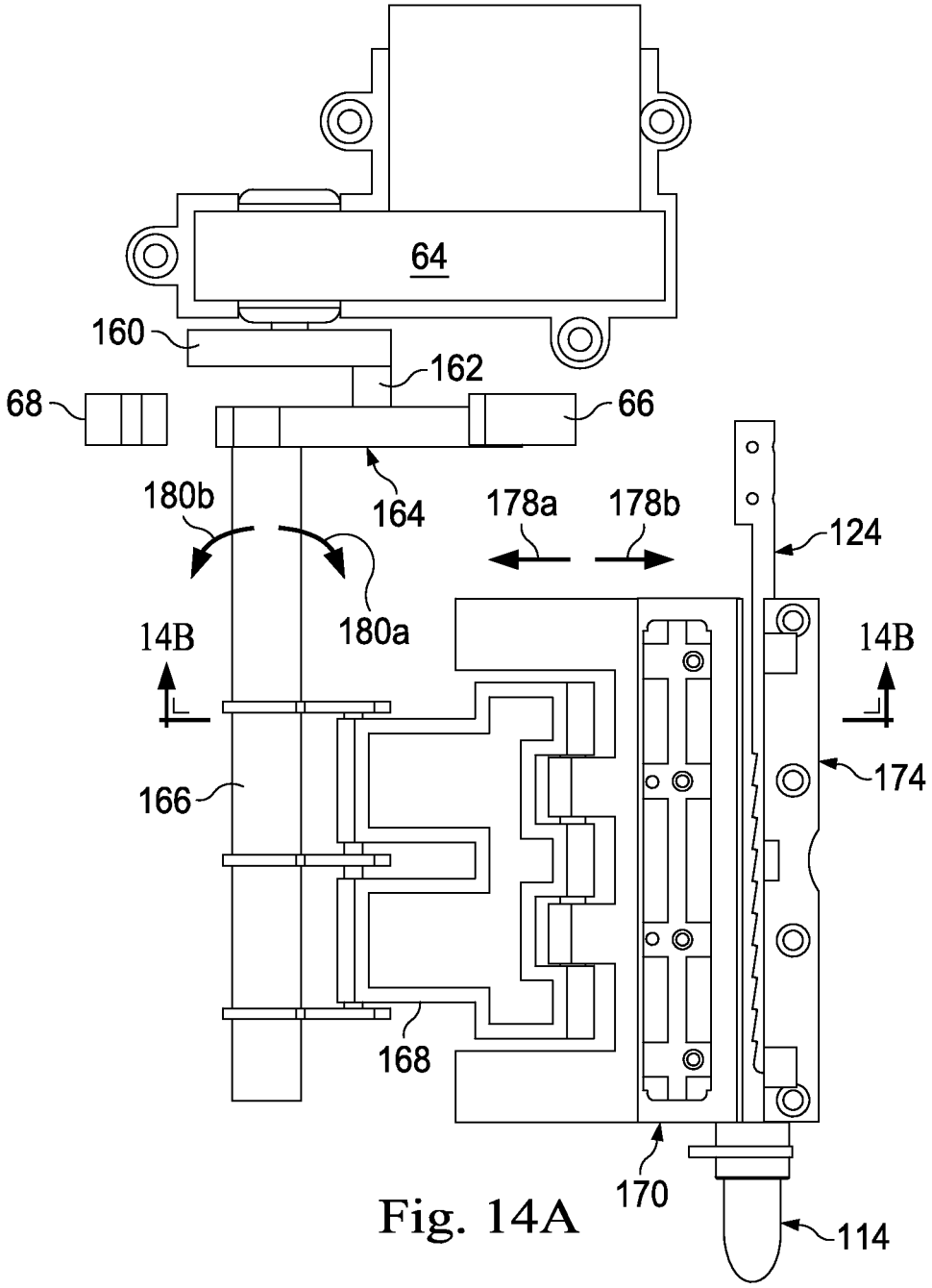
FIG. 14A is a top plan view of another portion of the carrot forming assembly of the cigarette forming assembly of the cigarette manufacturing machine of FIGS. 1-3, according to an exemplary embodiment.
Figure 14B:
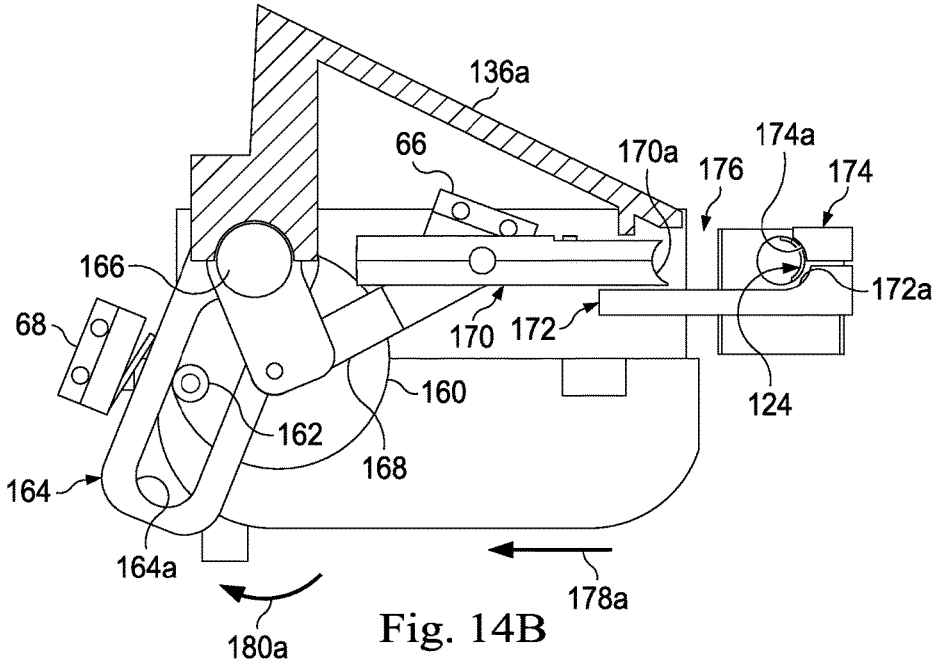
FIG. 14B is a sectional view of the portion of FIG. 14A taken along line 14B-14B of FIG. 14A.
Figure 14C:
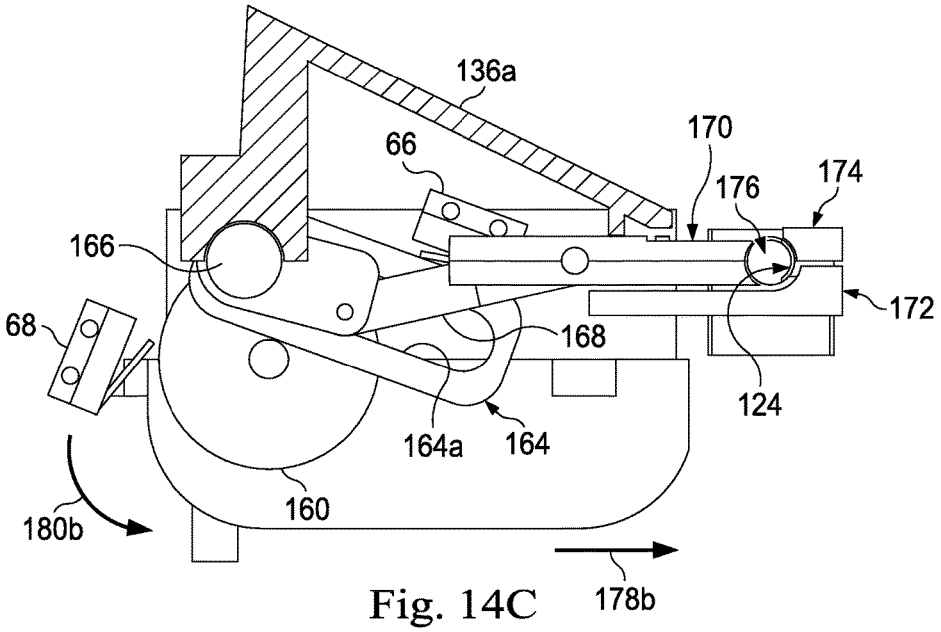
FIG. 14C is a view similar to that of FIG. 14B, but depicting a different operational mode, according to an exemplary embodiment.

In an exemplary embodiment, as illustrated in FIGS. 14A-14C with continuing reference to FIGS. 1-13B, the carrot forming assembly 30 further includes the motor 64 and a circular disk 160 connected to the output shaft of the motor 64. A pin 162 extends from the circular disk 160 and within a slot 164*a* of a sliding link 164. An end of a shaft 166 is connected to the sliding link 164. A rotation-to-translation link 168 is hingedly connected to the shaft 166. A movable wall 170 is hingedly connected to the rotation-to-translation link 168. The movable wall 170 includes a longitudinally-extending, half-moon arcuate surface 170*a*. The movable wall 170 is positioned below the ramp 136*a* of the tray 136, and is adapted to slide against a horizontal support 172. The horizontal support 172 is connected to the upper housing 14 and remains stationary. In an exemplary embodiment, the horizontal support 172 is integrally formed in whole or in part with the tray 136 and/or the upper housing 14. The horizontal support 172 defines a longitudinally-extending, quarter-moon arcuate surface 172*a*, which is spaced in a parallel relation from the arcuate surface 170*a*, regardless of the position of the movable wall 170.

A stationary wall 174 is positioned above the end of the horizontal support 172 opposite the movable wall 170. The stationary wall 174 defines a longitudinally-extending, quarter-moon arcuate surface 174*a*. The arcuate surfaces 172*a* and 174*a* are generally coaxial. In an exemplary embodiment, the stationary wall 174 is connected to one or more of the upper housing 14, the tray 136, and the horizontal support 172. In an exemplary embodiment, the stationary wall 174 is integrally formed in whole or in part with the upper housing 14, the tray 136, the horizontal support 172, or any combination thereof. A variable-sized cavity 176 is defined between the movable arcuate surface 170*a* and the stationary arcuate surfaces 172*a* and 174*a*. The cavity 176 is positioned below the bottom end of the ramp 136*a*. Under conditions to be described below, the push rod 124 is adapted to be disposed in the cavity 176, extend or move out of the cavity 176, and retract back into the cavity 176. The carrot forming assembly 30 further comprises the movable wall extension limit switch 66 and the movable wall retraction limit switch 68, each of which is adapted to engage the sliding link 164.

In several exemplary embodiments, the motor 64, the circular disk 160, the pin 162, the sliding link 164, the shaft 166, the rotation-to-translation link 168, the movable wall 170, the horizontal support 172, the stationary wall 174, and the cavity 176 are all disposed within the internal region 112 defined by the connected housings 12 and 14.

The movable wall 170 has two primary operational positions, as shown in FIGS. 14B and 14C. As illustrated in FIG. 14B, the movable wall 170 is retracted away from the stationary wall 174. Thus, the cavity 176 is relatively large and adapted to receive pre-cut tobacco leaves from the ramp 136*a*, under conditions to be described below. To place the movable wall 170 in its retracted position, the motor 64 causes the circular disk 160 to rotate clockwise, as viewed in FIG. 14B. The pin 162 slides within the slot 164*a* of the link 164, causing the link 164 to swing towards the switch 68 and the shaft 166 to rotate which, in turn, causes the movable wall 170 to slide against the horizontal support 172 and translate to the left, as viewed in FIG. 14B, and away from the stationary wall 174, thereby increasing the size of the cavity 176. The movable wall 170 continues to so translate until the link 164 engages the movable wall retraction limit switch 68. As a result of this engagement, one or more signals are sent to the controller 46 indicating that the movable wall 170 has reached its retraction limit and the motor 64 is no longer needed to operate to effect the retraction.

As shown in FIG. 14C, the movable wall 170 is extended towards the stationary wall 174. Thus, the cavity 176 is relatively small and generally cylindrically shaped, and is adapted to compress pre-cut tobacco leaves therein, under conditions to be described below. In an exemplary embodiment, when the movable wall 170 is extended towards the stationary wall 174, the cavity 176 defines a diameter of about 6 mm. To place the movable wall 170 in its extended position, the motor 64 causes the circular disk 160 to rotate counterclockwise, as viewed in FIG. 14B. The pin 162 slides within the slot 164*a* of the link 164, causing the link 164 to swing towards the switch 66 and the shaft 166 to rotate which, in turn, causes the movable wall 170 to slide against the horizontal support 172 and translate to the right, as viewed in FIG. 14C, and towards the stationary wall 174, thereby decreasing the size of the cavity 176. The movable wall 170 continues to so translate until the link 164 engages the switch movable wall extension limit switch 66. As a result of this engagement, one or more signals are sent to the controller 46 indicating that the movable wall 170 has reached its extension limit and the motor 64 is no longer needed to operate to effect the extension.

The retraction direction of the movable wall 170 is indicated by arrow 178*a* in FIGS. 14A and 14B. The extension direction of the movable wall 170 is indicated by arrow 178*b* in FIGS. 14A and 14C. The rotation direction of the circular disk 160 to effect the retraction is indicated by arrow 180*a* in FIGS. 14A and 14B. The rotation direction of the circular disk 160 to effect the extension is indicated by arrow 180*b* in FIGS. 14A and 14C.

Figure 15A:
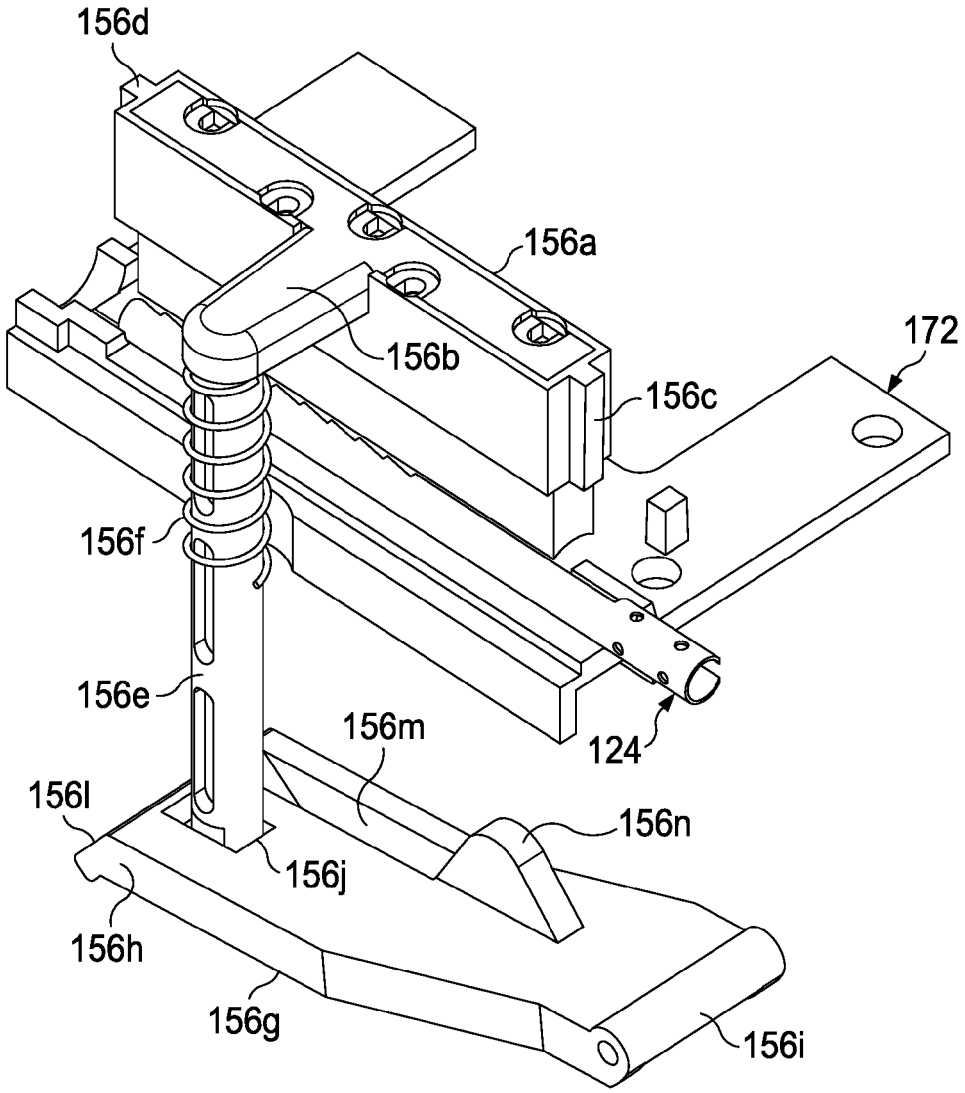
FIGS. 15A and 15B are different perspective views of yet another portion of the carrot forming assembly of the cigarette manufacturing machine of FIGS. 1-3, according to an exemplary embodiment.
Figure 15B:
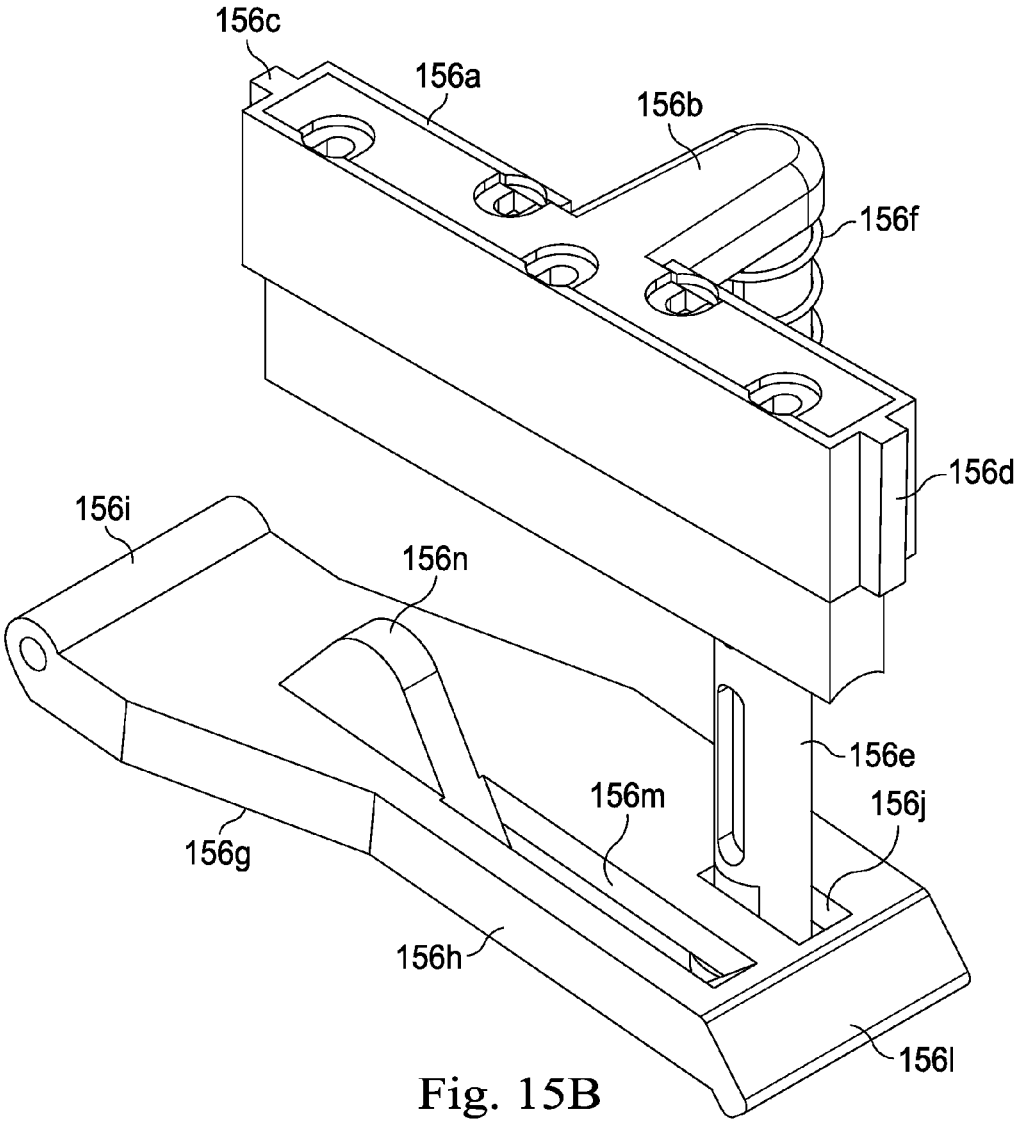
Figure 15C:
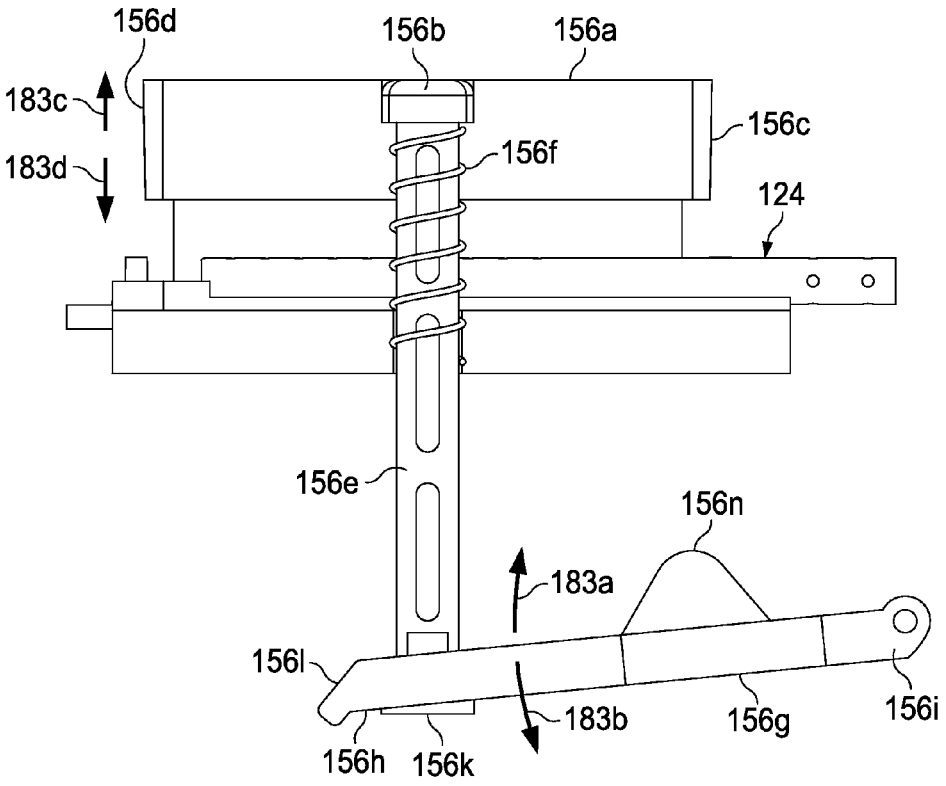
FIG. 15C is an elevational view of the portion of FIGS. 15A and 15B, according to an exemplary embodiment.

In an exemplary embodiment, as illustrated in FIGS. 15A, 15B, and 15C with continuing reference to FIGS. 1-14C, and as described above, the plunger assembly 156 includes the plunger block 156*a*, the transverse arm 156*b*, the ribs 156*c* and 156*d*, the post 156*e*, and the helical spring 156*f*. As shown in FIGS. 15A-15C, the plunger assembly 156 further includes a pivoting arm 156*g* including opposing end portions 156*h* and 156*i*. The end portion 156*i* of the pivoting arm 156*g* is pivotably connected to, and extends between, a pair of vertical supports 14*h* and 14*i* (shown in FIGS. 16A and 16B). The vertical supports 14*h* and 14*i* extend down from the top inside surface 14*e* of the upper housing 14. Under conditions to be described below, the pivoting arm 156*g* is adapted to pivot about the pivot connection between the end portion 156*i* and the vertical supports 14*h* and 14*i*. The pivoting of the pivoting arm 156*g* in an upward direction is indicated by an arrow 183*a* in FIG. 15C, and in a downward direction by an arrow 183*b*. The end portion 156*h* of the pivoting arm 156*g* is operably coupled to the post 156*e* at the end thereof opposing the transverse arm 156*b*. More particularly, an opening 156*j* is formed through the end portion 156*h*, and the post 156*e* extends through the opening 156*j*. An end bracket 156*k* (shown in FIGS. 15C, 16A, and 16B) is connected to the bottom end of the post 156*e*, and also engages the bottom surface of the pivoting arm 156*g* at the end portion 156*h* thereof. The respective sizes of the opening 156*j*, the post 156*e*, and the end bracket 156*k* are configured so that the post 156*e* extends substantially vertically at all times, regardless of the pivot position of the pivoting arm 156*g*. Under conditions to be described below, the helical spring 156*f* is adapted to cause the post 156*e*, as well as the arm 156*b* and the plunger block 156*a*, to move upwards as indicated by an arrow 183*c* in FIG. 15C, causing the pivoting arm 156*g* to pivot in the direction indicated by the arrow 183*a*. Under conditions to be described below, the pivoting arm 156*g* is adapted to be forced to pivot in the direction indicated by the arrow 183*b*, causing the post 156*e*, the arm 156*b*, and the plunger block 156*a* to move downwards as indicated by an arrow 183*d* in FIG. 15C, as well as causing the helical spring 156*f* to be compressed in the direction indicated by the arrow 183*d* (the spring 156*f* is compressed against the internal shoulder 14*ga*). A chamfer 156*l* is formed at the edge of the end portion 156*h*. A slot 156*m* is formed in the pivoting arm 156*g*. The slot 156*m* extends from a location proximate the chamfer 156*l* and the opening 156*j*, to a location approximately midway along the pivoting arm 156*g*. A cam 156*n* extends upward from the pivoting arm 156*g*. The cam 156*n* is adjacent the slot 156*m* at the end thereof opposing the chamfer 156*l*.

Figure 16A:
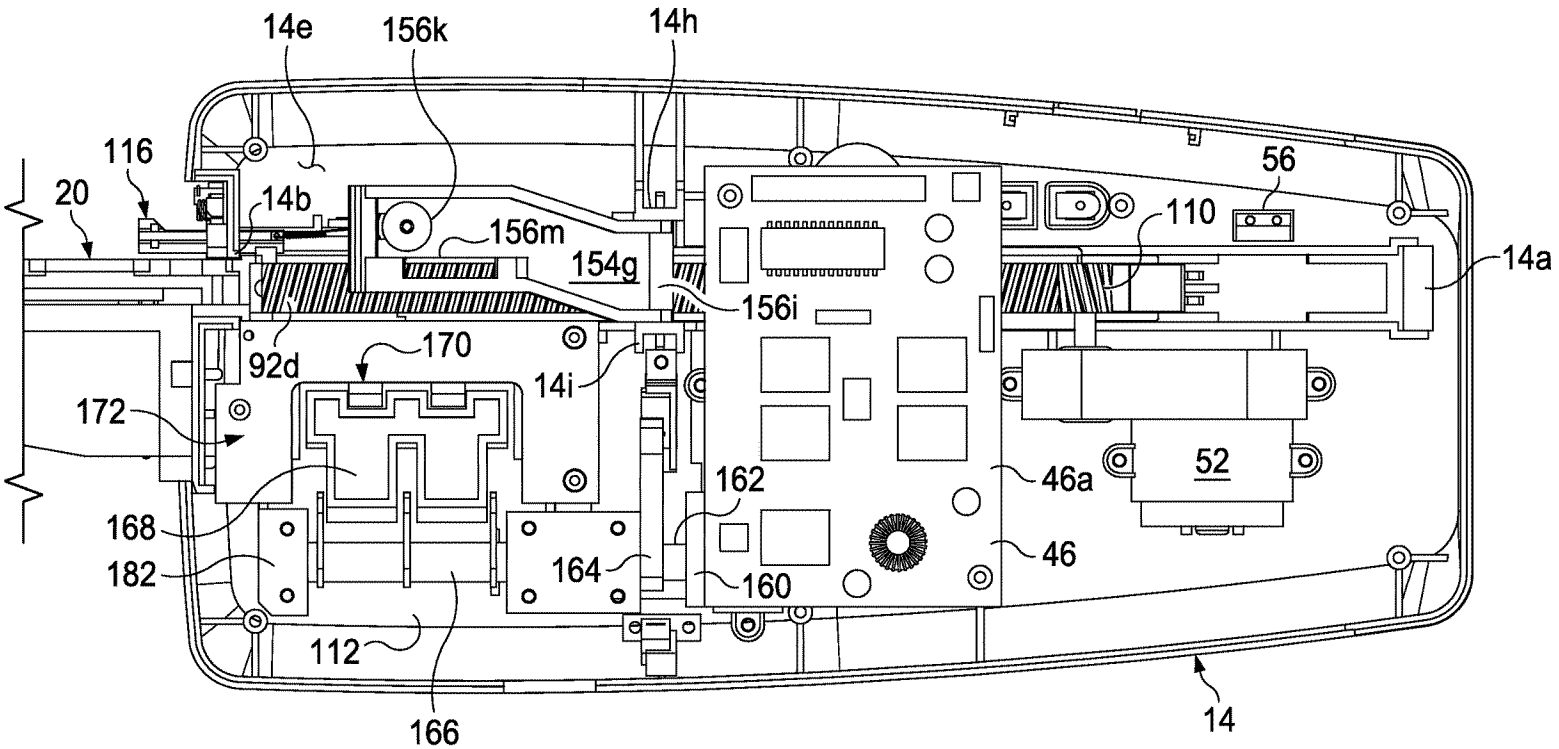
FIG. 16A is a bottom plan view of a portion of the cigarette manufacturing machine of FIGS. 1-3, according to an exemplary embodiment.
Figure 16B:
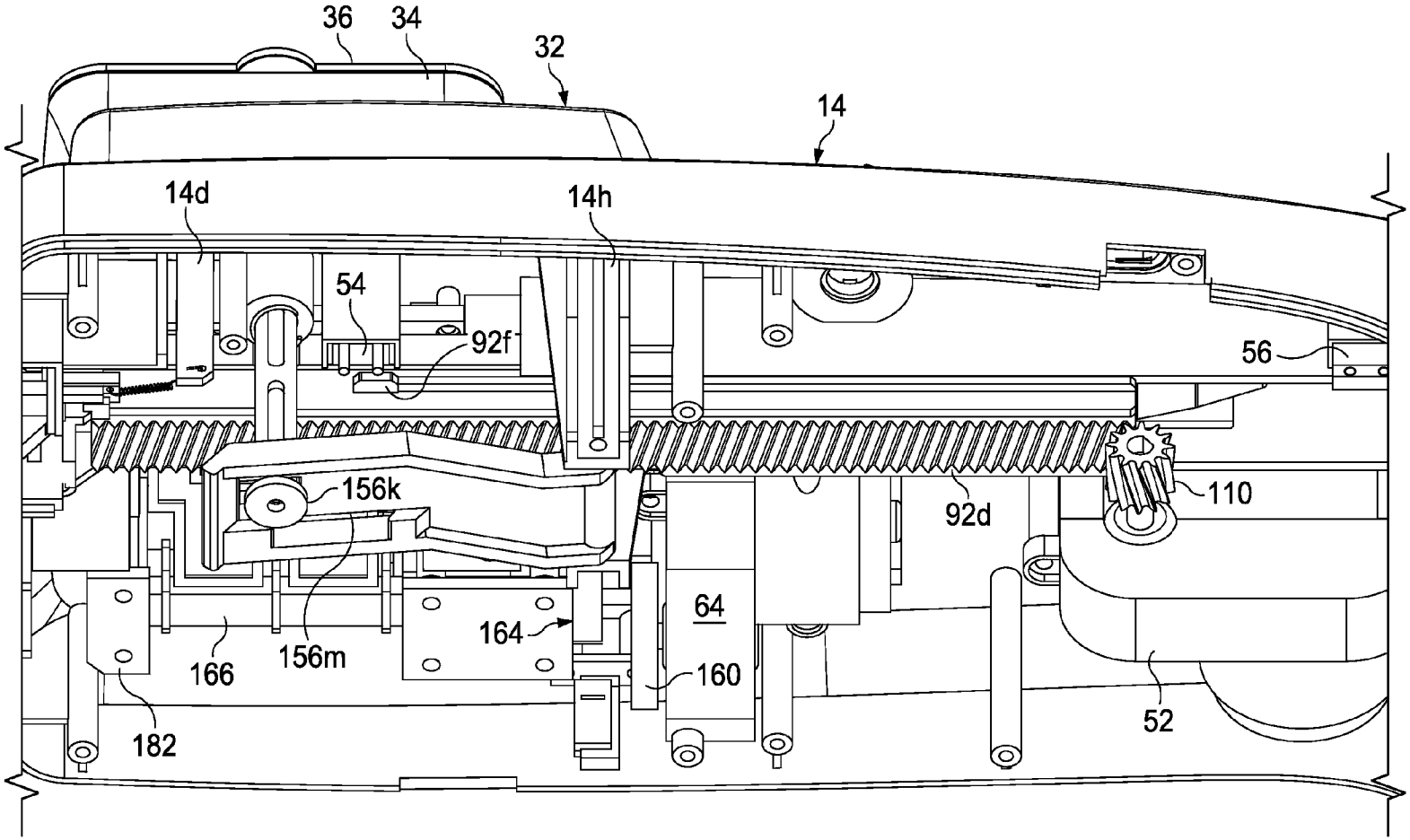
FIG. 16B is a perspective view of another portion of the cigarette manufacturing machine of FIGS. 1-3, according to an exemplary embodiment.

In an exemplary embodiment, as illustrated in FIGS. 16A and 16B with continuing reference to FIGS. 1-15C, the controller 46 includes a printed circuit board (PCB) 46*a*, to which the computer processor 48 and the computer readable medium 50 may be connected. The PCB 46*a* is connected to the underside of the upper housing 14, generally in the middle between the openings 14*b* and 14*a*. The carriage assembly 20 extends into the internal region 112 via the opening 14*b*, extending vertically between the top inside surface 14*e* of the upper housing 14 and the pivoting arm 156*g* of the plunger assembly 156. The carriage assembly 20 further extends vertically between the top inside surface 14*e* of the upper housing 14 and the PCB 46*a* so that the rack teeth 92*d* engage the pinion 110. As noted above, and under conditions to be described below, the rack bar 92 may extend out of the upper housing 14 via the opening 14*a* opposing the opening 14*b*. As noted above and shown in FIGS. 16A and 16B, the pinion 110 is connected to the output shaft of the motor 52, which is connected to the upper housing 14. The PCB 46*a* is horizontally positioned between the plunger assembly 156 and the motor 52. The transmission arm retraction limit switch 56 is connected to the upper housing 14 at a position proximate the opening 14*a*. As shown in FIG. 16B, the transmission arm extension limit switch 54 is connected to the upper housing 14 at a horizontal position between the vertical supports 14*d* and 14*h*. As indicated in FIGS. 16A and 16B, the motor 64 is vertically positioned between the top inside surface 14*e* of the upper housing 14 and the PCB 46*a* (the PCB 46*a* is omitted from FIG. 16B). The circular disk 160, which is connected to the output shaft of the motor 64, is adjacent the PCB 46*a*. The switches 66 and 68 are connected to the upper housing 14 and positioned on either side of the circular disk 160. The shaft 166 is spaced in a parallel relation from the carriage assembly 20. A bracket 182 is connected to the upper housing 14 and supports, at least in part, the end of the shaft 166 opposite the end thereof connected to the sliding link 164. The horizontal support 172 is connected to the upper housing 14. In an exemplary embodiment, the electrical power supply 70 is connected to a bottom inside surface of the lower housing 12.

In several exemplary embodiments, each of the motors 52, 58, and 64, the switches 54, 56, 60, 66, and 68, the humidity sensor 62, the tobacco compaction level switch 38, the pause/start button 40, the on/off button 42, and the electrical power supply 70 is in electrical communication with the PCB 46*a*, and/or other electronic device(s) connected thereto, via one or more wires. In several exemplary embodiments, one or more of the foregoing components, and/or one or more other components of the control system 44, are in wireless communication with the PCB 46*a* or electronic devices connected thereto. In several exemplary embodiments, a remote control module is in communication with the controller 46.

Figure 17A:
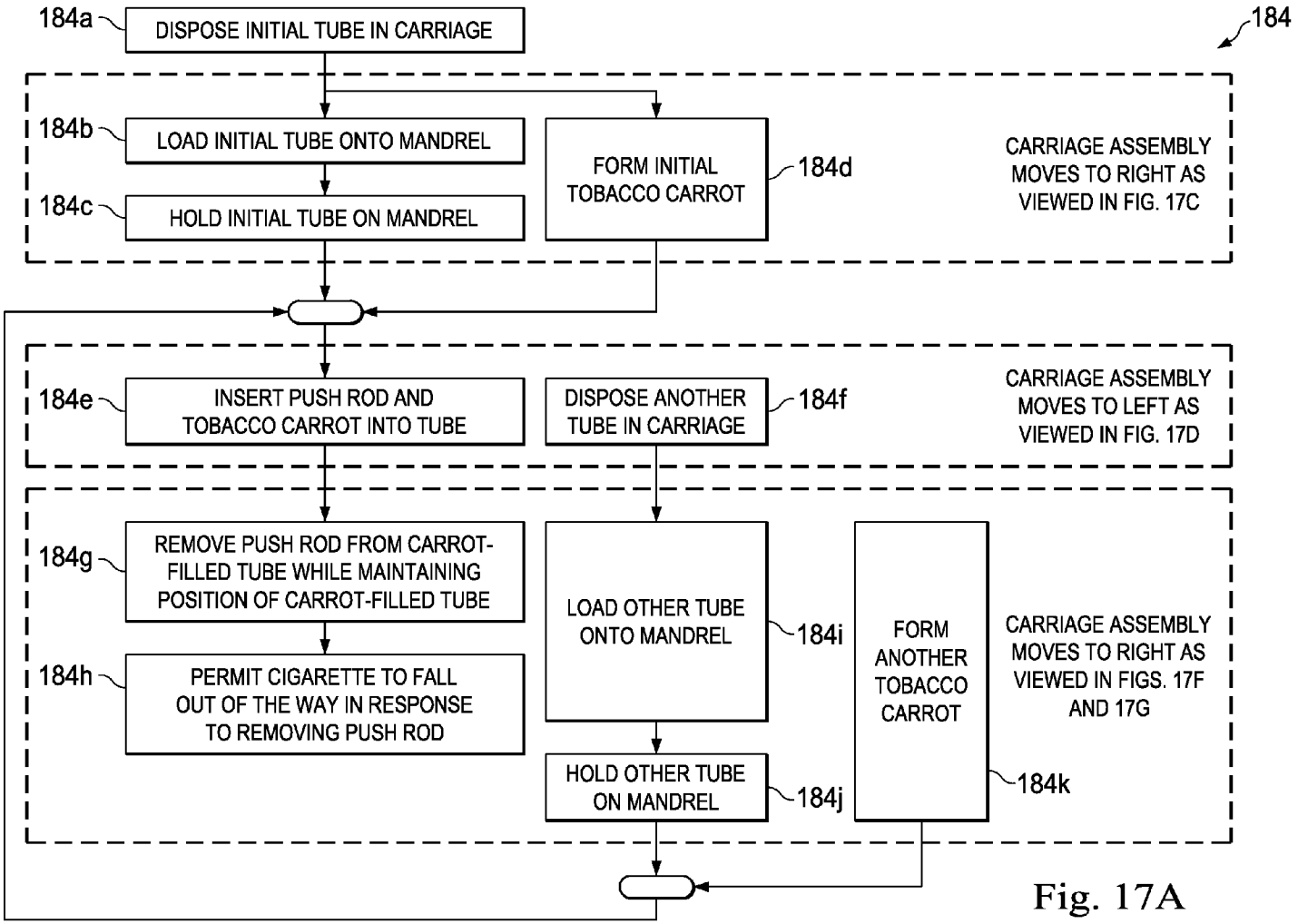
FIG. 17A is a flow chart illustration of a method of operation of the cigarette manufacturing machine of FIGS. 1-16B, according to an exemplary embodiment.
Figure 17B:
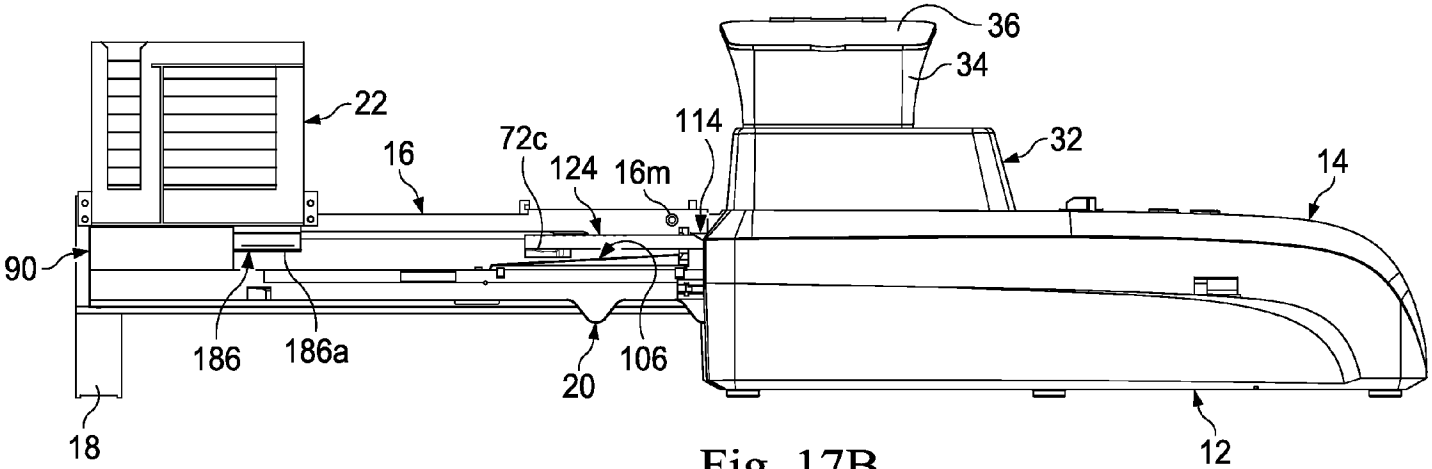
FIGS. 17B-17G are different elevational views of the cigarette manufacturing machine of FIGS. 1-16B during the execution of the method of FIG. 17A, according to an exemplary embodiment.

In an exemplary embodiment, as illustrated in FIGS. 17A-17G with continuing reference to FIGS. 1-16B, a method of operating the machine 10 is generally referred to by the reference numeral 184. The method 184 includes a step 184*a*, at which an initial, empty cigarette tube 186 is disposed in the carriage 90 of the carriage assembly 20. This disposal of the initial tube 186 at the step 184*a* is shown in FIG. 17B.

Figure 17C:
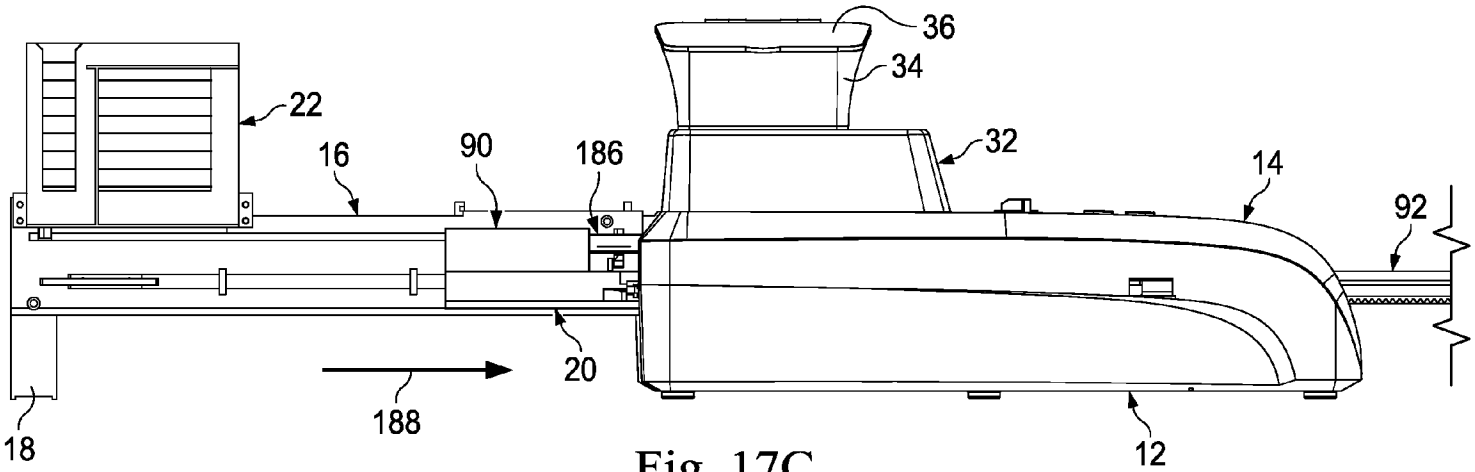
Figure 17D:
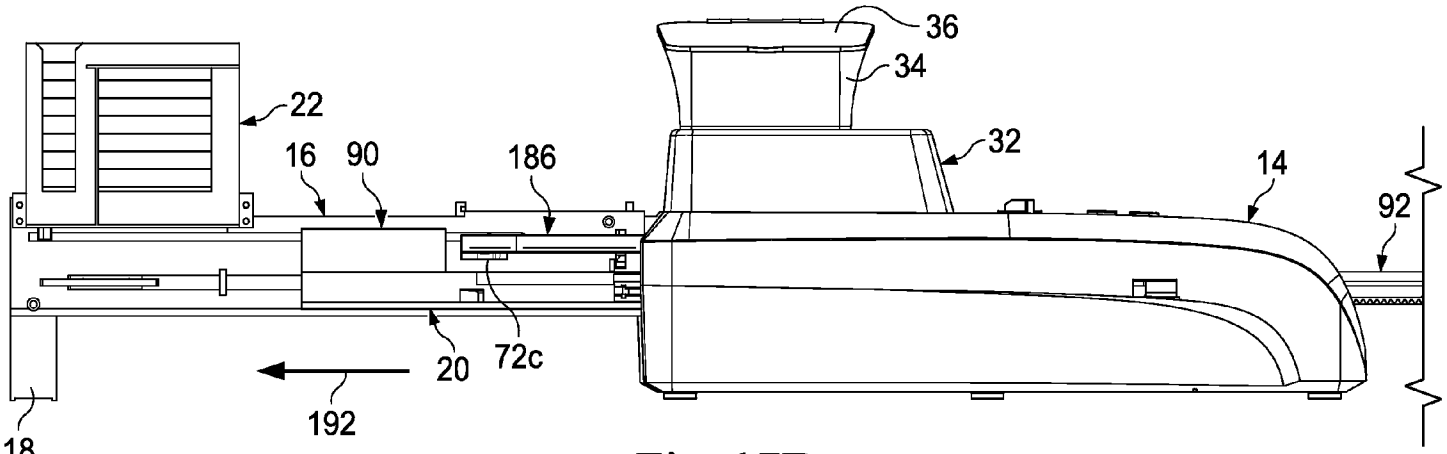

After the step 184*a*, at step 184*b* the initial tube 186 is loaded onto the mandrel 114 of the tube holding assembly 26. After the step 184*b*, at step 184*c* the initial tube 186 is held on the mandrel 114 using the tube holding assembly 26. During the steps 184*b* and 184*c*, an initial tobacco carrot is formed at step 184*d*. In several exemplary embodiments, the step 184*d* is executed during and after the steps 184*b* and 184*c*. In several exemplary embodiments, the step 184*d* is executed before, during, and after the steps 184*b* and 184*c*. The loading and holding of the initial tube 186 at the steps 184*b* and 184*c*, respectively, are shown in FIG. 17C, while the forming of the initial tobacco carrot at the step 184*d* is hidden from view in FIG. 17C. To execute the loading step 184*b* and the holding step 184*c*, and to execute at least a portion of the forming step 184*d*, the carriage assembly 20 travels from left to right, as viewed in FIG. 17C and indicated by arrow 188.

Figure 17E:
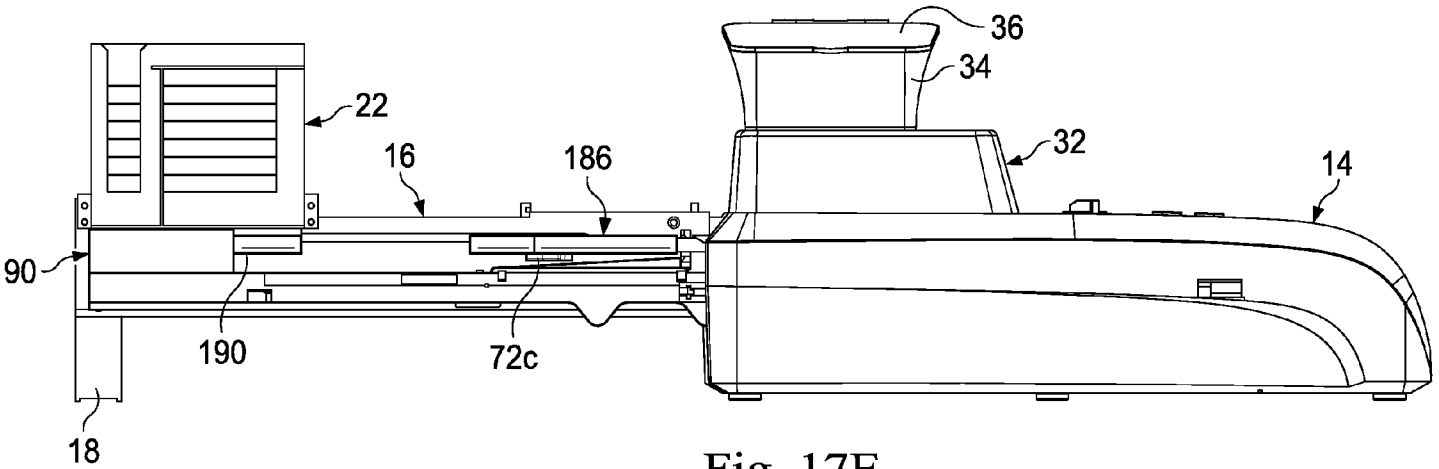

After the step 184*d*, the push rod 124, together with the tobacco carrot formed at the step 184*d*, are inserted into the initial tube 186 at step 184*e*. During the step 184*e*, at step 184*f* another empty cigarette tube 190 (shown in FIG. 17E) is disposed in the carriage 90 of the carriage assembly 20. In several exemplary embodiments, the step 184*f* is executed during and after the step 184*e*. To execute the insertion step 184*e* and the disposal step 184*f*, the carriage assembly 20 travels from right to left, as viewed in FIG. 17D and indicated by arrow 192. FIG. 17E shows the disposal of the tube 190 at the step 184*f*. FIG. 17E also shows the initial tube 186 after the push rod 124 and the tobacco carrot formed at the step 184*d* have been inserted in the initial tube 186 at the step 184*e*.

Figure 17F:
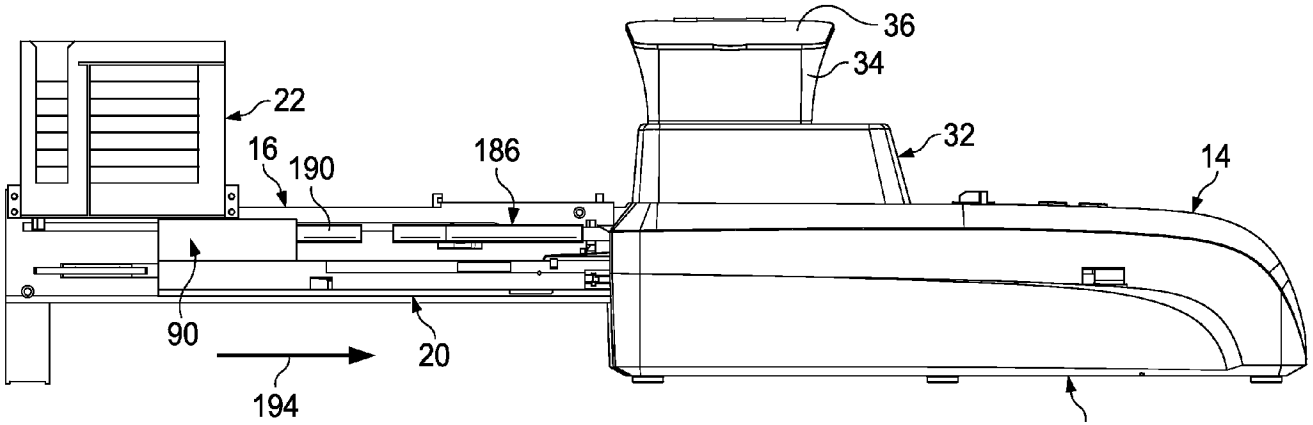
Figure 17G:
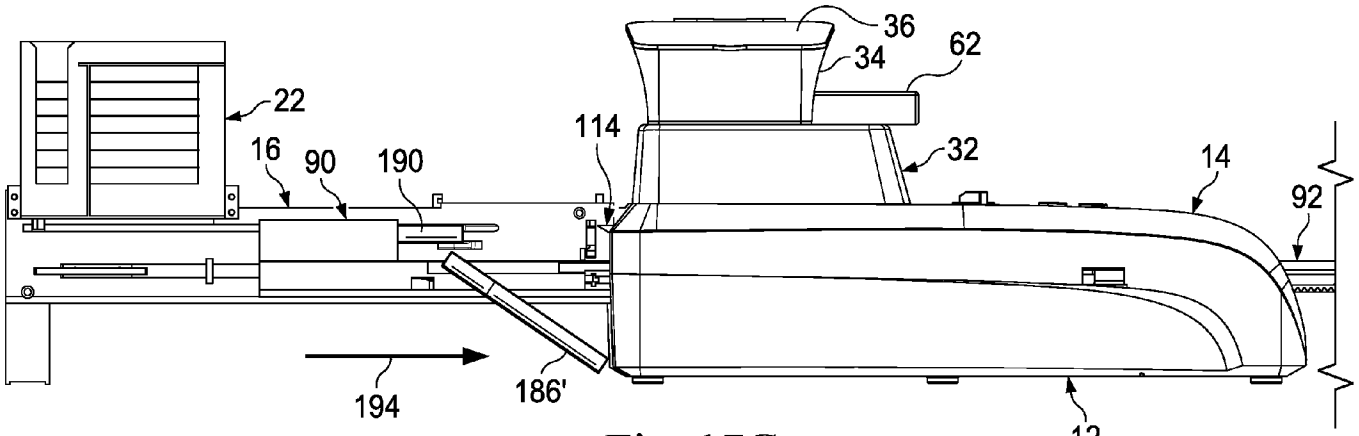

After the steps 184*e* and 184*f*, at step 184*g* the push rod 124 is removed from the carrot-filled initial tube 186 while the position of the carrot-filled initial tube 186 is generally maintained. The removing step 184*g* is shown in FIG. 17F. After the step 184*g*, the carrot-filled initial tube 186, which is now a manufactured cigarette 186', is permitted at step 184*h* to fall out of the way in response to removing the push rod 124 at the step 184*g*. The falling step 184*h* is shown in FIG. 17G. To execute the removing step 184*g* and the falling step 184*h*, the carriage assembly 20 again travels from left to right, as viewed in FIGS. 17F and 17G and indicated by arrow 194.

During and after the steps 184*g* and 184*h*, the tube 190 is loaded onto the mandrel 114 at step 184*i*. After the step 184*i*, at step 184*j* the tube 190 is held on the mandrel 114 using the tube holding assembly 26. During the steps 184*i* and 184*j*, another tobacco carrot is formed at step 184*k*. In several exemplary embodiments, the step 184*k* is executed during and after the steps 184*i* and 184*j*. In several exemplary embodiments, the step 184*k* is executed before, during, and after the steps 184*i* and 184*j*. To execute the loading step 184*i* and the holding step 184*j*, and to execute at least a portion of the forming step 184*k*, the carriage assembly 20 continues to travel from left to right, as viewed in FIGS. 17F and 17G and indicated by the arrow 194.

After the step 184*k*, the steps 184*e* and 184*f* are repeated. The push rod 124 and the tobacco carrot formed at the step 184*k* are inserted into the tube 190 at the step 184*e*, and yet another empty cigarette tube is disposed in the carriage at the step 184*f*. After the steps 184*e* and 184*f*, the steps 184*g* and 184*h* are executed. At the step 184*g*, the push rod 124 is removed from the carrot-filled tube 190 while the position of the carrot-filled tube 190 is generally maintained. At the step 184*h*, the carrot-filled tube 190, which is now a manufactured cigarette, falls out of the way in response to removing the push rod 124 at the step 184*g*. The tube disposed in the carriage 90 at the step 184*f* is loaded onto the mandrel 114 at the step 184*i*, and held on the mandrel 114 at the step 184*j*, while yet another tobacco carrot is formed at the step 184*k*.

In several exemplary embodiments, the steps 184*e*, 184*f*, 184*g*, 184*h*, 184*i*, 184*j*, and 184*k* are repeated until there are no longer any empty cigarette tubes in the tube magazine assembly 22. At this point, in several exemplary embodiments, the steps 184*e*, 184*g*, and 184*h* are executed using the last empty cigarette tube previously disposed in the tube magazine assembly 22 and disposed in the carriage 90 at the step 184*f*, but no additional empty cigarette tube is loaded at the step 184*i* and held at the step 184*j* (another tobacco carrot may or may not be formed at the step 184*k*). After the steps 184*e*, 184*g*, and 184*h* are executed, the operation of the machine 10 is stopped.

In an exemplary embodiment, the controller 46 counts the number of times the step 184*g* is executed; once this number is equal to the quantity of empty cigarette tubes that the tube magazine assembly 22 can hold, the controller 46 stops the operation of the machine 10.

In an exemplary embodiment, the carriage 90 and/or the tube magazine assembly 22 includes a sensor that detects that the tube magazine assembly 22 does not have any empty cigarette tubes stored therein, and sends one or more signals to the controller 46 informing the controller 46 that the tube magazine assembly 22 is empty of tubes. At this point, in several exemplary embodiments, the steps 184*e*, 184*g*, and 184*h* are executed using the last empty cigarette tube previously disposed in the tube magazine assembly 22 and disposed in the carriage 90 at the step 184*f*, but no additional empty cigarette tube is loaded at the step 184*i* and held at the step 184*j* (another tobacco carrot may or may not be formed at the step 184*k*). After the steps 184*e*, 184*g*, and 184*h* are executed, the controller 46 stops the operation of the machine 10 on the basis of the controller 46's receipt of the one or more signals from the sensor at the carriage 90 and/or the tube magazine assembly 22.

In an exemplary embodiment, the operation of the machine 10 is stopped by a user of the machine after the user observes that all of the empty cigarette tubes previously disposed in the tube magazine assembly 22 have become manufactured cigarettes.

Various steps of the method 184, as described above and illustrated in FIGS. 17A-17G, will be described in further detail below. Additionally, other operational features of the machine 10, which enable the machine 10 to carry out the method 184, will also be described below.

Figure 18B:
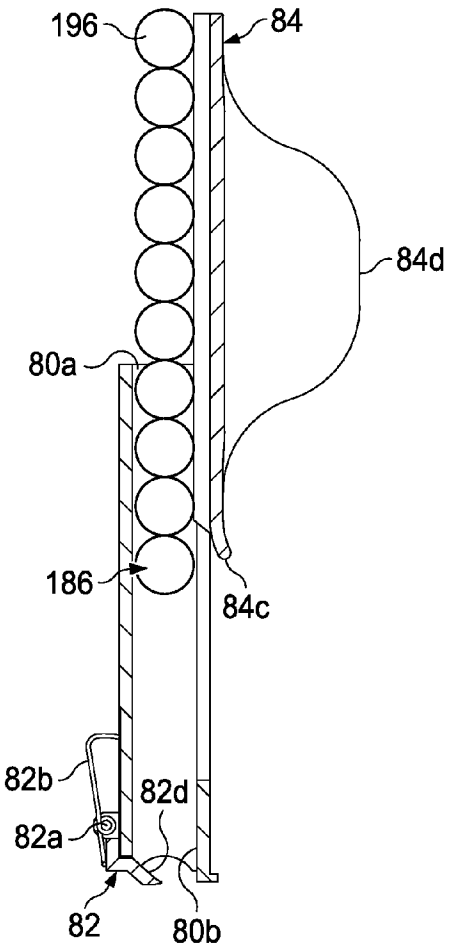
FIG. 18B is a sectional view of the tube magazine assembly of FIGS. 8A-8D during the step of FIG. 18A, according to an exemplary embodiment.
Figure 18A:
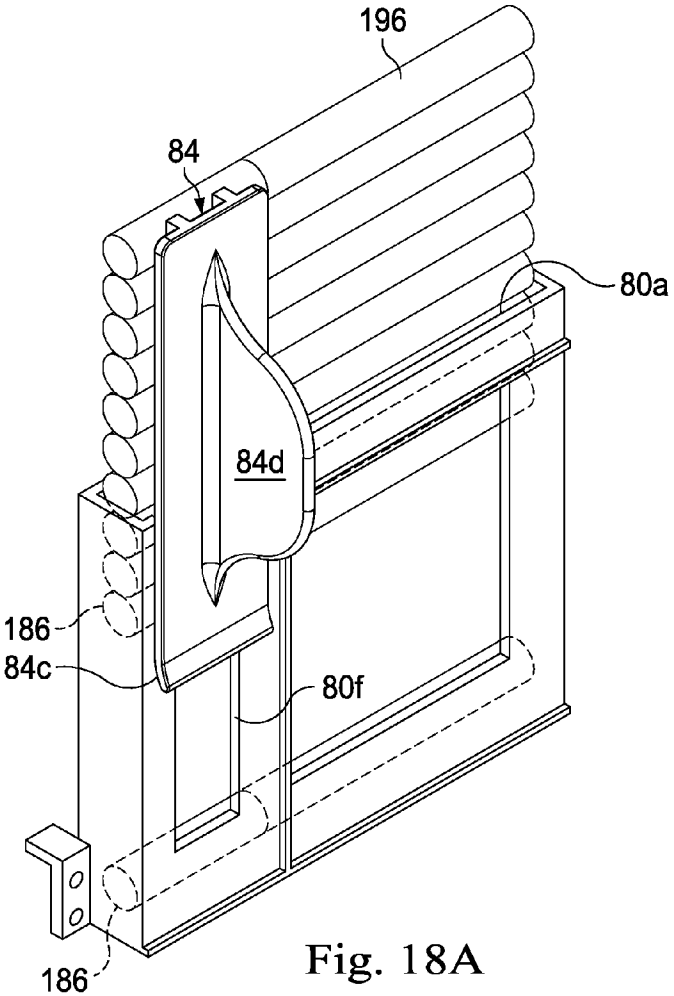
FIG. 18A is a perspective view of the tube magazine assembly of FIGS. 8A-8D during a step of the method of FIG. 17A, according to an exemplary embodiment.
Figure 18C:
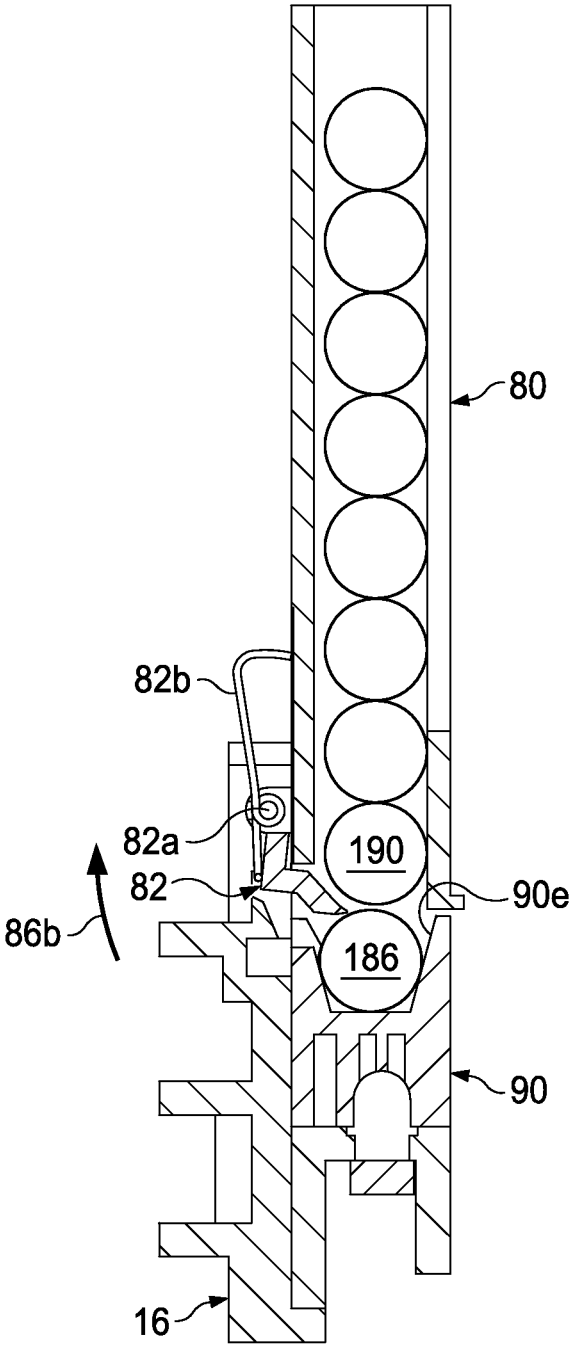
FIG. 18C is a sectional view of the tube magazine assembly of FIGS. 8A-8D connected to the horizontal support of FIGS. 6A-6C during the step of FIG. 18A, according to an exemplary embodiment.

In an exemplary embodiment, as illustrated in FIGS. 18A-18C with continuing reference to FIGS. 1-17G, to dispose the initial tube 186 in the carriage 90 at the step 184*a* of the method 184, a plurality of empty cigarette tubes 196 are picked up using the cigarette tube holder 84. In particular, the empty cigarette tubes 196 are positioned adjacent each other in a parallel arrangement (such as in a carton of tubes), and the adhesives 84*g* are engaged with the respective filter end portions of the empty cigarette tubes 196; the initial tube 186 is part of the plurality of empty cigarette tubes 196, and is the tube adjacent, or closest to, the curved surface 84*c*. As a result, the empty cigarette tubes 196 are adhered to the cigarette tube holder 84 using the adhesives 84*g*. The cigarette tube holder 84 (with the empty cigarette tubes 196 adhered thereto) is picked up using the handle 84*d*, and positioned above the top opening 80*a* so that the curved surface 84*c* is above the slot 80*f*. The cigarette tube holder 84 is then moved downwards so that the ribs 84*ea* and 84*eb* extend and move downwards within the slot 80*f*, disposing the empty cigarette tubes 196 in the quadrilateral structure 80. In an exemplary embodiment, when the tube holder 84 is near or at the bottom end of the slot 80*f*, continued downward movement of the cigarette tube holder 84 causes the tube holder 84 to disengage from the empty cigarette tubes 196. The curved surface 84*c* facilitates the introduction of the empty cigarette tubes 196 into the top opening 80*a*, and the disengagement of the cigarette tube holder 84 from the tubes 196 when the curved surface 84*c* is near or at the bottom end of the slot 80*f*.

In an exemplary embodiment, at the step 184*a*, the initial position of the carriage 90 is directly below the tube magazine assembly 20. As a result, the angularly-extending surface 90*j* of the tab 90*i* of the carriage 90 engages the angularly-extending surface 82*f* of the protrusion 82*e* of the bottom door 82, overcoming the biasing force of the torsion spring 82*b* so that the bottom door 82 pivots about the hinged connected 82*a* and in the direction indicated by the arrow 86*b* in FIGS. 8C, 8D, and 18C. The protrusion 82*e* may be pushed into the notch 16*i*. As a result, the initial tube 186 falls through the bottom opening 80*b* of the quadrilateral structure 80, through the top opening 90*e* of the carriage 90, and into the channel 90*d* of the carriage 90. Thus, the initial tube 186 is disposed in the carriage 90 at the step 184*a*.

In another exemplary embodiment, at the step 184*a*, the initial position of the carriage 90 is not directly below the tube magazine assembly 22. Instead, the carriage 90 is initially positioned horizontally between the carriage 90 and the upper housing 14. Thus, at the step 184*a*, the carriage assembly 20 moves so that the carriage 90 moves away from the upper housing 14 and towards the end post 18. To so move the carriage assembly 20, the motor 52 drives the pinion 110 so that the pinion 110 rotates in place; the pinion 110 rotates counterclockwise, as viewed in FIG. 9A. Due to the engagement between the pinion 110 and the rack teeth 92*d* of the carriage assembly 20, the counterclockwise rotation of the pinion 110 causes the carriage assembly 20 to translate so that the carriage 90 moves towards the end post 18. During this movement of the carriage 90, the angularly-extending surface 90*j* of the tab 90*i* of the carriage 90 engages the angularly-extending surface 82*f* of the protrusion 82*e* of the bottom door 82, overcoming the biasing force of the torsion spring 82*b* so that the bottom door 82 pivots about the hinged connected 82*a* and in the direction indicated by the arrow 86*b* in FIGS. 8C, 8D, and 18C. The protrusion 82*e* may be pushed into the notch 16*i*. As a result, the initial tube 186 falls through the bottom opening 80*b* of the quadrilateral structure 80, through the top opening 90*e* of the carriage 90, and into the channel 90*d* of the carriage 90. Thus, the initial tube 186 is disposed in the carriage 90 at the step 184*a*. In several exemplary embodiments, the controller 46 detects that the carriage 90 has traveled, far enough towards the end post 18, in response to the protrusion 92*f* of the rack bar 92 engaging the transmission arm extension limit switch 54, which sends one or more signals to the controller 46 indicating that the carriage 90 has indeed traveled far enough towards the end post 18; as a result, the controller 46 stops the motor 52 from driving the pinion 110, thereby stopping movement of the carriage assembly 20.

In an exemplary embodiment, as illustrated in FIGS. 19A-19D with continuing reference to FIGS. 1-18C and in particular to FIGS. 17B and 17C, to load the initial tube 186 on the mandrel 114 at the step 184*b* of the method 184, the motor 52 causes the pinion 110 to rotate clockwise, as viewed in FIG. 9A, causing the carriage assembly 22 to translate from the left to the right, as viewed in FIGS. 17B and 17C and indicated by the arrow 188. During this translation, the initial tube 186 is carried by the carriage 90, continuing to extend within the channel 90*d* of the carriage 90. As shown in FIGS. 17B and 17C, an open end portion 186*a* of the initial tube 186 opposite its filter end portion sticks out of the carriage 90. Moreover, during the translation in the direction indicated by the arrow 188 in FIGS. 17B and 17C, the angularly-extending surface 90*j* of the tab 90*i* of the carriage 90 no longer engages the angularly-extending surface 82*f* of the protrusion 82*e* of the bottom door 82; as a result, the biasing force of the torsion spring 82*b* causes the bottom door 82 to pivot about the hinged connected 82*a* and in the direction indicated by the arrow 86*a* in FIGS. 8C and 8D. Therefore, the bottom door 82 closes and prevents any of the remaining tubes 196 in the tube magazine assembly 22 from falling through the bottom opening 80*b* of the quadrilateral structure 80. Additionally, during the translation in the direction indicated by the arrow 188 in FIGS. 17B and 17C, the side surface 90*c* of the carriage 90 engages the tab 72*c* of the cigarette end support 72, overcoming the biasing force of the torsion spring 72*d* so that the cigarette end support 72 pivots, about the pin connection 72*b* and in the direction indicated by the arrow 78*a* in FIG. 7C. As a result, the tab 72*c* retracts into the horizontal slot 16*j* of the horizontal support 16, dragging against the back surface 90*h* of the carriage 90 as the carriage assembly 20 translates in the direction indicated by the arrow 188; after the carriage assembly 20 stops so translating as described below, the retracted position of the tab 72*c* in the horizontal slot 16*j* continues to be maintained due to the engagement between the tab 72*c* and the back surface 90*h* of the carriage 90.

Figure 19B:
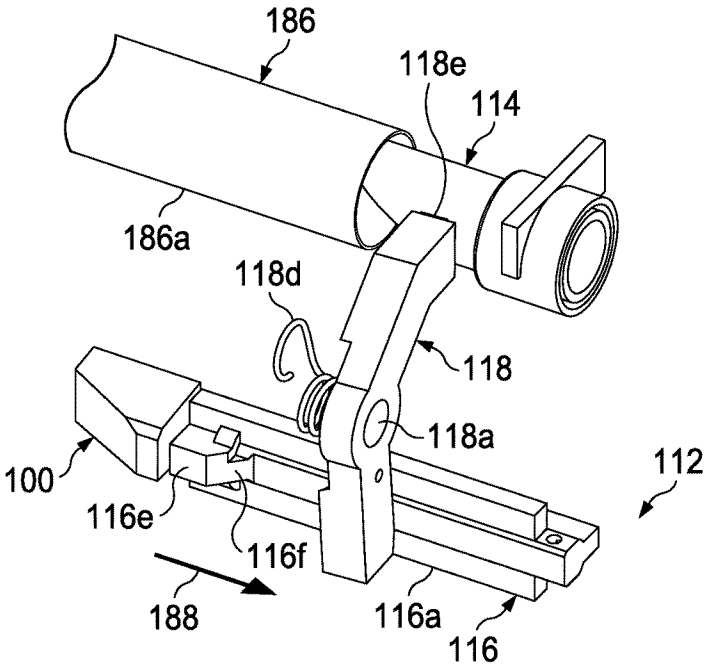
FIGS. 19A-19C are different perspective views of a portion of the tube holding assembly of FIGS. 10A-10E during another step of the method of FIG. 17A, according to an exemplary embodiment.
Figure 19A:
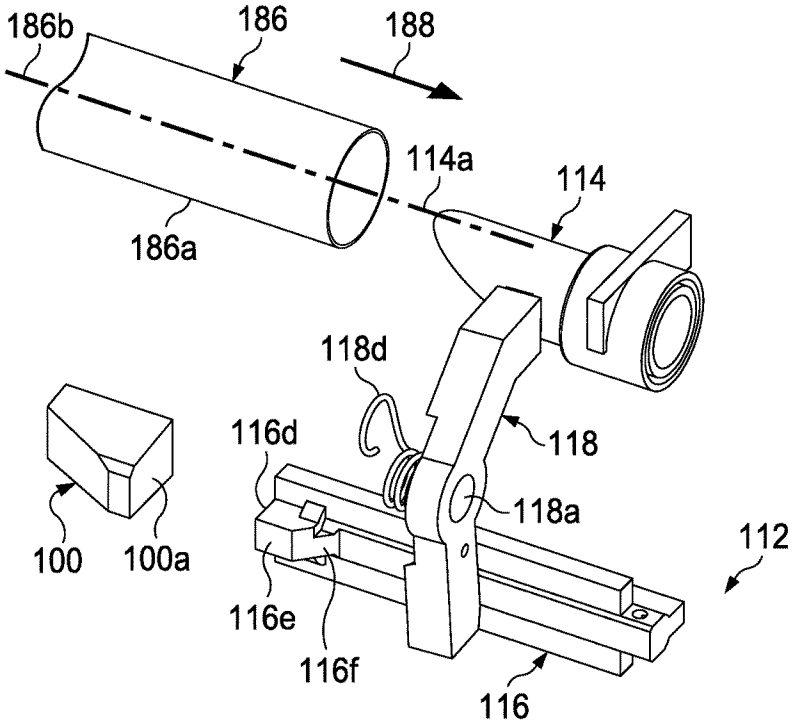

As shown in FIG. 19A, continued translation of the carriage 90 in the left-to-right direction as indicated by the arrow 188 causes the end portion 186*a* of the initial tube 186 to approach the mandrel 114, and also causes the contact surface 100*a* of the protrusion 100 of the carriage assembly 20 to approach the contact surface 116*d* of the end portion 116*b* of the sliding member 116 of the tube holding assembly 26. In an exemplary embodiment, during the continued translation of the carriage 90 in the left-to-right direction as indicated by the arrow 188, the longitudinal axis 114*a* of the mandrel 114 is generally coaxial with a longitudinal center axis 186*b* of the initial tube 186.

As shown in FIG. 19B, continued translation of the carriage 90 in the direction indicated by the arrow 188 causes the contact surface 100*a* to engage the contact surface 116*d* and push the sliding member 116 so that the bar 116*a* of the sliding member 116 slides, within the corresponding cross-shaped opening 14*c* formed in the upper housing 14, and further into the internal region 112 defined by the connected housings 12 and 14. Before or during this sliding movement of the bar 116*a* of the sliding member 116, continued translation of the carriage 90 in the direction indicated by the arrow 188 causes the end portion 186*a* of the initial tube 186 to be loaded onto the mandrel 114, at the step 184*b*, so that a portion of the mandrel 114 extends within the initial tube 186. During the translation of the carriage 90, the push rod 124 retracts into the cavity 176 via the mandrel 114; thus, the push rod 124 does not interfere with the loading of the initial tube 186 onto the mandrel 114. In an exemplary embodiment, the longitudinal axis 114*a* of the mandrel 114 is generally coaxial with the longitudinal center axis 186*b* of the initial tube 186; as a result, the center of the initial tube 186 initially receives the tip 114*ba* of the mandrel 114 to ensure the proper loading of the initial tube 186 onto the mandrel 114. Continued translation causes the initial tube 186 to receive more of the mandrel 114, resulting in the center of the initial tube 186 being generally coaxial with the center of the mandrel 114, rather than with the longitudinal axis 114*a* of the mandrel 114.

In several exemplary embodiments, the guide roller 16*m* engages the initial tube 186 during its translation, guiding the travel of the initial tube 186 towards the mandrel 114 for loading thereon at the step 184*b*. In an exemplary embodiment, the guide roller 16*m* engages the upper surface of the initial tube 186 as it translates horizontally, as shown in FIG. 17C. In an exemplary embodiment, the guide roller 16*m* stabilizes the initial tube 186 and ensures proper alignment with the tip 114*ba* of the mandrel 114.

In several exemplary embodiments, the angle 114*c* defined by the bevel 114*b* of the mandrel 114 greatly facilitates the loading of the initial tube 186 on the mandrel 114 at the step 184*b*. In several exemplary embodiments, reducing the angle 114*c* to less than 45 degrees reduces the risk of damage to empty cigarette tubes as they are individually loaded onto the mandrel 114. In several exemplary embodiments, reducing the angle 114*c* to equal to, or less than, about 30 degrees reduces the risk of damage to empty cigarette tubes as they are individually loaded onto the mandrel 114.

Figure 19D:
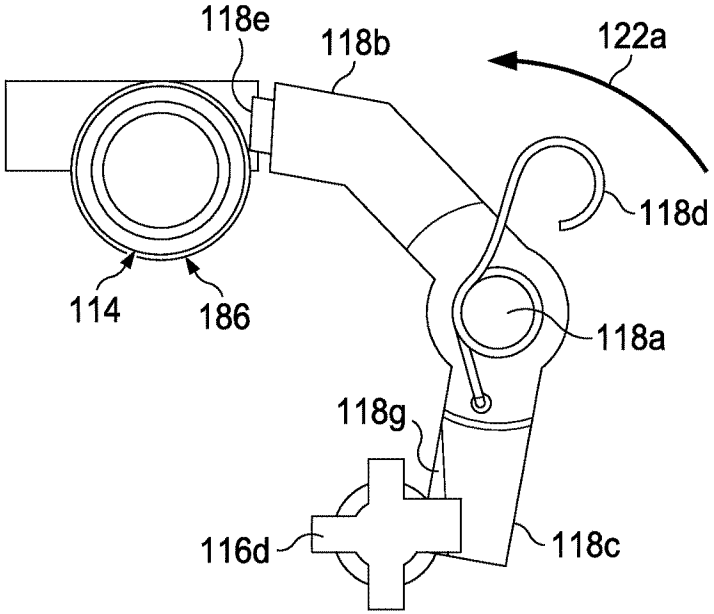
FIG. 19D is an elevational view of the portion of FIGS. 19A-19C during the step of FIGS. 19A-19C, according to an exemplary embodiment.
Figure 19C:
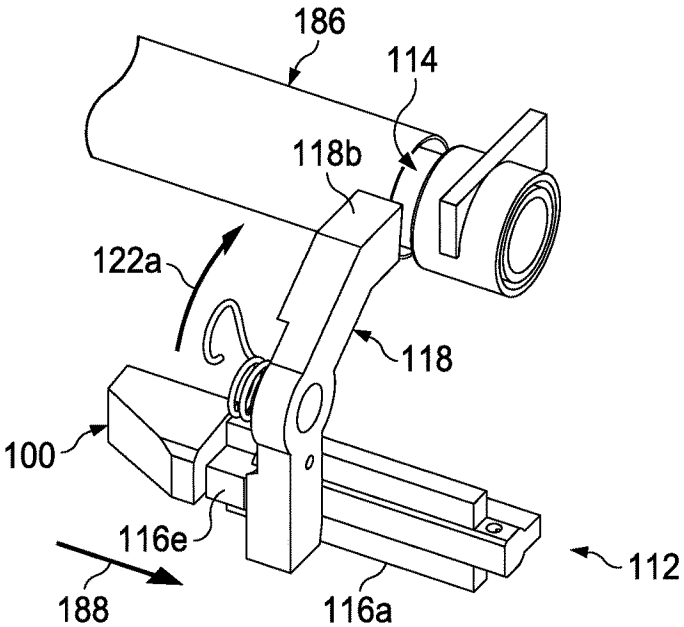

In an exemplary embodiment, to hold the initial tube 186 on the mandrel 114 at the step 184*c*, and as shown in FIGS. 19C and 19D with reference to FIGS. 10C and 10D, continued translation of the carriage 90 in the direction indicated by the arrow 188 causes the protrusion 100 to continue to push the sliding member 116, further into the internal region 112, so that the cam surface 116*f* of the protrusion 116*e* of the sliding member 116 engages and pushes against the contact surface 118*g* of the chamfer 118*f* of the clamping member 118. This engagement and subsequent pushing causes the pivoting member 118 to overcome the biasing force of the torsion spring 118*d* so that the clamping member 118 rotates, about the pin connection 118*a* and in the direction indicated by the arrow 122*a* in FIG. 19D, as well as in FIGS. 10C and 10D.

As shown in FIGS. 19C and 19D, the rotation of the clamping member 118 in the direction indicated by the arrow 122*a* causes the contact protrusion 118*e* extending from the distal end of the upper arm 118*b* to engage the initial tube 186, clamping the wall of the initial tube 186 between the outside surface of the mandrel 114 and the contact protrusion 118*e* of the clamping member 118. As a result, the initial tube 186 is held on the mandrel 114 by the tube holding assembly 26 at the step 184*c*. In an exemplary embodiment, the contact protrusion 118*e* is composed of rubber and/or another elastomer material to minimize any risk of damage to the wall of the initial tube 186 when it is clamped.

During or after the clamping of the wall of the initial tube 186 between the mandrel 114 and the contact protrusion 118*e* at the step 184*c*, the translation of the carriage assembly 20 in the direction indicated by the arrow 188 is stopped so that the initial tube 186 is not compressed or otherwise damaged, but is held in place on the mandrel 114 at the step 184*c*. In an exemplary embodiment, at the step 184*c*, the controller 46 causes the motor 52 to stop rotating the pinion 110, and thus to stop the translation of the carriage assembly 20 in the direction indicated by the arrow 188, in response to the protrusion 92*f* of the rack bar 92 engaging the transmission arm retraction limit switch 56. In an exemplary embodiment, such an engagement causes the switch 56 to send one or more signals to the controller 46, informing the controller 46 that the carriage assembly 20 has traveled far enough in the direction 188 so that the initial tube 186 is now held in place on the mandrel 114 at the step 184*c*.

The holding of the initial tube 186 on the mandrel 114 at the step 184*c* is shown in FIG. 17C. As shown in FIG. 17C, at the step 184*c*, the end of the rack bar 92 opposing the transmission arm 88 extends out of the upper housing 14 via the opening 14*a*.

As noted above, before, during, or after the steps 184*b* and 184*c*, an initial carrot of tobacco is formed at the step 184*d*. In an exemplary embodiment, as illustrated in FIGS. 20A-20D with continuing reference to FIGS. 1-19D, to form an initial carrot of tobacco at the step 184*d*, pre-cut tobacco leaves are disposed in the hopper 34 so that the pre-cut tobacco leaves pile up on the ramp 136*a* of the tray 136.

Figure 20A:
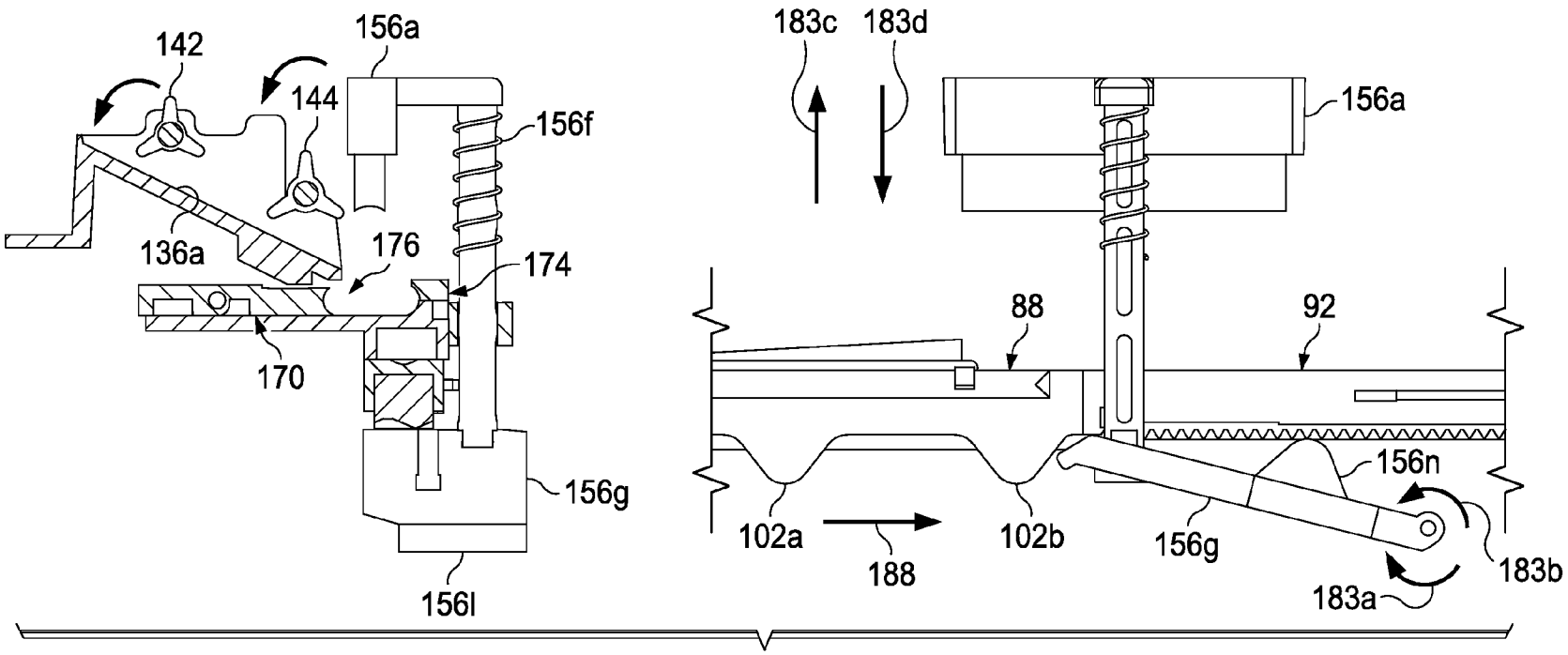
FIG. 20A includes a partial sectional/partial elevational view of a portion of the carrot forming assembly of FIGS. 12A-15C, and another elevational view of components thereof, during yet another step of the method of FIG. 17A, according to an exemplary embodiment.

As shown in FIG. 20A, before the steps 184*b* and 184*c*, and initially during the steps 184*b* and 184*c*, the helical spring 156*f*, which is supported by the internal shoulder 14*ga*, forces the post 156*e*, the arm 156*b*, and the plunger block 156*a* upwards and away from the cavity 176, as indicated by the arrow 183*c* in FIGS. 20A and 15C. As a result, the pivoting arm 156*g* pivots upwards as indicated by the arrow 183*a* in FIGS. 20A and 15C. Since the plunger block 156*a* is positioned away from the cavity 176, pre-cut tobacco leaves may be more easily introduced into the cavity 176. In addition to the plunger block 156*a* being moved away from the cavity 176, the movable wall 170 is retracted away from the stationary wall 174; thus, the size of the cavity 176 is increased, facilitating the receipt of pre-cut tobacco leaves into the cavity 176. The operational position of the movable wall 170 shown in FIG. 20A generally corresponds to the operational position of the movable wall 170 shown in FIG. 14B.

Although not shown in FIG. 20A, the push rod 124 is disposed in the cavity 176, in a position illustrated in at least FIGS. 14A-14C, 15A, and 15C.

In an exemplary embodiment, during the step 184*d*, when the plunger block 156*a* is positioned away from the cavity 176, and the movable wall 170 is retracted away from the stationary wall 174, the controller 46 causes the motor 58 to drive the shaft 140, as well as the gear 150. The driving of the gear 150 drives the gear 148, which, in turn, drives the gear 146, thereby driving the shaft 138. The shafts 138 and 140 rotate in place, causing the star wheels 142 and 144 to rotate in place, in a counterclockwise direction as viewed in FIG. 20A and indicated by arrows 198*a* and 198*b*. In an exemplary embodiment, the star wheels 142 and 144 rotate in a clockwise direction as viewed in FIG. 20A. In an exemplary embodiment, the star wheels 142 rotate in a direction that is opposite the direction of rotation of the star wheels 144. As a result of the respective rotations of the star wheels 142 and 144, pre-cut tobacco leaves are pushed down the ramp 136*a* and into the cavity 176. The angled surface defined by the ramp 136*a* ensures that the pre-cut tobacco leaves easily slide and drop into the cavity 176.

In several exemplary embodiments, the number of revolutions of the star wheels 142 and 144 is dictated by the tobacco compaction level switch 38. In an exemplary embodiment, the switch 38 includes three settings corresponding to one, two, and three revolutions, respectively, of the star wheels 142 and 144. The setting of the switch 38 informs the controller 46 as to how many revolutions the star wheels 142 and 144 are to make. Thus, the switch 38 permits a user to control the amount, and compaction level, of pre-cut tobacco leaves to be inserted in the initial tube 186.

In several exemplary embodiments, during the step 184*d*, pre-cut tobacco leaves are pushed into the cavity 176 as the carriage assembly 20 translates from the position shown in FIG. 17B to the position shown in FIG. 17C, as indicated by the arrow 188.

During the step 184*d*, as the carriage assembly 20 continues to translate in the direction indicated by the arrow 188, the cam 102*b* engages the chamfer 156*l* of the pivoting arm 156*g*, forcing the pivoting arm 156*g* to pivot downward in a counterclockwise direction, as viewed in FIG. 20A and as indicated by the arrow 183*b*. In response to this pivoting, the post 156*e*, the arm 156*b*, and the plunger block 156*a* move downwards as indicated by the arrow 183*d* in FIGS. 20A and 15C; as a result, the helical spring 156*f* is compressed downward in the direction indicated by the arrow 183*d*. The downward movement of the plunger block 156*a* initially compacts the pre-cut tobacco leaves in the cavity 176. During this initial compaction, the helical spring 156*f* accommodates the dimensional variations of the pre-cut tobacco leaves in the cavity 176. During this initial compaction, in an exemplary embodiment, the star wheels 142 and 144 do not rotate.

The continued translation of the carriage assembly 20 causes the cam 102*b* to be dragged over and past the chamfer 156*l*, and drop into the slot 156*m* and translate therein. Since the cam 102*b* is no longer engaging the chamfer 156*l*, the helical spring 156*f* expands, pushing the post 156*e*, the arm 156*b*, and the plunger block 156*a* upwards as indicated by the arrow 183*c*. At this point in time, in an exemplary embodiment, the star wheels 142 and 144 are rotated in accordance with the foregoing, in order to push additional pre-cut tobacco leaves down the ramp 136*a* and into the cavity 176.

Figure 20B:
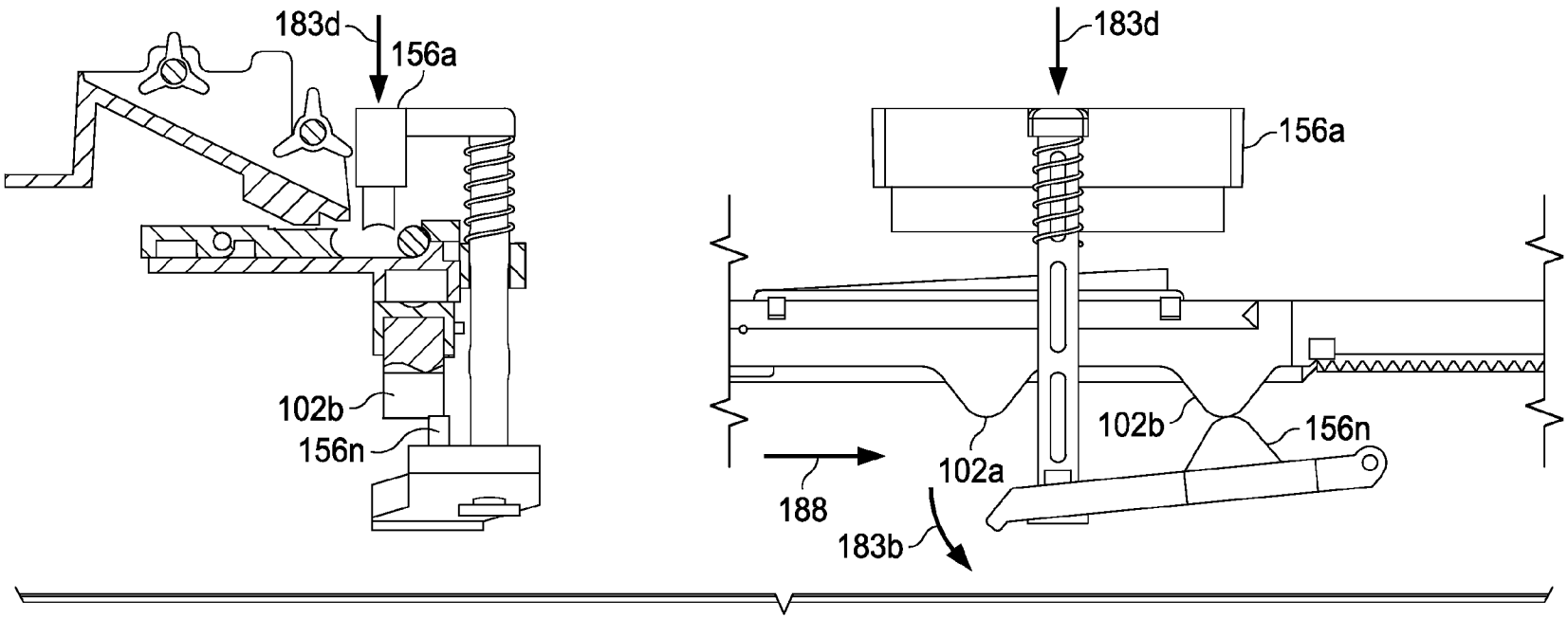
FIGS. 20B-20D are views similar to that of FIG. 20A but depicting the portion of FIG. 20A in different operational modes, according to an exemplary embodiment.

As shown in FIG. 20B, the continued translation of the carriage assembly 20 in the direction indicated by the arrow 188 causes the cam 102*b* to engage the cam 156*n* of the pivoting arm 156*g*, forcing the pivoting arm 156*g* to pivot downward in a counterclockwise direction, as viewed in FIG. 20B and as indicated by the arrow 183*b*. In response to this pivoting, the post 156*e*, the arm 156*b*, and the plunger block 156*a* move downwards as indicated by the arrow 183*d* in FIGS. 20B and 15C; as a result, the helical spring 156*f* is compressed downward in the direction indicated by the arrow 183*d*. The downward movement of the plunger block 156*a* further compacts the pre-cut tobacco leaves in the cavity 176. During this further compaction, the helical spring 156*f* accommodates the dimensional variations of the pre-cut tobacco leaves in the cavity 176. During this further compaction, in an exemplary embodiment, the star wheels 142 and 144 do not rotate.

Figure 20C:
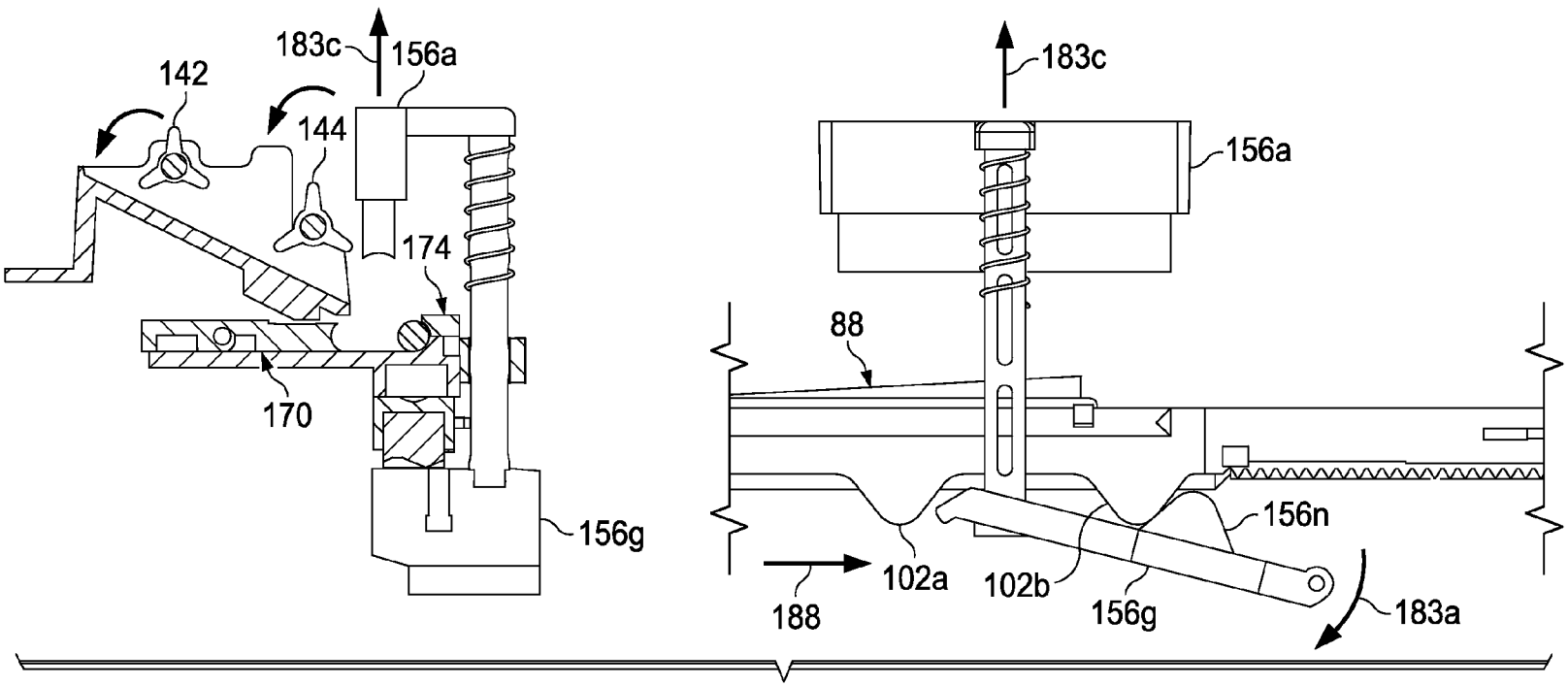

As shown in FIG. 20C, during the step 184*d*, the continued translation of the carriage assembly 20 causes the cam 102*b* to be dragged over and past the cam 156*n*. Since the cam 102*b* is no longer engaging the cam 156*n*, the helical spring 156*f* expands, pushing the post 156*e*, the arm 156*b*, and the plunger block 156*a* upwards as indicated by the arrow 183*c*. At this point in time, in an exemplary embodiment, the star wheels 142 and 144 are rotated in accordance with the foregoing, in order to push additional pre-cut tobacco leaves down the ramp 136*a* and into the cavity 176.

During the engagement of the cam 102*b* with the cam 156*n*, the cam 102*a* passes over, but does not engage, the chamfer 156*l*, and then drops into the slot 156*m* for translation therein.

Figure 20D:
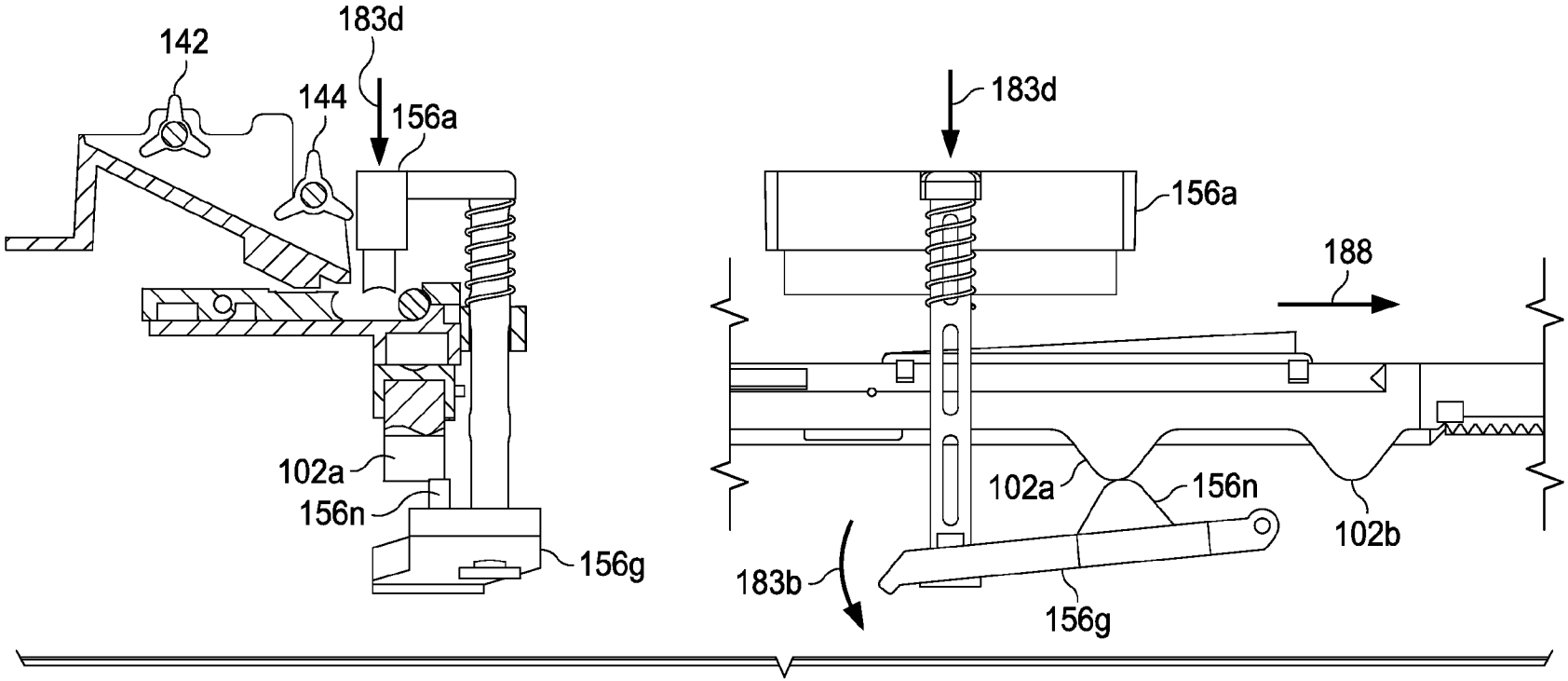

As shown in FIG. 20D, the continued translation of the carriage assembly 20 in the direction indicated by the arrow 188 causes the cam 102*a* to engage the cam 156*n* of the pivoting arm 156*g*, forcing the pivoting arm 156*g* to pivot downward in a counterclockwise direction, as viewed in FIG. 20D and as indicated by the arrow 183*b*. In response to this pivoting, the post 156*e*, the arm 156*b*, and the plunger block 156*a* move downwards as indicated by the arrow 183*d* in FIGS. 20B and 15C; as a result, the helical spring 156*f* is compressed downward in the direction indicated by the arrow 183*d*. The downward movement of the plunger block 156*a* further compacts the pre-cut tobacco leaves in the cavity 176. During this further compaction, the helical spring 156*f* accommodates the dimensional variations of the pre-cut tobacco leaves in the cavity 176. During this further compaction, in an exemplary embodiment, the star wheels 142 and 144 do not rotate.

In several exemplary embodiments, in accordance with the foregoing, the rotation of the star wheels 142 and 144, and thus the introduction of pre-cut tobacco leaves in the cavity 176, is synchronized with the compaction of the pre-cut tobacco leaves in the cavity 176 by the plunger block 156*a*. That is, the carrot-forming assembly 30 operates so that pre-cut tobacco leaves are introduced into the cavity 176, and then they are compacted in the cavity 176, and this synchronization is repeated.

In an exemplary embodiment, during the step 184*d*, after the cam 102*a* has moved past the cam 156*n*, the carriage assembly 20 continues to translate in the direction indicated by the arrow 188, until the protrusion 92*f* engages the transmission arm retraction limit switch 56, which sends one or more signals to the controller 46 indicating that the carriage 90 has indeed traveled far enough towards the upper housing 14. As a result, the controller 46 stops driving the motor 52 and the carriage assembly 20 stops moving.

As noted above, during the introduction and compaction of pre-cut tobacco leaves in the cavity 176, the push rod 124 is disposed in the cavity 176, in a position illustrated in at least FIGS. 14A-14C, 15A, and 15C.

During the step 184*d*, after the cam 102*a* has moved past the cam 156*n*, and before, during, or after the protrusion 92*f* has engaged the switch 56 to cause the carriage assembly 20 to stop moving, the movable wall 170 moves from the retracted operational position shown in FIG. 14B to the extended operational position shown in FIG. 14C. Thus, the cavity 176 is relatively small and generally cylindrically shaped, with the pre-cut tobacco leaves therein further compressed. To place the movable wall 170 in its extended position, the motor 64 causes the circular disk 160 to rotate counterclockwise, as viewed in FIGS. 14B and 14C. The pin 162 slides within the slot 164*a* of the link 164, causing the link 164 to swing towards the switch 66 and the shaft 166 to rotate which, in turn, causes the movable wall 170 to slide against the horizontal support 172 and translate to the right, as viewed in FIG. 14C, and towards the stationary wall 174, thereby decreasing the size of the cavity 176 until it is generally cylindrically shaped, thereby further compacting the pre-cut tobacco leaves, and thereby forming the tobacco carrot at the step 184*d*. The movable wall 170 continues to so translate until the link 164 engages the switch movable wall extension limit switch 66. As a result of this engagement, one or more signals are sent to the controller 46 indicating that the movable wall 170 has reached its extension limit and the motor 64 is no longer needed to operate to effect the extension. The extension direction of the movable wall 170 is indicated by arrow 178*b* in FIGS. 14A and 14C. The rotation direction of the circular disk 160 to effect the extension is indicated by the arrow 180*b* in FIGS. 14A and 14C.

At the step 184*d*, the tobacco carrot is formed in response to the movable wall 170 moving to its extended position as shown in FIG. 14C. In several exemplary embodiments, the tobacco carrot is composed of compacted pre-cut tobacco leaves compacted into a generally cylindrical shape.

After forming the tobacco carrot at the step 184*d*, the push rod 124 and the tobacco carrot formed at the step 184*d* are inserted into the initial tube 186 at the step 184*e*.

Figure 21A:
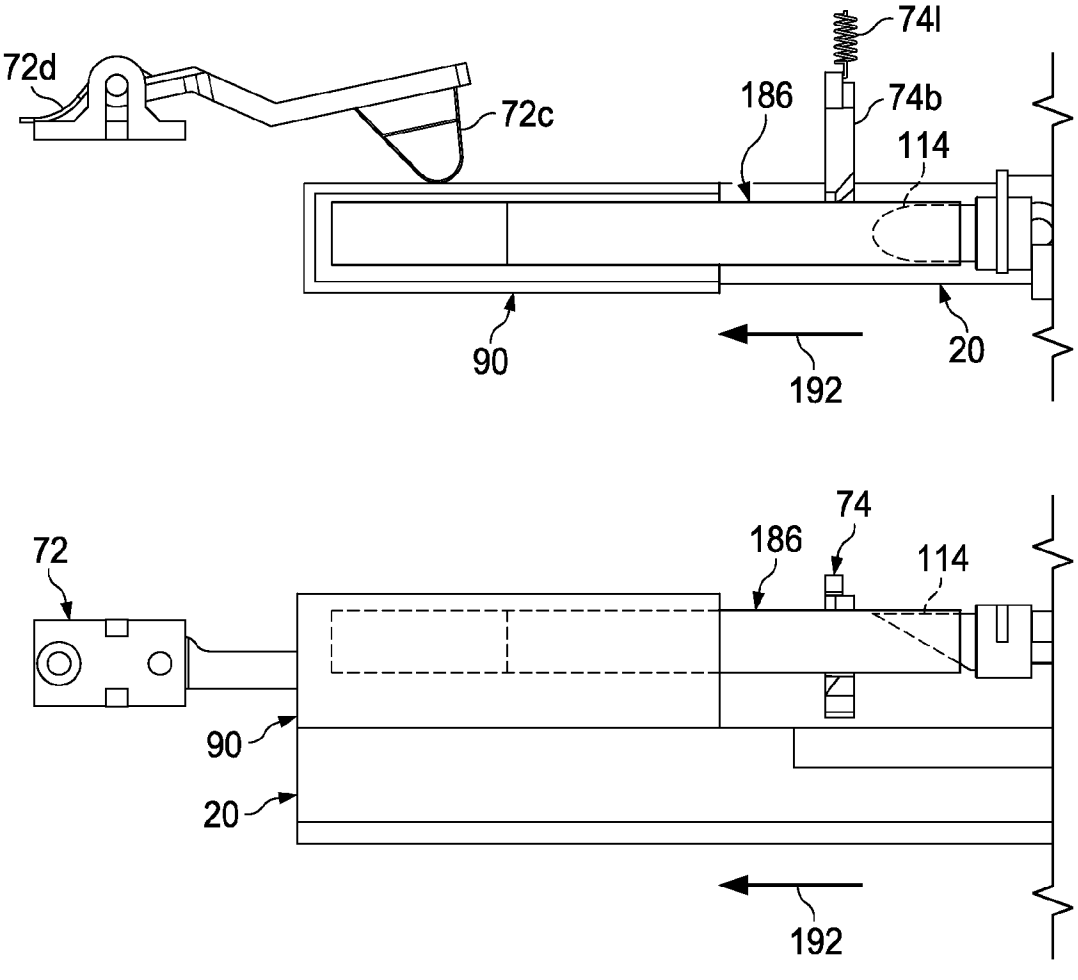
FIG. 21A includes a top plan view of a portion of the cigarette manufacturing machine of FIGS. 1-16B, and an elevational view of that same portion, during still yet another step of the method of FIG. 17A, according to an exemplary embodiment.
Figure 21B:
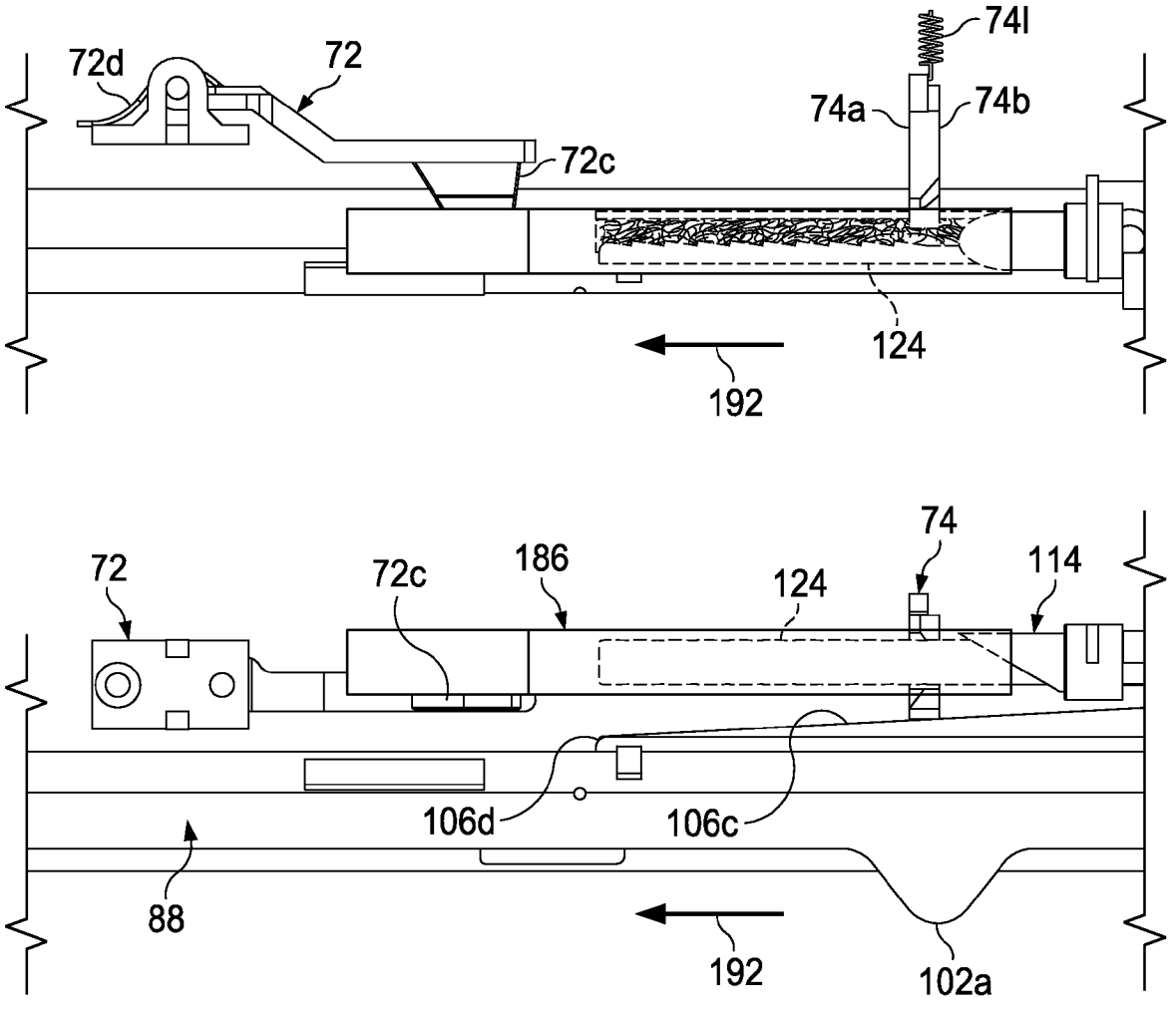
FIGS. 21B and 21C are views similar to that of FIG. 21A but depicting the portion of FIG. 21A in different operational modes during the step of FIG. 21A, according to an exemplary embodiment.
Figure 21C:
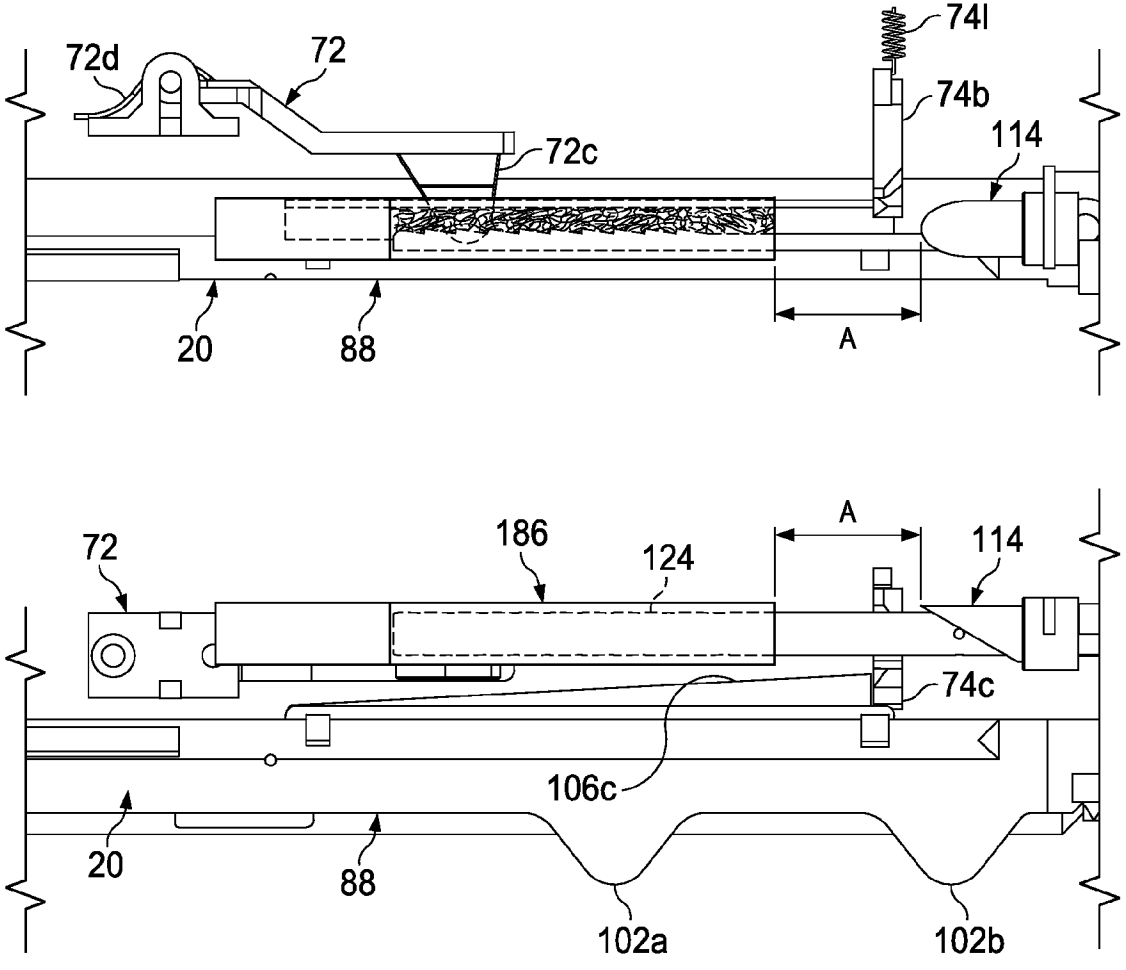

In an exemplary embodiment, as illustrated in FIGS. 21A-21C with continuing reference to FIGS. 1-20D, to insert the push rod 124 and the tobacco carrot at the step 184*e*, the carriage assembly 20 is retracted out of the upper housing 14. To so retract the carriage assembly 20, the motor 52 drives the pinion 110 so that the pinion 110 rotates in place; the pinion 110 rotates counterclockwise, as viewed in FIG. 9A. Due to the engagement between the pinion 110 and the rack teeth 92*d* of the carriage assembly 20, the counterclockwise rotation of the pinion 110 causes the carriage assembly 20 to translate so that the carriage 90 moves towards the end post 18, as indicated by arrow 192 in FIGS. 21A and 17D. The clamping member 118 (not shown in FIGS. 21A-21C) of the tube holding assembly 26 continues to clamp the initial tube 186, resulting in the carriage 90 moving relative to the stationary initial tube 186. Eventually, the carriage 90 no longer supports the initial tube 186; instead, the cigarette end support 72 of the cigarette stopper assembly 24 supports the filter end portion of the initial tube 186, as shown in FIG. 21B. More particularly, since the tab 72*c* no longer engages the carriage 90, the biasing force of the torsion spring 72*d* causes the tab 72*c* to pivot, about the pin connection 72*b* and in the direction indicated by the arrow 78*b* in FIG. 7C, so that the tab 72*c* extends through the horizontal slot 16*j* of the horizontal support 16, and thus supports the filter end portion of the initial tube 186.

At the step 184*e*, during the movement of the carriage assembly 20, the carrot injection assembly 28 is placed in the operational mode shown in FIG. 11D, in which the box 128 engages the top surface 92*a* so that the protrusion 92*e* extends upward within the internal region 128*e* and between the side wall 128*a* and the inside arm 130*c*. As a result, the carrot injection assembly 28 is operably coupled to the carriage assembly 20. This placement of the carrot injection assembly 28 will be described in further detail below.

At the step 184*e*, as a result of placing the carrot injection assembly 28 in the operational mode shown in FIG. 11D, the carrot injection assembly 28 translates along with the carriage assembly 20 in the direction indicated by the arrow 192. Continued movement of the carriage assembly 20 causes the push rod 124, as well as the tobacco carrot formed at the step 184*d* and carried by the push rod 124, to extend out of the mandrel 114 and be inserted into the initial tube 186, as shown in FIG. 21B.

During the injection of the push rod 124 and the tobacco carrot formed at the step 184*d*, due to the movement of the carriage assembly 20, the protrusion 107*a* engages the end of the end portion 116*a*, causing the sliding member 116 to slide in the direction indicated by the arrow 192. As a result, the cam surface 116*f* no longer engages the contact surface 118*g*; thus, the torsion spring 118*d* causes the clamping member 118 to rotate, about the pin connection 118*a* and in the direction indicated by the arrow 122*b* in FIGS. 10C and 10D. As a result, the contact protrusion 118*e* of the clamping member 118 no longer clamps the wall of the initial tube 186 and thus the clamping member 118 is released from the initial tube 186.

Before, during, or after the release of the clamping member 118 from the initial tube 186, the insertion force of the push rod 124 pushes the initial tube 186 off of the mandrel 114 so that the initial tube 187 slides backwards against the tab 72*c*, while still being supported by the tab 72*c* and the push rod 124. The carriage assembly 20 stops moving in the direction indicated by the arrow 192 when the carriage 90 is below the tube magazine assembly 22. As a result, the push rod 124 also stops moving. In several exemplary embodiments, the controller 46 detects that the carriage 90 has traveled, far enough towards the end post 18, in response to the protrusion 92*f* of the rack bar 92 engaging the transmission arm extension limit switch 54, which sends one or more signals to the controller 46 indicating that the carriage 90 has indeed traveled far enough towards the end post 18; as a result, the controller 46 stops the motor 52 from driving the pinion 110, thereby stopping movement of the carriage assembly 20, thereby stopping movement of the carriage 90 and the push rod 124.

During or after the insertion of the push rod 124 at the step 184*e*, the movable wall 170 moves from the extended operational position shown in FIG. 14C to the retracted operational position shown in FIG. 14B. Thus, the cavity 176 is relatively large and adapted to receive additional pre-cut tobacco leaves from the ramp 136*a*. To place the movable wall 170 in its retracted position, the motor 64 causes the circular disk 160 to rotate clockwise, as viewed in FIG. 14B. The pin 162 slides within the slot 164*a* of the link 164, causing the link 164 to swing towards the switch 68 and the shaft 166 to rotate which, in turn, causes the movable wall 170 to slide against the horizontal support 172 and translate to the left, as viewed in FIG. 14B, and away from the stationary wall 174, thereby increasing the size of the cavity 176. The movable wall 170 continues to so translate until the link 164 engages the switch movable wall retraction limit switch 68. As a result of this engagement, one or more signals are sent to the controller 46 indicating that the movable wall 170 has reached its retraction limit and the motor 64 is no longer needed to operate to effect the extension. The retraction direction of the movable wall 170 is indicated by the arrow 178*a* in FIGS. 14A and 14B. The rotation direction of the circular disk 160 to effect the retraction is indicated by the arrow 180*a* in FIGS. 14A and 14B. In an exemplary embodiment, after the tobacco carrot is formed at the step 184*d* but before the insertion at the step 184*e*, the movable wall 170 is slightly retracted away from the stationary wall 174 in order to ensure that the push rod 124 can freely travel out of the cavity 176; in an exemplary embodiment, the movable wall 170 is so retracted by a distance equal to, or less than, about 1 mm; in an exemplary embodiment, the movable wall 170 is so retracted by 0.5 mm; in an exemplary embodiment, the movable wall 170 is so retracted by 0.3 mm.

As shown in FIG. 21C, as a result of the full extension of the push rod 124 into the initial tube 186 at the step 184*e*, an offset distance A is defined between the end of the initial tube 186 and the tip 114*ba* of the mandrel 114 when the push rod 124 has stopped moving. The provision of the offset distance A allows for the automatic cleaning of any excessive pre-cut tobacco leaves off of the mandrel 114. In several exemplary embodiments, gravity causes excessive pre-cut tobacco leaves in and on the mandrel 114 to fall away from the mandrel 114. In several exemplary embodiments, the removal of the push rod 124 from the initial tube 186 at the step 184*g*, which removal will be discussed in further detail below, and the subsequent retraction of the push rod 124 into the mandrel 114, automatically cleans off excessive pre-cut tobacco leaves; the offset distance A provides space for this cleaning. In an exemplary embodiment, the offset distance A ranges from about 15 mm to about 20 mm. In an exemplary embodiment, the offset distance A is greater than 0 mm but less than 50 mm. In an exemplary embodiment, the offset distance A is greater than or equal to about 5 mm. In an exemplary embodiment, the offset distance A is greater than or equal to about 10 mm. In an exemplary embodiment, the offset distance A is greater than or equal to about 15 mm. In an exemplary embodiment, the offset distance A is greater than or equal to about 20 mm.

In an exemplary embodiment, as shown in FIG. 21A, during the movement of the carriage assembly 20 in the direction indicated by the arrow 192 and the insertion of the push rod 124 into the initial tube 186 at the step 184*e*, the helical spring 74*l* urges the C-shaped bracket 74*a* of the cigarette horizontal travel stopper 74 to rotate, about the pivot connection 74*d*, in a counterclockwise direction as viewed in FIG. 7B and indicated by the arrow 76*a*. As a result, the upper protrusion 74*b* does not interfere with the movement of the initial tube 186, in the right-to-left direction as viewed in FIGS. 21A and 21B and indicated by the arrow 192. The spring 74*l* maintains this position of the bracket 74*a*.

Additionally, in an exemplary embodiment, as shown in FIG. 21B, during the movement of the carriage assembly 20 in the direction indicated by the arrow 192 and the insertion of the push rod 124 into the initial tube 186 at the step 184*e*, the lower protrusion 74*c* of the bracket 74*a* engages or clears, and then passes over, the end surface 106*d* of the cam 106. The inclined surface 106*c* engages the lower protrusion 74*c*; as the movement of the carriage assembly 20 in the direction indicated by the arrow 192 continues, the movement of the inclined surface 106*c* in that same direction pushes up on the lower protrusion 74*c*, further causing the C-shaped bracket 74*a* of the cigarette horizontal travel stopper 74 to rotate, about the pivot connection 74*d*, in a counterclockwise direction as viewed in FIG. 7B and indicated by the arrow 76*a*. This further ensures that the upper protrusion 74*b* does not interfere with the movement of the initial tube 186, in the right-to-left direction as viewed in FIG. 21B and indicated by the arrow 192. The engagement of the inclined surface 106*c* continues until the inclined surface 106*c* moves past the cigarette horizontal travel stopper 74, as shown in FIG. 21C. At this point, the spring 74*l* continues to urge the upper protrusion 74*b* out of the way, but the efficacy of this urging is not as critical because the cigarette horizontal travel stopper 74 is positioned within the offset distance A, between the initial tube 186 and the mandrel 114. That is, the initial tube 186 has moved past the cigarette horizontal travel stopper 74.

In an exemplary embodiment, as noted above, the step 184*f* is executed during the step 184*e*. In an exemplary embodiment, to dispose the empty cigarette tube 190 in the carriage 90 of the carriage assembly 20 at the step 184*f*, as the carriage 90 moves in the direction indicated by the arrow 192, the angularly-extending surface 90*j* of the tab 90*i* of the carriage 90 engages the angularly-extending surface 82*f* of the protrusion 82*e* of the bottom door 82, overcoming the biasing force of the torsion spring 82*b* so that the bottom door 82 pivots about the hinged connected 82*a* and in the direction indicated by the arrow 86*b* in FIGS. 8C, 8D, and 18C. The protrusion 82*e* may be pushed into the notch 16*i*. As a result, the tube 190 falls through the bottom opening 80*b* of the quadrilateral structure 80, through the top opening 90*e* of the carriage 90, and into the channel 90*d* of the carriage 90. Thus, the tube 190 is disposed in the carriage 90 at the step 184*f*.

The stopped position of the carriage 90 after the step 184*e*, the offset distance A after the step 184*e*, and the disposal of the tube 190 after the step 184*f*, are shown in FIG. 17E.

As noted above, after the steps 184*e* and 184*f*, at step 184*g* the push rod 124 is removed from the carrot-filled initial tube 186 while the position of the carrot-filled initial tube 186 is generally maintained. The removing step 184*g* is shown in FIGS. 17F and 22A-22C.

Figure 22A:
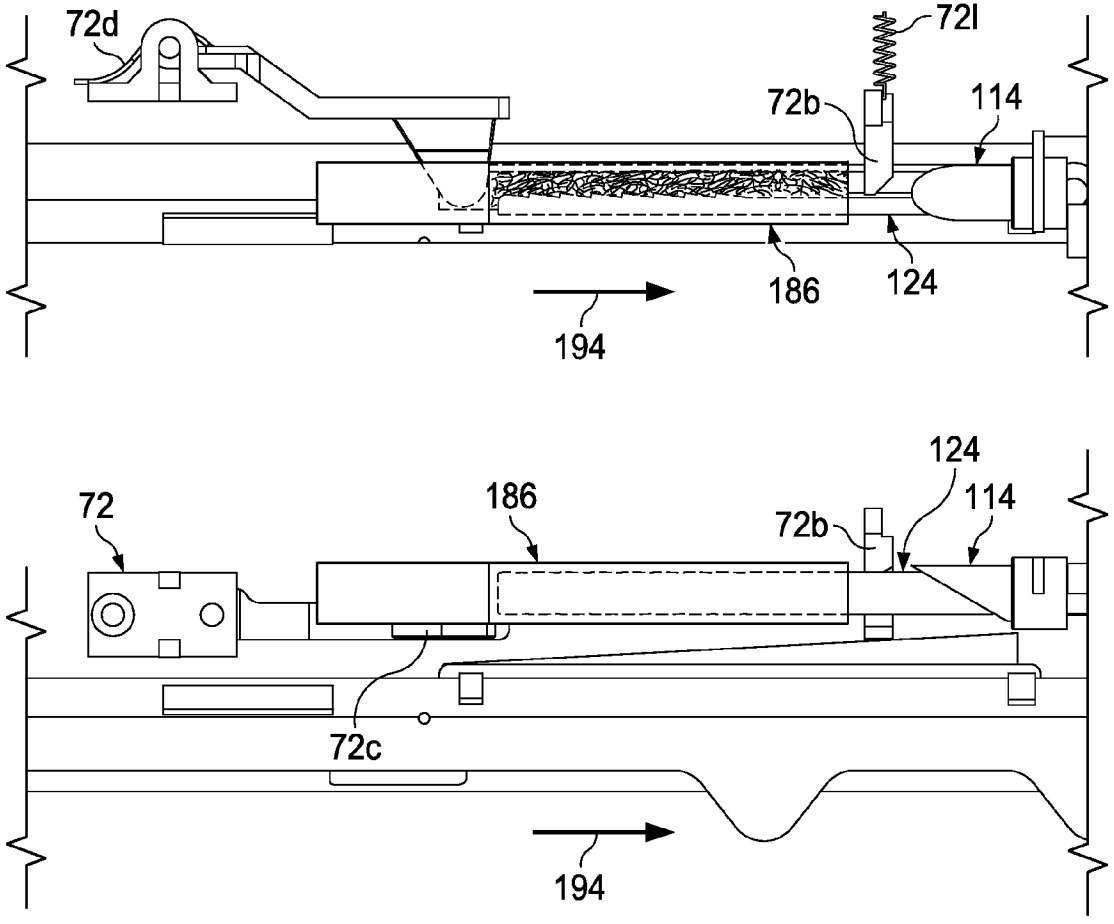
FIG. 22A includes a top plan view of the portion of FIGS. 21A-21C, and an elevational view of that same portion, during still yet another step of the method of FIG. 17A, according to an exemplary embodiment.
Figure 22B:
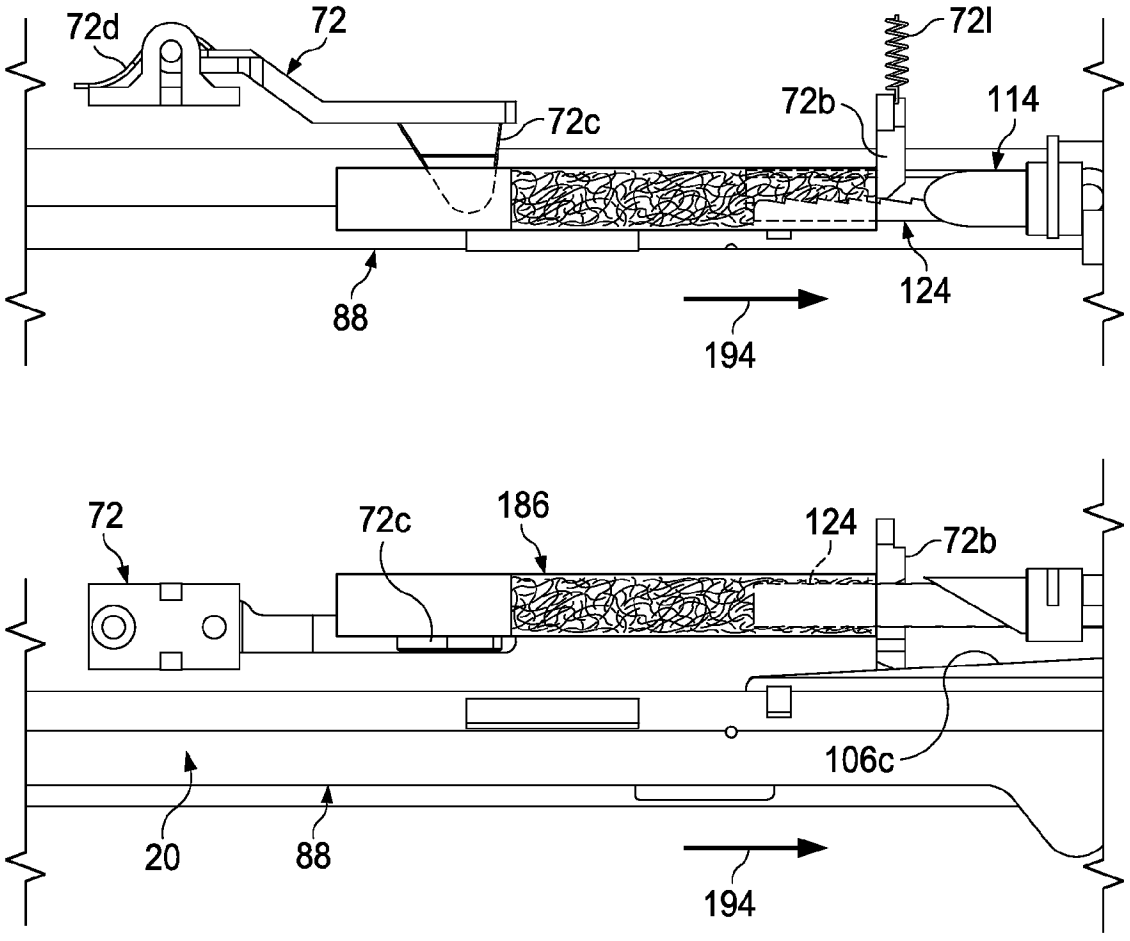
FIGS. 22B and 22C are views similar to that of FIG. 22A but depicting the portion of FIG. 22A in different operational modes during the step of FIG. 22A, according to an exemplary embodiment.
Figure 22C:
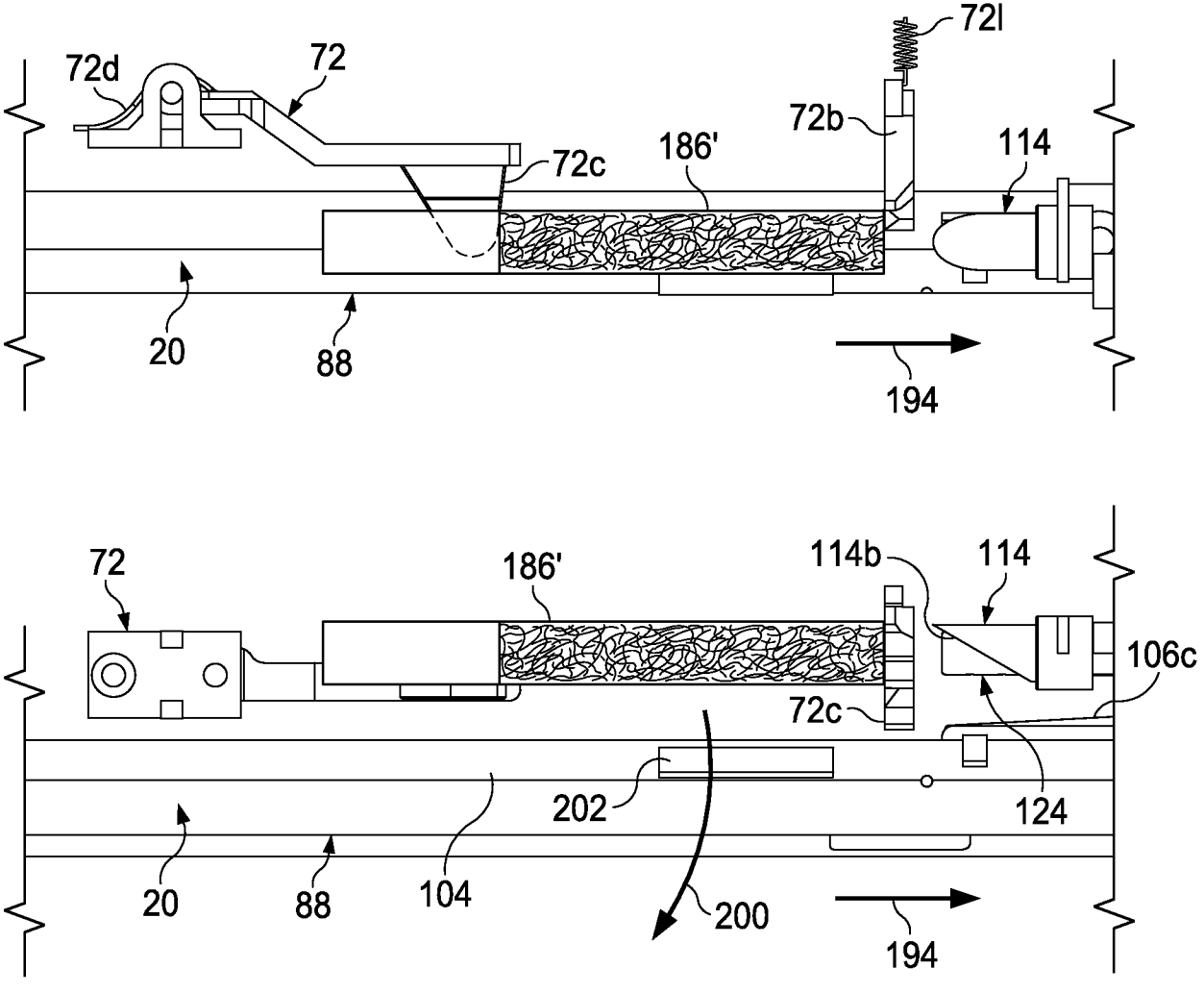

In an exemplary embodiment, as illustrated in FIGS. 22A-22C with continuing reference to FIGS. 1-21C, to remove the push rod 124 from the carrot-filled initial tube 186 while generally maintaining the position of the carrot-filled initial tube 186 at the step 184*g*, the carriage assembly 20 again travels from left to right, as viewed in FIGS. 22A-22C and indicated by the arrow 194. In response, the notch 106*h* of the cam 106 approaches and then receives the lower protrusion 74*c* of the C-shaped bracket 74*a* of the cigarette horizontal travel stopper 74. The angularly-extending surface 106*j* defined by the notch 106*h* then engages the angularly-extending triangular surface 74*j* of the bracket 74*a*, overcoming the biasing force provided by the spring 74*l* and causing the bracket 74*a* to begin to rotate, about the pin connection 72*d*, in a clockwise direction as viewed in FIG. 7B and indicated by the arrow 76*b*. Continued movement of the carriage assembly 20 then causes the angularly-extending surface 106*j* to be dragged along the surface 74*j* and/or the surface 74*g*, until the back surface 106*g* of the cam 106 engages the surfaces 74*j* and/or 74*g* of the bracket 74*a*, causing the bracket 74*a* to further rotate, about the pin connection 72*d*, in a clockwise direction as viewed in FIG. 7B and indicated by the arrow 76*b*. The engagement of the back surface 106*g* of the cam 106 with the surfaces 74*j* and/or 74*g* of the bracket 74*a* is indicated in FIG. 22A because the lower protrusion 74*c* is hidden behind the cam 106 in FIG. 22A. This rotation of the bracket 74*a* in the direction indicated by the arrow 76*b* causes the upper protrusion 74*b* to be in the line of travel of the initial tube 186 as it moves towards the mandrel 114, but not in the line of travel of the push rod 124. During the movement of the carriage assembly 20 in the direction indicated by the arrow 194 in FIG. 22A, the carrot-filled initial tube 186 continues to be supported by the tab 72*c* of the cigarette end support 72 and the push rod 124. The torsion spring 72*d* urges the tab 72*c* to extend through the horizontal slot 16*j* of the horizontal support 16.

As shown in FIG. 22B, the movement of the carriage assembly 20 in the direction indicated by the arrow 194 causes the push rod 124 to pull the carrot-filled tube 186 slightly until the end of the tube 186 contacts the upper protrusion 74*b* of the cigarette horizontal travel stopper 74, thereby stopping the horizontal travel of the tube 186. Thus, at the step 184*g*, continued movement of the carriage assembly 20 causes the push rod 124 to be removed from the carrot-filled initial tube 186 while the position of the tube 186 is generally maintained.

As noted above in connection with FIGS. 17F and 17G, after the step 184*g*, the carrot-filled initial tube 186, which is now the manufactured cigarette 186', is permitted at the step 184*h* to fall out of the way in response to removing the push rod 124 at the step 184*g*.

In an exemplary embodiment, as illustrated in FIG. 22C with continuing reference to FIGS. 1-22B, to permit the cigarette 186' to fall out of the way at the step 184*h*, the machine 10 is configured so that gravity causes the cigarette 186' to fall downwards. In an exemplary embodiment, the end portion 186*a'* may initially fall downward because the filter end portion of the cigarette 186' may still be supported by the tab 72*c*; however, the filter end portion of the cigarette 186' quickly slides off the tab 72*c* so that the entire cigarette 186' falls out of the way of the carriage assembly 20, just in time for the carriage assembly 20 to be used to load the tube 190 on the mandrel 114 at the step 184*i*. The falling of the cigarette 186' is illustrated in FIG. 17G, and indicated by arrow 200 in FIG. 22C.

In several exemplary embodiments, the location of the bevel 114*b* on the underside of the mandrel 114 facilitates the automatic falling of the cigarette 186' at the step 184*h*. As a result of the bevel 114*b*, there is less material of the mandrel 114 at, or near, the three-dimensional space where the end portion 186*a'* of the cigarette 186' is configured to fall in the direction indicated by the arrow 200. This reduces the risk that the cigarette 186' will get caught on the mandrel 114 at the step 184*h*. In several exemplary embodiments, the filter end portion of the cigarette 186' may fall downwards before the end portion 186*a'* falls downward, in a direction opposite that indicated by the arrow 200 in FIG. 22C; in such exemplary embodiments, the presence of the bevel 114*b* ensures that the cigarette 186' does not contact the mandrel 114. In several exemplary embodiments, the cigarette 186' may not fall in the direction indicated by the arrow 200 or in a direction opposite thereto; instead, the cigarette 186' falls straight down.

In several exemplary embodiments, the angular surface 104 facilitates the automatic falling of the cigarette 186' at the step 184*h*. During its fall, the cigarette 186' may contact the angular surface 104, which may deflect the cigarette 186' away from the transmission arm 88. In several exemplary embodiments, a pad 202 connected to the angular surface 104 also facilitates the automatic falling of the cigarette 186' at the step 184*h*. The pad 202 may be composed of a material having relatively low friction. During its fall, the cigarette 186' may contact the pad 202, which may deflect the cigarette 186' away from the transmission arm 88.

As noted above, during and after the steps 184*g* and 184*h*, the tube 190 is loaded onto the mandrel 114 at the step 184*i*. The step 184*i* is identical to the step 184*b*, except that the tube 190 is loaded onto the mandrel 114 rather than the initial tube 186. Therefore, the step 184*i* will not be described in further detail. As noted above, after the step 184*i*, at the step 184*j* the tube 190 is held on the mandrel 114 using the tube holding assembly 26. The step 184*j* is identical to the step 184*c*, except that the tube 190 is held on the mandrel 114 rather than the initial tube 186. Therefore, the step 184*j* will not be described in further detail. As noted above, during the steps 184*i* and 184*j*, another tobacco carrot is formed at step 184*k*. The step 184*k* is identical to the step 184*d*, except that another tobacco carrot is formed rather the initial tobacco carrot. After the steps 184*i*, 184*j*, and 184*k*, the step 184*e* is repeated, with the push rod 124 and the tobacco carrot formed at the step 184*k* being inserted into the tube 190.

Figure 23A:
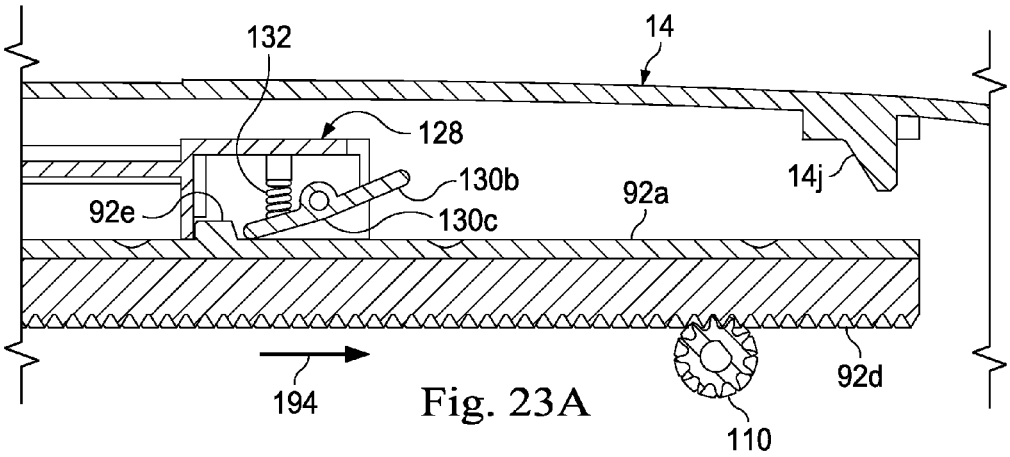
FIGS. 23A-23C are sectional views of a portion of the cigarette manufacturing machine of FIGS. 1-16B during the step of FIGS. 22A-22C, according to an exemplary embodiment.
Figure 23B:
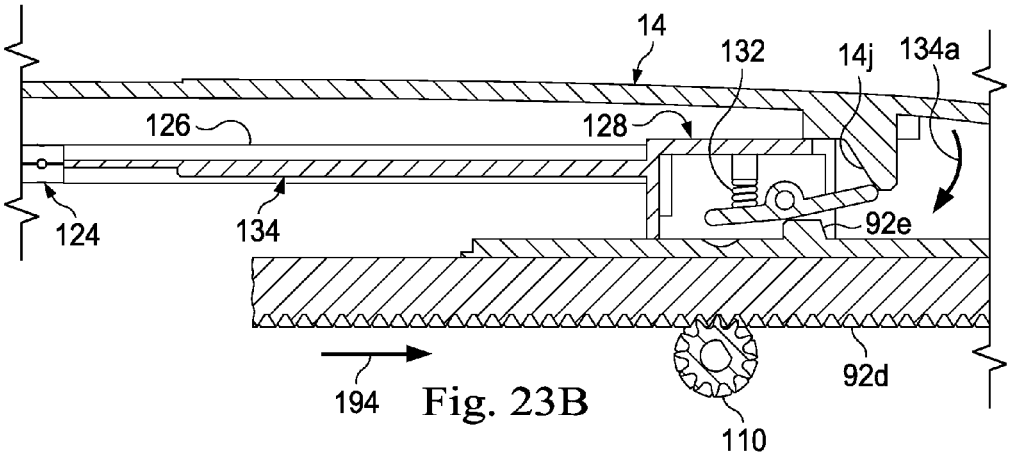
Figure 23C:
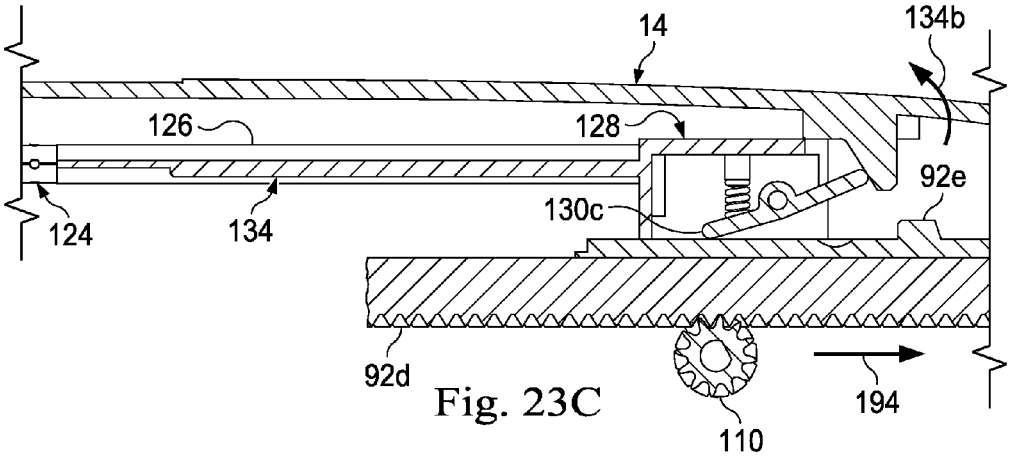

In an exemplary embodiment, as illustrated in FIGS. 23A-23C with continuing reference to FIGS. 1-22C, during the step 184*g*, after the push rod 124 has been retracted, via the mandrel 114, back into the cavity 176, movement of the push rod 124 in the direction indicated by the arrow 194 is stopped so that the push rod 124 remains in the cavity 176. However, the carriage assembly 20, including the rack bar 92, continues to move, relative to the carrot injection assembly 28 and thus the push rod 124, to execute the steps 184*i*, 184*j*, and 184*k*. To this end, the operational mode of the carrot injection assembly 28 is changed from the operational mode of the carrot injection assembly 28 shown in FIG. 11D, so that the carrot injection assembly 28 is operably decoupled from the carriage assembly 20. More particularly, as shown in FIG. 23A, the carrot injection assembly 28 is operably coupled to the carriage assembly 20, with the box 128 engaging the top surface 92*a* so that the protrusion 92*e* extends upward within the internal region 128*e* and between the side wall 128*a* and the inside arm 130*c*. As a result, the carrot injection assembly 28 moves with the carriage assembly 20, in either of the directions indicated by the arrows 192 and 194.

As shown in FIG. 23A, as the carriage assembly 20, including the rack bar 92, moves in the direction indicated by the arrow 194, the protrusion 92*e* engages the inside arm 130*c* of the paddle 130, which is biased downward against the top surface 92*a* of the rack bar 92. As a result, the protrusion 92*e* pushes the inside arm 130*c*, and thus the entire carrot injection assembly 28, in the direction indicated by the arrow 194.

As shown in FIG. 23B, to stop the movement of the carrot injection assembly 28 so that the push rod 124 is positioned in the cavity 176 and remains there while the carriage assembly 20 continues to move, the outside arm 130*b* engages a curved inside surface 14*j* of the upper housing 14. As a result of this engagement and the continuous movement of the rack bar 92, the paddle 130 rotates, about the pin connection 130*a* and in the direction indicated by the arrow 134*a*. As a result, the inside arm 130*c* of the paddle 130 rotates, overcoming the downwardly-directed biasing force of the spring 132 and riding up over the protrusion 92*e*. As a result, the protrusion 92*e* passes underneath the paddle 130 and the carrot injection assembly 28 is operably decoupled from the carriage assembly 20.

As shown in FIG. 23C, the rack bar 92 continues to move in the direction indicated by the arrow 194 to complete the steps 184*i*, 184*j*, and 184*k*, while the push rod 124 remains generally stationary in the cavity 176; in several exemplary embodiments, the push rod 124 may translate slightly to the left, as viewed in FIG. 23C.

Figure 24A:
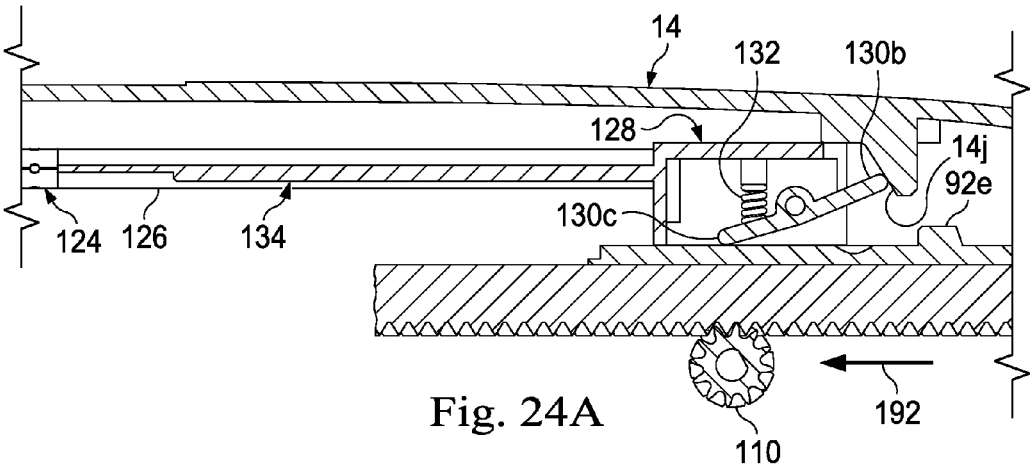
FIGS. 24A-24C are sectional views of the portion of FIGS. 23A-23C during the step of FIGS. 21A-21C, according to an exemplary embodiment.
Figure 24B:
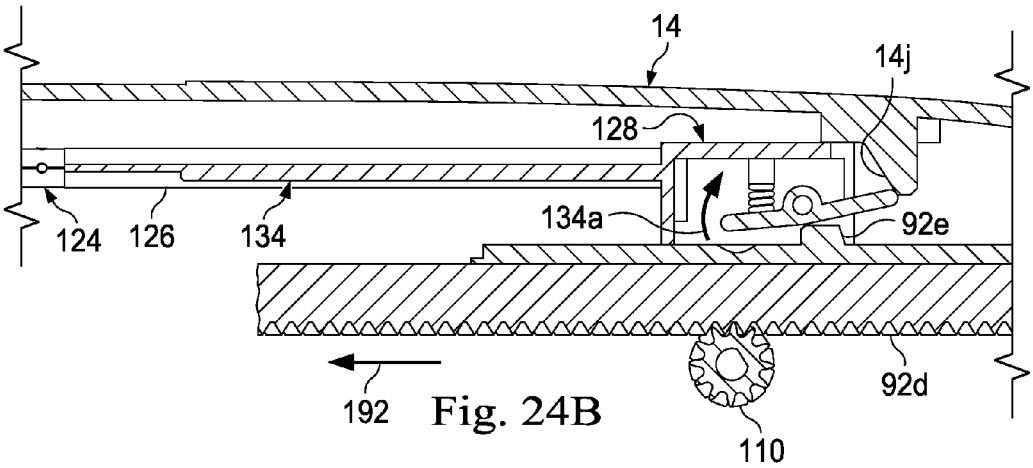
Figure 24C:
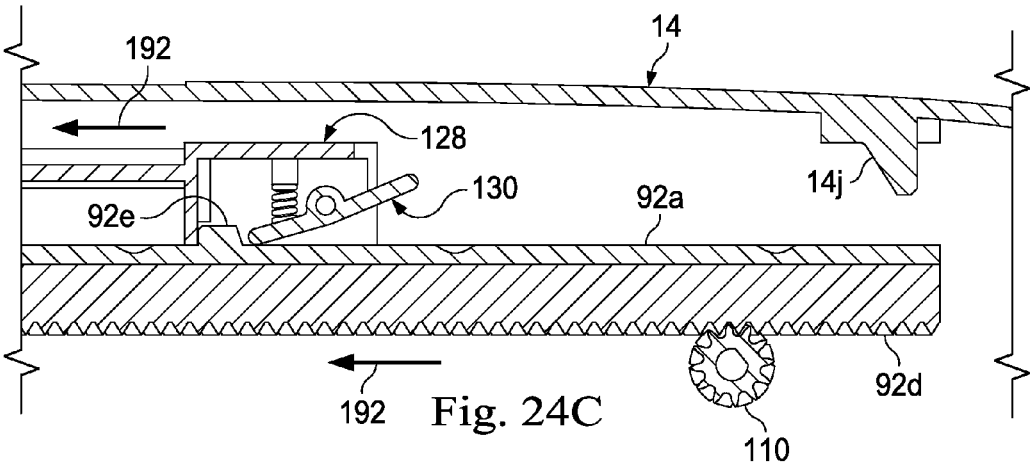

In an exemplary embodiment, as illustrated in FIGS. 24A-24C with continuing reference to FIGS. 1-23C, after the steps 184*i*, 184*j*, and 184*k*, the step 184*e* is repeated to insert the push rod 124 and the tobacco carrot formed at the step 184*k* into the tube 190. To this end, as described above, the carriage assembly 20 moves in the direction indicated by the arrow 192, and the carrot injection assembly 28 is placed in its operational mode in which it is operably coupled to the carriage assembly 20. More particularly, as shown in FIG. 24A, the rack bar 92 moves to the left, in the direction indicated by the arrow 192 and relative to the carrot injection assembly 28. At this point, the spring 132 is pushing the inside arm 130*c* of the paddle 130 against the top surface 92*a* of the rack bar 92. As shown in FIG. 24B, the protrusion 92*e* engages the inside arm 130*c*, causing the paddle 130 to rotate about the pin connection 130*a*, in a clockwise direction as viewed in FIG. 24B and indicated by the arrow 134*a*. In response, the spring 132 is compressed. The protrusion 92*e* slides against the underside of the inside arm 130*c*. As shown in FIG. 23C, after the protrusion 92*e* has moved past the inside arm 130*c*, the spring 132 causes the paddle 130 to rotate in a counterclockwise direction as viewed in FIG. 23C, so that the inside arm 130*c* again engages the top surface 92*a* of the rack 92. The protrusion 92*e* engages the side wall 128*a* of the box 128 of the carrot injection assembly 28. As a result, the carrot injection assembly 28 is operably coupled to the carriage assembly 20. The carrot injection assembly 28 moves with the carriage assembly 20 in the direction indicated by the arrow 192, in order to complete the step 184*e*.

Figure 25:
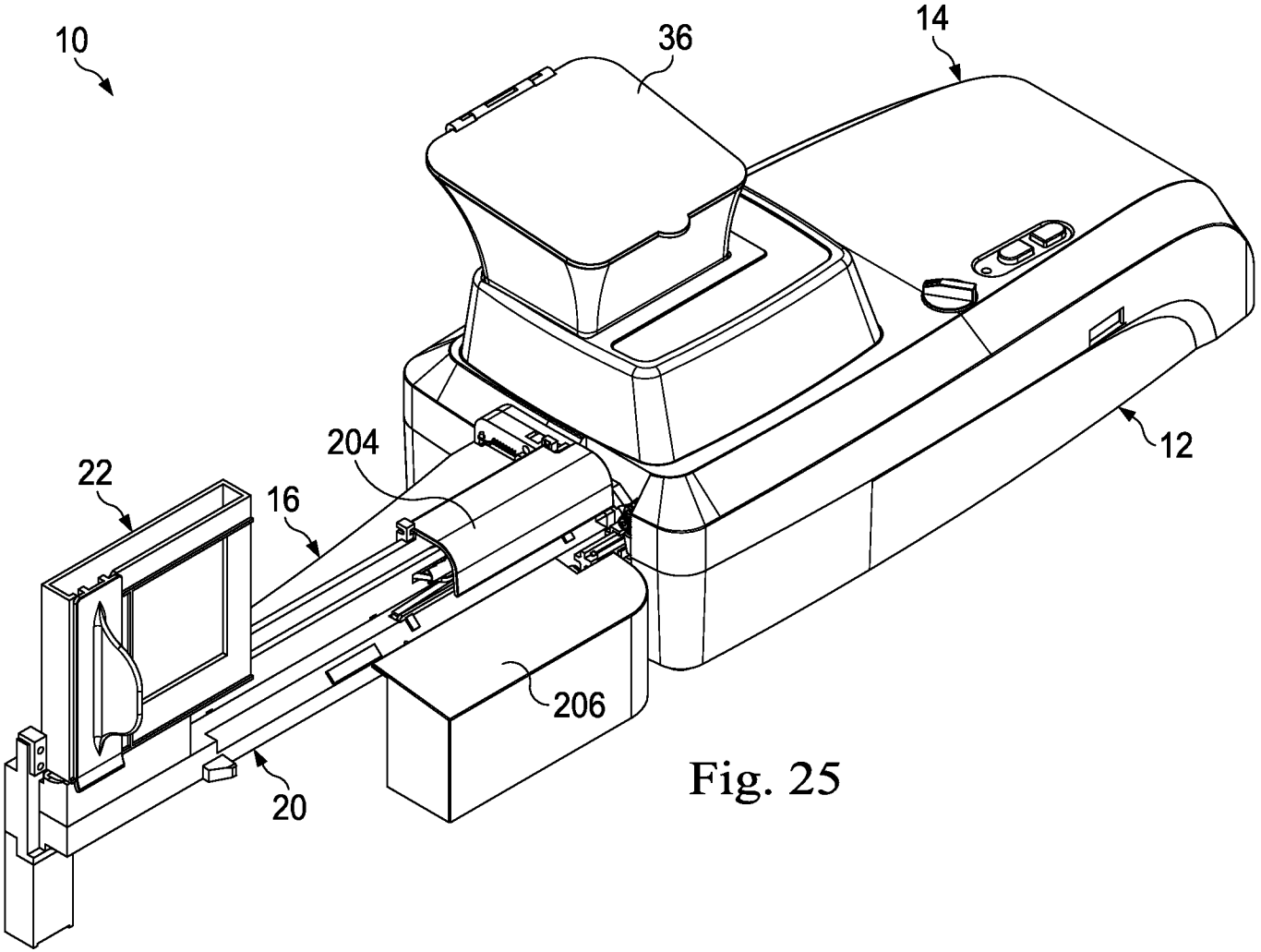
FIG. 25 is a perspective view of a cigarette manufacturing machine according to an exemplary embodiment.

In an exemplary embodiment, as illustrated in FIG. 25 with continuing reference to FIGS. 1-24C, the machine 10 includes a guard 204, which is connected to the horizontal support 16 and extends over the region where each of the tubes 186 and 190 is loaded onto the mandrel 114 and respective tobacco carrots are inserted into each of the tubes 186 and 190. Additionally, in an exemplary embodiment, the machine 10 includes a ramp 206 positioned below the guard 204 and adjacent the angular surface 104 of the horizontal support. In several exemplary embodiments, at the step 184*h*, the cigarette 186' rolls down the ramp 206 and into a container or tray (not shown), which container or tray may be connected to the ramp 206 at the base thereof.

In an exemplary embodiment, as illustrated in FIG. 17G with reference to FIG. 5, the humidity sensor 62 engages a wall of the hopper 34 so that pins of the humidity sensor 62 extend within, or are adjacent, the internal region defined by the hopper 34 and in which pre-cut tobacco leaves are disposed. In an exemplary embodiment, the humidity sensor 62 is supported by the guard 32 and/or the top of the upper housing 14; one or more support brackets may be connected to the guard 32 and/or the upper housing 14 to support the humidity sensor 62. In an exemplary embodiment, the humidity sensor 62 is, or includes, an HQRP® JT-4G digital moisture meter. In an exemplary embodiment, the humidity sensor 62 is in electrical communication with the PCB 46*a* via one or more wires. In an exemplary embodiment, the humidity sensor 62 is in wireless communication with the PCB 46*a* or electronic devices connected thereto. During the above-described operation of the machine 10, in several exemplary embodiments, the humidity sensor 62 measures the moisture content or humidity within the hopper 34, and sends to the controller 46 one or more signals corresponding to the humidity level within the hopper 34. If the controller 46 determines that the moisture content or humidity level within the hopper 34, as measured by the humidity sensor 62, is outside of a predetermined range, the controller 46 automatically stops the operation of the machine 10, including automatically preventing the carriage assembly 20 from moving. In an exemplary embodiment, the range is from about 5% humidity to about 20% humidity; if the humidity level within the internal region defined by the hopper 34, as measured by the humidity sensor 62, is below 5% or above 20%, the controller 46 stops the operation of the machine 10. In an exemplary embodiment, the range is from about 12% humidity to about 20% humidity; if the humidity level within the internal region defined by the hopper 34, as measured by the humidity sensor 62, is below 12% or above 20%, the controller 46 stops the operation of the machine 10. This functionality facilitates the maintenance of the machine 10 and ensures that high-quality cigarettes are manufactured by the machine 10. In an exemplary embodiment, if the humidity sensor 62 determines that the moisture content or humidity level within the hopper 34 is outside of the predetermined range, the controller 46 stops the operation of the machine 10 and provides a functional alert to the user of the machine 10 indicating that the pre-cut tobacco leaves in the hopper 34 need to be replaced; in an exemplary embodiment, such a functional indicator is, or includes, one or more flashing lights, such as an LED that may be located between the switch 38 and the button 40.

In several exemplary embodiments, the humidity sensor 62 is installed on the hopper 34 in the vicinity of the middle star wheels 142. In several exemplary embodiments, the humidity sensor 62 is positioned within the hopper 34, outside of the hopper 34, or both within and outside of the hopper 34, on one or more sides thereof.

Although not shown in the figures, in several exemplary embodiments, a guard is connected to the upper housing 14, and extends from the opening 14*a* in a direction opposite the direction of extension of the horizontal support 16 from the upper housing 14. The longitudinal length of the guard extending from the upper housing at the opening 14*a* is equal to, or greater than, the length of the portion of the rack bar 92 that extends out of the upper housing 14, via the opening 14*a*, during the above-described operation of the machine 10. Due to the length of the guard, the rack bar 92 is prevented from contacting any items in the vicinity of the machine 10 during the operation thereof.

In an exemplary embodiment, the size of the tube magazine assembly 22 may be increased so that it can hold more than 10 empty tubes; correspondingly, the height of the hopper 34 may be increased to hold enough pre-cut tobacco leaves to manufacture cigarettes using the increased quantity of empty tubes, and the controller 46 may be programmed so that the controller 46 stops the operation of the machine 10 after the step 184*g* has been executed a number of times equal to the increased quantity of empty cigarette tubes that the tube magazine assembly 22 can hold.

In several exemplary embodiments, the controller 46 counts the cumulative life-to-date number of cigarettes manufactured by the machine 10. After each operation of the machine 10, the controller 46 stores this cumulative number of manufactured. In several exemplary embodiments, the machine 10 includes a display that indicates this cumulative number of manufactured cigarettes.

As noted above, in an exemplary embodiment, the controller 46 counts the number of times the step 184*g* is executed; once this number is equal to the quantity of empty cigarette tubes that the tube magazine assembly 22 can hold, the controller 46 stops the operation of the machine 10. In an exemplary embodiment, the controller 46 causes the carriage 90 to move back to its initial position below the tube magazine assembly 20, as shown in FIG. 17B. As a result, the angularly-extending surface 90*j* of the tab 90*i* of the carriage 90 engages the angularly-extending surface 82*f* of the protrusion 82*e* of the bottom door 82, overcoming the biasing force of the torsion spring 82*b* so that the bottom door 82 pivots about the hinged connected 82*a* and in the direction indicated by the arrow 86*b* in FIGS. 8C, 8D, and 18C. The protrusion 82*e* may be pushed into the notch 16*i*.

As a result, the channel 90*d* of the carriage is ready to receive another empty tube when operation of the machine 10 is re-started.

In an exemplary embodiment, the on/off button 42 is activated, and then the pause/start button 40 is activated to begin the above-described operation of the machine 10. In an exemplary embodiment, if the on/off button 42 is activated during the operation of the machine 10, the controller 46 causes the carriage 90 to move back to its initial position below the tube magazine assembly 20, as shown in FIG. 17B. In an exemplary embodiment, if the pause/start button 40 is activated during the operation of the machine 10, the controller 46 causes the machine 10 to pause all component movements occurring at that time; at this point, in an exemplary embodiment, again activating the pause/start button 40 will re-start the operation of the machine 10.

In an exemplary embodiment, the motor 54 includes an overload sensor that detects whether there is too much resistance against the push rod 124 when the push rod 124 begins to move out of the cavity 176 at the step 184*e*, along with the carrot formed at the step 184*d*. In several exemplary embodiments, this resistance may be due to the pre-cut tobacco leaves of the carrot formed at the step 184*d* being too moist, and/or there being too many pre-cut tobacco leaves in the cavity 176.

In an exemplary embodiment, one or more cylindrical guides extend from the vertically-extending wall 16*b* at a vertical position slightly above the carriage 90, and at a horizontal position between the post 16*f* and the slot 16*j*. As the carriage 90 travels below the cylindrical guides, the guides ensure that the empty tube in the carriage 90 remains seated in the channel 90*d* of the carriage 90.

In several exemplary embodiments, the operation of the machine 10, and/or the execution of the method 184, automatically manufactures a plurality of cigarettes precisely, uniformly, and efficiently. In several exemplary embodiments, during the operation of the machine 10 and/or the execution of the method 184, the tubes 196 are not damaged. Additionally, in several exemplary embodiments, the respective tobacco carrots formed at the step 184*d* and at different iterations of the step 184*k* include enough compacted tobacco. In several exemplary embodiments, the machine 10 is able to accommodate user preferences such as, for example, the amount of tobacco the user desires to be included in each cigarette, or environmental considerations such as, for example, humidity.

Figure 26:
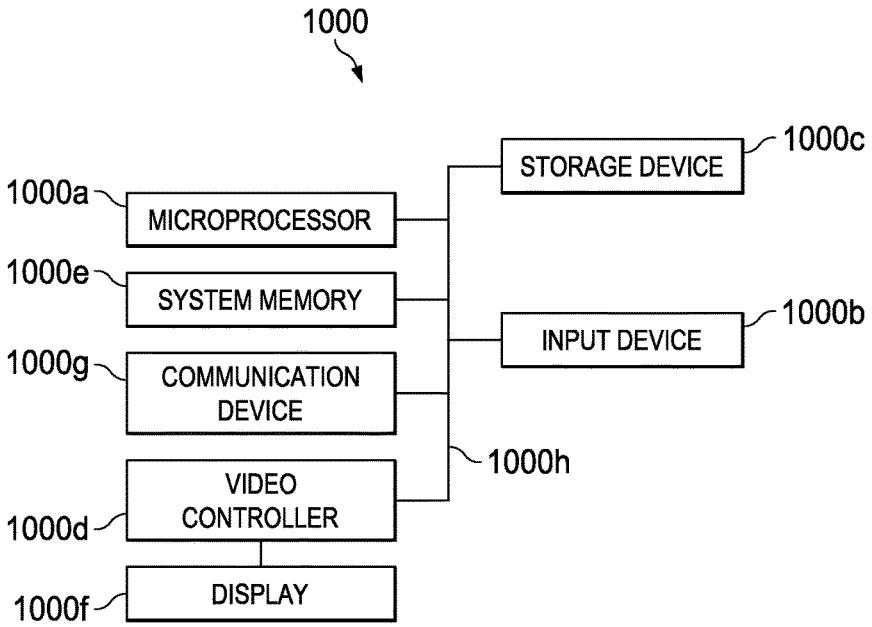
FIG. 26 is a diagrammatic illustration of a node for implementing one or more exemplary embodiments of the present disclosure, according to an exemplary embodiment.

In an exemplary embodiment, as illustrated in FIG. 26 with continuing reference to FIGS. 1-25, an illustrative computing device 1000 for implementing one or more embodiments of one or more of the above-described networks, elements, methods and/or steps, and/or any combination thereof, is depicted. The computing device 1000 includes a processor 1000*a*, an input device 1000*b*, a storage device 1000*c*, a video controller 1000*d*, a system memory 1000*e*, a display 1000*f*, and a communication device 1000*g*, all of which are interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer readable medium that may contain executable instructions. In an exemplary embodiment, the computer readable medium is a non-transitory tangible media. In several exemplary embodiments, the communication device 1000*g* may include a modem, network card, or any other device to enable the computing device 1000 to communicate with other computing devices. In several exemplary embodiments, any computing device represents a plurality of interconnected (whether by intranet or Internet) computer systems, including without limitation, personal computers, mainframes, PDAs, smartphones and cell phones.

In several exemplary embodiments, the controller 46, is, or at least includes, the computing device 1000 and/or components thereof, and/or one or more computing devices that are substantially similar to the computing device 1000 and/or components thereof. In several exemplary embodiments, one or more of the above-described components of one or more of the computing device 1000 and the controller 46, and/or one or more components thereof, include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several exemplary embodiments, hardware may include any physical device that is capable of storing machine-readable instructions, such as memory or Other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In an exemplary embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In an exemplary embodiment, a data structure may provide an organization of data, or an organization of executable code.

In several exemplary embodiments, a database may be any standard or proprietary database software. In several exemplary embodiments, the database may have fields, records, data, and other database elements that may be associated through database specific software. In several exemplary embodiments, data may be mapped. In several exemplary embodiments, mapping is the process of associating one data entry with another data entry. In an exemplary embodiment, the data contained in the location of a character file can be mapped to a field in a second table. In several exemplary embodiments, the physical location of the database is not limiting, and the database may be distributed. In an exemplary embodiment, the database may exist remotely from the server, and run on a separate platform. In an exemplary embodiment, the database may be accessible across the Internet. In several exemplary embodiments, more than one database may be implemented.

In several exemplary embodiments, a computer program, such as a plurality of instructions stored on a non-transitory computer readable medium, may be executed by a processor to cause the processor to carry out or implement in whole or in part the operation of the machine 10, the method 184, and/or any combination thereof. In several exemplary embodiments, such a processor may include the processor 1000*a*. In several exemplary embodiments, such a processor may execute the plurality of instructions in connection with a virtual computer system.

The present disclosure introduces an apparatus for manufacturing cigarettes, the apparatus including a housing; a mandrel extending from the housing; and a movable member operably coupled to the housing and adapted to carry a first cigarette tube; wherein the movable member is movable, relative to each of the housing and the mandrel, in a first direction and a second direction that is opposite the first direction. In an exemplary embodiment, when the movable member carries the first cigarette tube, the first cigarette tube is loaded on the mandrel in response to movement of the movable member in the first direction. In an exemplary embodiment, the apparatus includes a clamping member operably coupled to the housing; wherein, when the movable member carries the first cigarette tube, the wall of the first cigarette tube is clamped between the mandrel and the clamping member in response to the movement of the movable member in the first direction. In an exemplary embodiment, the apparatus includes a push rod operably coupled to the housing and adapted to carry pre-cut tobacco leaves; wherein, when the first cigarette tube is loaded on the mandrel, the push rod and the pre-cut tobacco leaves are inserted, via the mandrel, into the first cigarette tube in response to movement of the movable member in the second direction. In an exemplary embodiment, an offset distance is defined between the first cigarette tube and the mandrel after the push rod and the pre-cut tobacco leaves are inserted into the first cigarette tube. In an exemplary embodiment, the movable member is adapted to carry a second cigarette tube in response to the movement of the movable member in the second direction. In an exemplary embodiment, when the movable member carries the second cigarette tube: the push rod is removed from the tobacco-leaves-filled first cigarette tube, while the position of the tobacco-leaves-filled first cigarette tube is generally maintained, in response to another movement of the movable member in the first direction after the movement of the movable member in the second direction; and the second cigarette tube is loaded on the mandrel in response to the another movement of the movable member in the first direction. In an exemplary embodiment, the mandrel defines a longitudinal axis along the topside thereof; wherein the mandrel includes a bevel formed at the distal end of the mandrel on the underside thereof so that the topside of the mandrel is longer than the underside of the mandrel; wherein the bevel defines a tip on the topside of the mandrel, the tip generally lying on the longitudinal axis; and wherein the bevel defines an angle from the longitudinal axis. In an exemplary embodiment, the angle is less than 45 degrees. In an exemplary embodiment, the angle is equal to, or less than, about 30 degrees. In an exemplary embodiment, the apparatus includes a motor to drive the movable member in the first and second directions. In an exemplary embodiment, the apparatus includes a stationary wall disposed within the housing; a movable wall disposed within the housing and movable between an extended position near the stationary wall and a retracted position away from the stationary wall; a variable-sized cavity defined between the stationary wall and movable wall, wherein the cavity is generally cylindrically shaped when the movable wall is in the extended position near the stationary wall; and a push rod adapted to extend out of, and retract back into, the cavity via the mandrel. In an exemplary embodiment, the apparatus includes one or more star wheels adapted to rotate to introduce pre-cut tobacco leaves into the cavity; and a plunger block movable between a first position in which the plunger block does not compact the pre-cut tobacco leaves in the cavity and a second position in which the plunger block compacts the pre-cut tobacco leaves in the cavity; wherein the plunger block and the one or more star wheels are synchronized so that the one or more star wheels rotate when the plunger block is in its first position and do not rotate when the plunger block is in its second position. In an exemplary embodiment, the apparatus includes a push rod adapted to carry pre-cut tobacco leaves and having: a first operational mode in which the push rod is operably coupled to the movable member so that the push rod is movable with the movable member in the first and second directions; and a second operational mode in which the push rod is not operably coupled to the movable member and thus is not movable with the movable member in the first and second directions. In an exemplary embodiment, when the movable member carries the first cigarette tube, the first cigarette tube is loaded on the mandrel in response to movement of the movable member in the first direction; wherein the operational mode of the push rod changes from the first operational mode to the second operational mode in response to the movement of the movable member in the first direction; wherein the operational mode of the push rod changes from the second operational mode to the first operational mode in response to movement of the movable member in the second direction; and wherein, when the first cigarette tube is loaded on the mandrel, the push rod and the pre-cut tobacco leaves are inserted, via the mandrel, into the first cigarette tube in response to the movement of the movable member in the second direction. In an exemplary embodiment, the apparatus includes a hopper operably coupled to the housing and in which pre-cut tobacco leaves are adapted to be disposed; and a humidity sensor adapted to measure a humidity level within the hopper; wherein the movable arm is automatically prevented from moving when the humidity level within the hopper, as measured by the humidity sensor, is outside of a predetermined range.

The present disclosure also introduces a method of manufacturing cigarettes, the method including loading a first cigarette tube on a mandrel; holding the first cigarette tube on the mandrel; and inserting a push rod and a carrot of pre-cut tobacco leaves into the first cigarette tube, the carrot of pre-cut tobacco leaves having a generally cylindrical shape; wherein an offset distance is defined between the first cigarette tube and the mandrel after the push rod and the carrot of pre-cut tobacco leaves are inserted into the first cigarette tube. In an exemplary embodiment, the method includes disposing the first cigarette tube in a carrier connected to a movable member; wherein loading the first cigarette tube on the mandrel includes moving the movable member in a first direction; wherein holding the first cigarette tube on the mandrel includes continuing to move the movable member in the first direction; and wherein inserting the push rod and the carrot of pre-cut tobacco leaves into the first cigarette tube includes moving the movable member in a second direction that is opposite the first direction. In an exemplary embodiment, the method includes removing the push rod from the carrot-filled first cigarette tube while the position of the carrot-filled first cigarette tube is generally maintained, including moving the movable member in the first direction after moving the movable member in the second direction. In an exemplary embodiment, the method includes forming the carrot of pre-cut tobacco leaves, including introducing the pre-cut tobacco leaves into a cavity; and compacting the pre-cut tobacco leaves in the cavity; wherein the pre-cut tobacco leaves are compacted in the cavity in response to the movement of the movable member in the first direction. In an exemplary embodiment, the method includes forming the carrot of pre-cut tobacco leaves further includes decreasing the size of the cavity until the cavity is generally cylindrically shaped. In an exemplary embodiment, the method includes engaging a pinion with the movable member and operably coupling a first motor to the pinion; wherein moving the movable member in the first direction includes driving the first motor so that the pinion rotates in a first rotational direction; wherein moving the movable member in the second direction includes driving the first motor so that the pinion rotates in a second rotational direction that is opposite the first rotational direction; wherein introducing the pre-cut tobacco leaves into the cavity includes driving a second motor; and wherein decreasing the size of the cavity until the cavity is generally cylindrically shaped includes driving a third motor. In an exemplary embodiment, the method includes disposing a second cigarette tube in the carrier, wherein the second cigarette tube is disposed in the carrier in response to the movement of the movable member in the second direction; loading the second cigarette tube on the mandrel, including moving the movable member in the first direction after moving the movable member in the second direction; and permitting the carrot-filled first cigarette tube to fall out of the way of the second cigarette tube in response to moving the movable member in the first direction to load the second cigarette tube on the mandrel. In an exemplary embodiment, the method includes holding the second cigarette tube on the mandrel; and inserting the push rod and another carrot of pre-cut tobacco leaves into the second cigarette tube. In an exemplary embodiment, the method includes disposing the pre-cut tobacco leaves in a hopper; measuring the humidity level within the hopper; determining that the humidity level within the hopper is outside of a predetermined range; and automatically preventing the movable arm from moving in response to determining that the humidity level within the hopper is outside of the predetermined range.

The present disclosure also introduces a system for manufacturing cigarettes, the system including means for loading a first cigarette tube on a mandrel; means for holding the first cigarette tube on the mandrel; and means for inserting a push rod and a carrot of pre-cut tobacco leaves into the first cigarette tube, the carrot of pre-cut tobacco leaves having a generally cylindrical shape; wherein an offset distance is defined between the first cigarette tube and the mandrel after the push rod and the carrot of pre-cut tobacco leaves are inserted into the first cigarette tube. In an exemplary embodiment, the system includes means for disposing the first cigarette tube in a carrier connected to a movable member; wherein means for loading the first cigarette tube on the mandrel includes means for moving the movable member in a first direction; wherein means for holding the first cigarette tube on the mandrel includes means for continuing to move the movable member in the first direction; and wherein means for inserting the push rod and the carrot of pre-cut tobacco leaves into the first cigarette tube includes means for moving the movable member in a second direction that is opposite the first direction. In an exemplary embodiment, the system includes means for removing the push rod from the carrot-filled first cigarette tube while the position of the carrot-filled first cigarette tube is generally maintained, including means for moving the movable member in the first direction after moving the movable member in the second direction. In an exemplary embodiment, the system includes means for forming the carrot of pre-cut tobacco leaves, including means for introducing the pre-cut tobacco leaves into a cavity; and means for compacting the pre-cut tobacco leaves in the cavity; wherein the pre-cut tobacco leaves are compacted in the cavity in response to the movement of the movable member in the first direction. In an exemplary embodiment, means for forming the carrot of pre-cut tobacco leaves further includes means for decreasing the size of the cavity until the cavity is generally cylindrically shaped. In an exemplary embodiment, the system includes means for engaging a pinion with the movable member and operably coupling a first motor to the pinion; wherein means for moving the movable member in the first direction includes means for driving the first motor so that the pinion rotates in a first rotational direction; wherein means for moving the movable member in the second direction includes driving the first motor so that the pinion rotates in a second rotational direction that is opposite the first rotational direction; wherein means for introducing the pre-cut tobacco leaves into the cavity includes means for driving a second motor; and wherein means for decreasing the size of the cavity until the cavity is generally cylindrically shaped includes means for driving a third motor. In an exemplary embodiment, the system includes means for disposing a second cigarette tube in the carrier, wherein the second cigarette tube is disposed in the carrier in response to the movement of the movable member in the second direction; means for loading the second cigarette tube on the mandrel, including moving the movable member in the first direction after moving the movable member in the second direction; and means for permitting the carrot-filled first cigarette tube to fall out of the way of the second cigarette tube in response to moving the movable member in the first direction to load the second cigarette tube on the mandrel. In an exemplary embodiment, the system includes means for holding the second cigarette tube on the mandrel; and means for inserting the push rod and another carrot of pre-cut tobacco leaves into the second cigarette tube. In an exemplary embodiment, the system includes means for disposing the pre-cut tobacco leaves in a hopper; means for measuring the humidity level within the hopper; means for determining that the humidity level within the hopper is outside of a predetermined range; and means for automatically preventing the movable arm from moving in response to determining that the humidity level within the hopper is outside of the predetermined range.

The present disclosure also introduces a non-transitory computer readable medium that includes a plurality of instructions stored thereon and executable by one or more processors, the plurality of instructions including instructions for loading a first cigarette tube on a mandrel; instructions for holding the first cigarette tube on the mandrel; and instructions for inserting a push rod and a carrot of pre-cut tobacco leaves into the first cigarette tube, the carrot of pre-cut tobacco leaves having a generally cylindrical shape; wherein an offset distance is defined between the first cigarette tube and the mandrel after the push rod and the carrot of pre-cut tobacco leaves are inserted into the first cigarette tube. In an exemplary embodiment, the plurality of instructions includes instructions for disposing the first cigarette tube in a carrier connected to a movable member; wherein instructions for loading the first cigarette tube on the mandrel include instructions for moving the movable member in a first direction; wherein instructions for holding the first cigarette tube on the mandrel include instructions for continuing to move the movable member in the first direction; and wherein instructions for inserting the push rod and the carrot of pre-cut tobacco leaves into the first cigarette tube include instructions for moving the movable member in a second direction that is opposite the first direction. In an exemplary embodiment, the plurality of instructions includes instructions for removing the push rod from the carrot-filled first cigarette tube while the position of the carrot-filled first cigarette tube is generally maintained, including instructions for moving the movable member in the first direction after moving the movable member in the second direction. In an exemplary embodiment, the plurality of instructions includes instructions for forming the carrot of pre-cut tobacco leaves, including instructions for introducing the pre-cut tobacco leaves into a cavity; and instructions for compacting the pre-cut tobacco leaves in the cavity; wherein the pre-cut tobacco leaves are compacted in the cavity in response to the movement of the movable member in the first direction. In an exemplary embodiment, instructions for forming the carrot of pre-cut tobacco leaves further include instructions for decreasing the size of the cavity until the cavity is generally cylindrically shaped. In an exemplary embodiment, instructions for moving the movable member in the first direction include instructions for driving a first motor so that a pinion rotates in a first rotational direction; wherein instructions for moving the movable member in the second direction include driving the first motor so that the pinion rotates in a second rotational direction that is opposite the first rotational direction; wherein instructions for introducing the pre-cut tobacco leaves into the cavity include instructions for driving a second motor; and wherein instructions for decreasing the size of the cavity until the cavity is generally cylindrically shaped include instructions for driving a third motor. In an exemplary embodiment, the plurality of instructions includes instructions for disposing a second cigarette tube in the carrier, wherein the second cigarette tube is disposed in the carrier in response to the movement of the movable member in the second direction; instructions for loading the second cigarette tube on the mandrel, including moving the movable member in the first direction after moving the movable member in the second direction; and instructions for permitting the carrot-filled first cigarette tube to fall out of the way of the second cigarette tube in response to moving the movable member in the first direction to load the second cigarette tube on the mandrel. In an exemplary embodiment, the plurality of instructions includes instructions for holding the second cigarette tube on the mandrel; and instructions for inserting the push rod and another carrot of pre-cut tobacco leaves into the second cigarette tube. In an exemplary embodiment, the plurality of instructions includes instructions for disposing the pre-cut tobacco leaves in a hopper; instructions for measuring the humidity level within the hopper; instructions for determining that the humidity level within the hopper is outside of a predetermined range; and instructions for automatically preventing the movable arm from moving in response to determining that the humidity level within the hopper is outside of the predetermined range.

The present disclosure also introduces an apparatus according to one or more embodiments of the present disclosure. The present disclosure also introduces a method including at least one step according to one or more aspects of the present disclosure.

The present disclosure also introduces a system comprising at least one component having at least one character according to one or more aspects of the present disclosure. The present disclosure also introduces a kit including at least one component having at least one character according to one or more aspects of the present disclosure.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upward," "downward," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. An apparatus for manufacturing cigarettes, the apparatus comprising:

a housing;

a mandrel extending from the housing; and a movable member operably coupled to the housing and adapted to carry a first cigarette tube;

wherein the movable member is movable, relative to each of the housing and the mandrel, in a first direction and a second direction that is opposite the first direction; and wherein the apparatus further comprises a push rod adapted to carry pre-cut tobacco leaves and having:

a first operational mode in which the push rod is operably coupled to the movable member so that the push rod is movable with the movable member in the first and second directions; and a second operational mode in which the push rod is not operably coupled to the movable member and thus is not movable with the movable member in the first and second directions.

2. The apparatus of claim 1, wherein, when the movable member carries the first cigarette tube, the first cigarette tube is loaded on the mandrel in response to movement of the movable member in the first direction.

3. The apparatus of claim 2, further comprising a clamping member operably coupled to the housing;

wherein, when the movable member carries the first cigarette tube, the wall of the first cigarette tube is clamped between the mandrel and the clamping member in response to the movement of the movable member in the first direction.

4. The apparatus of claim 2, wherein, when the first cigarette tube is loaded on the mandrel, the push rod and the pre-cut tobacco leaves are inserted, via the mandrel, into the first cigarette tube in response to movement of the movable member in the second direction.

5. The apparatus of claim 4, wherein an offset distance is defined between the first cigarette tube and the mandrel after the push rod and the pre-cut tobacco leaves are inserted into the first cigarette tube.

6. The apparatus of claim 4, wherein the movable member is adapted to carry a second cigarette tube in response to the movement of the movable member in the second direction.

7. The apparatus of claim 6, wherein, when the movable member carries the second cigarette tube:

the push rod is removed from the tobacco-leaves-filled first cigarette tube, while the position of the tobacco-leaves-filled first cigarette tube is generally maintained, in response to another movement of the movable member in the first direction after the movement of the movable member in the second direction; and the second cigarette tube is loaded on the mandrel in response to the another movement of the movable member in the first direction.

8. The apparatus of claim 1, wherein the mandrel defines a longitudinal axis along the topside thereof;

wherein the mandrel comprises a bevel formed at the distal end of the mandrel on the underside thereof so that the topside of the mandrel is longer than the underside of the mandrel;

wherein the bevel defines a tip on the topside of the mandrel, the tip generally lying on the longitudinal axis; and wherein the bevel defines an angle from the longitudinal axis.

9. The apparatus of claim 8, wherein the angle is less than 45 degrees.

10. The apparatus of claim 9, wherein the angle is equal to, or less than, about 30 degrees.

11. The apparatus of claim 1, further comprising a motor to drive the movable member in the first and second directions.

12. The apparatus of claim 1, further comprising:

a stationary wall disposed within the housing;

a movable wall disposed within the housing and movable between an extended position near the stationary wall and a retracted position away from the stationary wall; and a variable-sized cavity defined between the stationary wall and movable wall, wherein the cavity is generally cylindrically shaped when the movable wall is in the extended position near the stationary wall;

wherein the push rod is adapted to extend out of, and retract back into, the cavity via the mandrel.

13. The apparatus of claim 12, further comprising:

one or more star wheels adapted to rotate to introduce the pre-cut tobacco leaves into the cavity; and a plunger block movable between a first position in which the plunger block does not compact the pre-cut tobacco leaves in the cavity and a second position in which the plunger block compacts the pre-cut tobacco leaves in the cavity;

wherein the plunger block and the one or more star wheels are synchronized so that the one or more star wheels rotate when the plunger block is in its first position and do not rotate when the plunger block is in its second position.

14. The apparatus of claim 1, wherein, when the movable member carries the first cigarette tube, the first cigarette tube is loaded on the mandrel in response to movement of the movable member in the first direction;

wherein the operational mode of the push rod changes from the first operational mode to the second operational mode in response to the movement of the movable member in the first direction;

wherein the operational mode of the push rod changes from the second operational mode to the first operational mode in response to movement of the movable member in the second direction; and wherein, when the first cigarette tube is loaded on the mandrel, the push rod and the pre-cut tobacco leaves are inserted, via the mandrel, into the first cigarette tube in response to the movement of the movable member in the second direction.

15. The apparatus of claim 1, further comprising:

a hopper operably coupled to the housing and in which pre-cut tobacco leaves are adapted to be disposed; and a humidity sensor adapted to measure a humidity level within the hopper;

wherein the movable member is automatically prevented from moving when the humidity level within the hopper, as measured by the humidity sensor, is outside of a predetermined range.

16. An apparatus for manufacturing cigarettes, the apparatus comprising:

a housing;

a mandrel extending from the housing; and a movable member operably coupled to the housing and adapted to carry a first cigarette tube;

wherein the movable member is movable, relative to each of the housing and the mandrel, in a first direction and a second direction that is opposite the first direction;

wherein, when the movable member carries the first cigarette tube, the first cigarette tube is loaded on the mandrel in response to movement of the movable member in the first direction;

wherein the apparatus further comprises a push rod operably coupled to the housing and adapted to carry pre-cut tobacco leaves;

wherein, when the first cigarette tube is loaded on the mandrel, the push rod and the pre-cut tobacco leaves are inserted, via the mandrel, into the first cigarette tube in response to movement of the movable member in the second direction;

wherein the movable member is adapted to carry a second cigarette tube in response to the movement of the movable member in the second direction;

and wherein, when the movable member carries the second cigarette tube:

the push rod is removed from the tobacco-leaves-filled first cigarette tube, while the position of the tobacco-leaves-filled first cigarette tube is generally maintained, in response to another movement of the movable member in the first direction after the movement of the movable member in the second direction; and the second cigarette tube is loaded on the mandrel in response to the another movement of the movable member in the first direction.

17. The apparatus of claim 16, further comprising a clamping member operably coupled to the housing;

wherein, when the movable member carries the first cigarette tube, the wall of the first cigarette tube is clamped between the mandrel and the clamping member in response to the movement of the movable member in the first direction.

18. The apparatus of claim 16, wherein an offset distance is defined between the first cigarette tube and the mandrel after the push rod and the pre-cut tobacco leaves are inserted into the first cigarette tube.

19. The apparatus of claim 16, wherein the mandrel defines a longitudinal axis along the topside thereof;

wherein the mandrel comprises a bevel formed at the distal end of the mandrel on the underside thereof so that the topside of the mandrel is longer than the underside of the mandrel;

wherein the bevel defines a tip on the topside of the mandrel, the tip generally lying on the longitudinal axis; and wherein the bevel defines an angle from the longitudinal axis.

20. The apparatus of claim 16, further comprising:

a stationary wall disposed within the housing;

a movable wall disposed within the housing and movable between an extended position near the stationary wall and a retracted position away from the stationary wall; and a variable-sized cavity defined between the stationary wall and movable wall, wherein the cavity is generally cylindrically shaped when the movable wall is in the extended position near the stationary wall;

wherein the push rod is adapted to extend out of, and retract back into, the cavity via the mandrel.

21. The apparatus of claim 20, further comprising:

one or more star wheels adapted to rotate to introduce the pre-cut tobacco leaves into the cavity; and a plunger block movable between a first position in which the plunger block does not compact the pre-cut tobacco leaves in the cavity and a second position in which the plunger block compacts the pre-cut tobacco leaves in the cavity;

wherein the plunger block and the one or more star wheels are synchronized so that the one or more star wheels rotate when the plunger block is in its first position and do not rotate when the plunger block is in its second position.

22. The apparatus of claim 16, wherein the push rod has:

a first operational mode in which the push rod is operably coupled to the movable member so that the push rod is movable with the movable member in the first and second directions; and a second operational mode in which the push rod is not operably coupled to the movable member and thus is not movable with the movable member in the first and second directions.

23. The apparatus of claim 22, wherein the operational mode of the push rod changes from the first operational mode to the second operational mode in response to the movement of the movable member in the first direction; and wherein the operational mode of the push rod changes from the second operational mode to the first operational mode in response to movement of the movable member in the second direction.

24. An apparatus for manufacturing cigarettes, the apparatus comprising:

a housing;

a mandrel extending from the housing; and a movable member operably coupled to the housing and adapted to carry a first cigarette tube;

wherein the movable member is movable, relative to each of the housing and the mandrel, in a first direction and a second direction that is opposite the first direction;

wherein, when the movable member carries the first cigarette tube, the first cigarette tube is loaded on the mandrel in response to movement of the movable member in the first direction;

wherein the apparatus further comprises a clamping member operably coupled to the housing;

wherein, when the movable member carries the first cigarette tube, the wall of the first cigarette tube is clamped between the mandrel and the clamping member in response to the movement of the movable member in the first direction;

wherein the apparatus further comprises a push rod operably coupled to the housing and adapted to carry pre-cut tobacco leaves;

wherein, when the first cigarette tube is loaded on the mandrel, the push rod and the pre-cut tobacco leaves are inserted, via the mandrel, into the first cigarette tube in response to movement of the movable member in the second direction;

wherein an offset distance is defined between the first cigarette tube and the mandrel after the push rod and the pre-cut tobacco leaves are inserted into the first cigarette tube;

wherein the movable member is adapted to carry a second cigarette tube in response to the movement of the movable member in the second direction;

wherein the apparatus further comprises:

a motor to drive the movable member in the first and second directions;

a stationary wall disposed within the housing;

a movable wall disposed within the housing and movable between an extended position near the stationary wall and a retracted position away from the stationary wall; and a variable-sized cavity defined between the stationary wall and movable wall, wherein the cavity is generally cylindrically shaped when the movable wall is in the extended position near the stationary wall;

wherein the push rod is adapted to extend out of, and retract back into, the cavity via the mandrel;

wherein the push rod has:

a first operational mode in which the push rod is operably coupled to the movable member so that the push rod is movable with the movable member in the first and second directions; and a second operational mode in which the push rod is not operably coupled to the movable member and thus is not movable with the movable member in the first and second directions;

wherein the operational mode of the push rod changes from the first operational mode to the second operational mode in response to the movement of the movable member in the first direction;

and wherein the operational mode of the push rod changes from the second operational mode to the first operational mode in response to movement of the movable member in the second direction.

25. The apparatus of claim 24, wherein the mandrel defines a longitudinal axis along the topside thereof;

wherein the mandrel comprises a bevel formed at the distal end of the mandrel on the underside thereof so that the topside of the mandrel is longer than the underside of the mandrel; and wherein the bevel defines a tip on the topside of the mandrel, the tip generally lying on the longitudinal axis.

26. The apparatus of claim 24, further comprising:

one or more star wheels adapted to rotate to introduce the pre-cut tobacco leaves into the cavity; and a plunger block movable between a first position in which the plunger block does not compact the pre-cut tobacco leaves in the cavity and a second position in which the plunger block compacts the pre-cut tobacco leaves in the cavity;

wherein the plunger block and the one or more star wheels are synchronized so that the one or more star wheels rotate when the plunger block is in its first position and do not rotate when the plunger block is in its second position.

* * * * *